US007749669B2

(12) United States Patent
Daifuku et al.

(10) Patent No.: US 7,749,669 B2
(45) **Date of Patent: *Jul. 6, 2010**

(54) ELECTROPHOTOGRAPHIC TONER AND IMAGE FORMING METHOD

(75) Inventors: Koji Daifuku, Hachioji (JP); Kaori Ono, Hino (JP)

(73) Assignee: Konica Minolta Holdings, Inc. (JP)

( * ) Notice: Subject to any disclaimer, the term of this patent is extended or adjusted under 35 U.S.C. 154(b) by 111 days.

This patent is subject to a terminal disclaimer.

(21) Appl. No.: 11/429,356

(22) Filed: May 5, 2006

(65) Prior Publication Data

US 2006/0257774 A1 Nov. 16, 2006

(30) Foreign Application Priority Data

May 16, 2005 (JP) ..... 2005-142378
Apr. 18, 2006 (JP) ..... 2006-114224

(51) Int. Cl.
*G03G 9/00* (2006.01)

(52) U.S. Cl. ..... 430/108.1; 430/110.2

(58) Field of Classification Search ..... 430/108.1, 430/110.2

See application file for complete search history.

(56) References Cited

U.S. PATENT DOCUMENTS 5,892,033 A * 4/1999 Komamura et al. ..... 544/225
6,153,345 A * 11/2000 Soeda et al. ..... 430/108.21
6,255,029 B1 * 7/2001 Hirose et al. ..... 430/137.14
7,205,406 B2 * 4/2007 Kataoka et al. ..... 544/405
2003/0149131 A1 * 8/2003 Ninomiya et al. ..... 523/160
2006/0093935 A1 * 5/2006 Ono et al. ..... 430/108.1
2006/0292472 A1 * 12/2006 Ono et al. ..... 430/108.3
2007/0092819 A1 * 4/2007 Daifuku et al. ..... 430/108.1
2007/0207398 A1 * 9/2007 Ono et al. ..... 430/107.1
2007/0259282 A1 * 11/2007 Ishidai et al. ..... 430/108.21

FOREIGN PATENT DOCUMENTS

JP 2001159832 * 6/2001

OTHER PUBLICATIONS

JP-09-138526 machine English language translation.*
JP-10-020559 machine English language translation.*
JP-10-265690(machine English language translation.*
JP-2001159832.*
Abstract of JP 11188965, Jul. 1999.*
Abstract of JP 2001031896, Feb. 2001.*
Abstract of JP 2002121443, Apr. 2002.*
Abstract of JP 2002121444, Apr. 2002.*
Abstract of JP 2002121445, Apr. 2002.*
Abstract of JP 2003171581, Jun. 2003.*
Abstract of JP 2006015684, Jan. 2006.*
Abstract of JP 2006016565, Jan. 2006.*
Grant, et al. "Grant & Hackh's Chemical Dictionary Fifth Edition", cover; introductory page; p. 127, col. 1, definition for "Chelate"; enlarged p. 176 for definition of Chelate; p. 176, col. 2, definition for "Dentate"; enlarged p. 176 for definition of "Dentate".
Parker, Sybil P. "McGraw-Hill Dictionary of Scientific and Technical Terms Fifth Edition" cover; introductory page; p. 2019, col. 1, definition of "thermoplastic resin", enlarged pg. for definition of "thermoplastic resin".

* cited by examiner

*Primary Examiner*—Hoa V Le
(74) *Attorney, Agent, or Firm*—Cantor Colburn LLP

(57) ABSTRACT

An electrophotographic toner which achieves superior coloring without exhibiting any difficulty in dispersibility in thermoplastic resin while exhibiting improved characteristics, is disclosed, comprising a thermoplastic resin and a metal chelate dye contained in the thermoplastic resin and represented by the following formula:

$$M(L_1)(L_2)_n(X_1)_m(X_2)_l.W_1$$

Image forming method by use of the toner is also disclosed.

15 Claims, 1 Drawing Sheet

ELECTROPHOTOGRAPHIC TONER AND IMAGE FORMING METHOD

This application claims priority from Japanese Patent Application No. JP2005-142378 filed on May 16, 2005 and JP2006-114224 filed on Apr. 18, 2006, which are incorporated hereinto by reference.

FIELD OF THE INVENTION

The present invention relates to toners for use in electrophotography and an image forming method by use thereof.

BACKGROUND OF THE INVENTION

In electrophotography, as set forth in various disclosures, for example, U.S. Pat. No. 2,297,691 and JP-B No. 42-23910 (hereinafter, the term, JP-B refers to Japanese Patent Publication), electrostatic latent images are generally formed on a photoreceptor containing a photoconductive material through various means, the formed latent image is developed with a toner to form a powdery image and the powdery image is optionally transferred onto paper or the like, then, the powdery image is fixed by applying heat, pressure or solvent vapor.

Recently, color copying was put to practical use, in which electrostatic latent images of an original are formed through spectral light exposure and are developed with an individual color toner to obtain a colored copy image. Alternatively, respective color copy images are superimposed to obtain a full color copy image. As color toners used therein, there are manufactured color toners of yellow, magenta, cyan and the like, formed of an individual color pigment and/or dye dispersed in a binder resin.

In the foregoing electrophotography, image formation is generally performed according to the following steps. First, light information corresponding to image information is exposed onto a photoreceptor comprised of a photoconductive material through various methods to form an electrostatic latent image on the photoreceptor. Then, the electrostatic latent image formed on the photoreceptor is developed with a charged toner to form a toner image. The toner image is transferred onto an image recording medium (which is usually paper or an intermediate transfer material). The transferred image is fixed on plain paper using a thermal fixing apparatus. In the image forming method using electrophotography as described above, an electrostatic latent image formed on the photoreceptor corresponds to image information separated to an individual colors of yellow, magenta, cyan and black and are developed with a toner having the same color as the respective image data. The development is repeated for each color to form a full color image, namely up to four repetitions.

Commonly known organic pigments and dyes have been used as coloring material used for electrophotographic toners but they exhibit various defects. For instance, organic pigments, compared to dyes, are generally superior in heat resistance and light resistance, and exist in a toner in the form of a particle dispersion, resulting in enhanced covering power, leading to lowered transparency. Dispersibility of a pigment is generally poor so that transparency is vitiated and hue is lowered, resulting in deteriorated color reproduction of images.

To make it possible to visually recognize color of the lowest layer of overlaid toner layers without being concealed by upper toner layers, transparency of a fixed toner is required, and dispersibility or coloring power of a coloring agent is needed to maintain color reproducibility of the original.

To overcome defects of pigments as described above, there were proposed, for example, a means for enhancing transparency whereby primary particles exhibited a pigment dispersion diameter of the sub-micrometer order without forming aggregated secondary particles, by using a flashing method as a means for dispersing a pigment, as disclosed in JP-A No. 5-11504 (hereinafter, the term, JP-A refers to Japanese Patent Application Publication) and also a means for improving the electrostatic-charging property, fixability and image uniformity by covering pigment particles with a binding resin and a shelling resin, as disclosed in JP-A No. 11-160910. However, even when outputted by using the proposed toners, it is difficult to obtain sufficient transparency in the case of a toner using pigments.

In a color image forming apparatus, all of color reproduction is theoretically feasible through subtractive mixture of the three primary colors of yellow, magenta and cyan. However, the color-reproducible region or hue is lowered by spectral characteristics of a pigment dispersed in a thermoplastic resin or by color mixing property when overlaying different color toners, so that there still remain many problems to achieve faithful color reproduction of an original.

There were also disclosed toners using dyes, as described in JP-A No. 5-11504 and toners using a mixture of dyes and pigments. In a toner using a dye, the dye exists in a state of being dissolved in a binding resin for the toner, resulting in superior transparency and hue but exhibiting defects such as inferior light resistance and heat resistance of the pigments. With respect to heat resistance, in addition to lowering in density due to degradation of a dye, problems were produced such that the dye sublimed and easily stained the machine and additionally the dye was dissolved in silicone oil used for fixing and finally melted onto the heated roller, causing the off-setting phenomenon while fixing toner images by a heated roller. To overcome such defects of dyes, there were proposed, for example, a technique of using specific anthraquinone type dyes or chelate dyes for a magenta toner to allow light resistance or sublimation property to be compatible with color reproduction, as described in JP-B No. 3567403 and an encapsulated toner in which a core including a polymer resin and a color dye was covered with a polymer, as described in JP-A No. 5-72792.

However, even when outputted using these proposed toners, it was difficult for such dye-using toners to achieve sufficient heat resistance (sublimation property) and light resistance. Further, some of the metals, for example, nickel or cobalt, used in chelate dyes included problems with respect to safety. Accordingly, there was desired development of a toner meeting these conditions.

SUMMARY OF THE INVENTION

It is an object of the invention to overcome the foregoing problems.

Thus, it is an object of the invention to provide an electrophotographic toner achieving superior coloring without exhibiting any difficulty in dispersibility in thermoplastic resin, while exhibiting superior transparency and color reproducibility and enhanced heat resistance, electrostatic-charging property and off-set resistance and an image forming method by use of the electrophotographic toner.

It is also an object of the invention to use no toxic metal.

One aspect of the invention is directed to an electrophotographic toner comprising a thermoplastic resin containing at least one metal chelate dye represented by the following formula (1):

$$M(L_1)(L_2)_n(X_1)_m(X_2)_l.W_1 \quad \text{formula (1)}$$

wherein M is a divalent metal ion selected from the group of Cu and Zn; $X_1$ and $X_2$ are each a monodentate or didentate ligand, provided that $X_1$ and $X_2$ may link with each other; $L_1$ and $L_2$ are each a didentate or tridentate ligand exhibiting an absorption in the region of visible to infrared, which may be the same or different from each other; n, m and 1 are each 0 or 1; $W_1$ is a counter ion when a counter ion is required for neutralization of charge.

In one preferred embodiment of the invention, the electrophotographic toner comprises a thermoplastic resin and colored microparticles containing a dye and dispersed in the thermoplastic resin.

Another aspect of the invention is directed to an image forming method comprising: imagewise exposing a uniformly charged photoreceptor to form an electrostatic latent image, developing the electrostatic latent image with a toner to form a toner image and transferring the toner image to a transfer material, wherein the toner is a toner as described above.

DETAILED DESCRIPTION OF THE INVENTION

Figure 1:
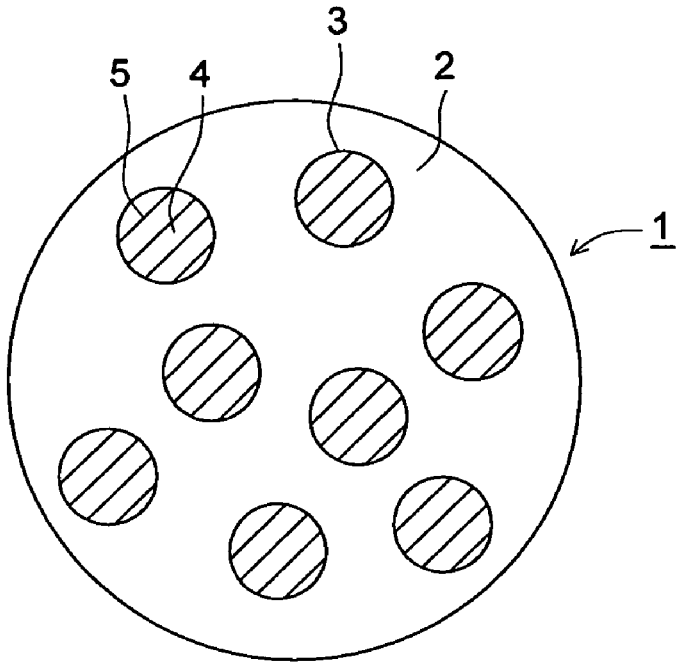
FIG. 1 illustrates the section of a toner particle containing colored microparticles dispersed in thermoplastic resin.

The electrophotographic toner of the invention contains a dye having a specific structure (hereinafter also denoted as a chelate dye) which is dispersed in a thermoplastic resin (hereinafter, also denoted as a binding resin). The dye is in the form of a dispersion of solid particles dispersed in the thermoplastic resin or is contained in colored microparticles comprising a resin differing in composition from the thermoplastic resin and dispersed in the thermoplastic resin.

As a result of extensive study to solve the foregoing problems, metal chelate dyes represented by the foregoing formula (1) were discovered. It was further discovered that a color toner comprising a thermoplastic resin, in which colored microparticles containing the dye and a resin differing in composition from the thermoplastic resin is dispersed, resulted in further superior hue and enhanced image fastness.

In the formula (1), M is a divalent metal ion selected from Cu and Zn; $X_1$ and $X_2$ are each a monodentate or didentate ligand, provided that $X_1$ and $X_2$ may link with each other; $L_1$ and $L_2$ are each a didentate or tridentate ligand having a visible to infrared absorption, which may be the same or different from each other; n, m and 1 are each 0 or 1; $W_1$ is a counter ion when a counter ion is required for neutralization of charge.

The monodentate and didentate represented by $X_1$ and $X_2$ include those described in JP-A No. 2000-251957, 2000-311723, 2000-323191, 2001-6760, 2001-59062 and 2001-60467. Specific examples of a chelate ligand include a halide ion, a hydroxyl ion, ammonia, pyridine, an amine (e.g., methylamine, diethylamine, tributylamine), a cyanide ion, a cyanate ion, a thiolato ion, a thiocyanate ion, bipyridines, aminopolycarboxylic acids, and 8-hydroxyquiniline. Chelate ligands are exemplified in K. Ueno "Chelate Chemistry".

A monodentate ligands preferably is a which coordinates via an acyl group, a carbonyl group, a thiocyanate group, an isothiocyanate group, a cyanate group, an isothiocyanate group, a halogen atom, a cyano group, an alkylthio group, an arylthio group, an alkoxy group or an aryloxy group, or a ligand comprised of a dialkyl ketone or a carbonamide.

A didentate ligand preferably is a ligand which coordinate via an acyloxu group, an oxalylene group, an acylthio group, a thioacyloxy group, a thioacylthio group, an acylaminooxy group, a thiocarbamate group, dithiocarbamate group, a thiocarbonate group, a dithiocarbonate group, a trithiocarbonate group, an alkylthio group or an arylthio group, or a ligand comprised of a dialkyl ketone or a carbonamide.

Specific examples are shown below but are not specifically limited to these. The structural formula shown below is simply one canonical structure of possible resonance structures. The distinction between a covalent bond (designated "-") and coordination bond (designated "• • •") is simply formal, not representing an absolute distinction.

X-1

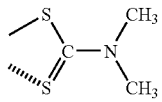

X-2

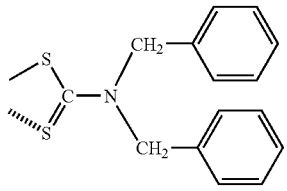

X-3

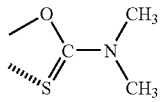

X-4

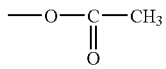

X-5

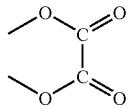

X-6

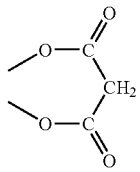

X-7

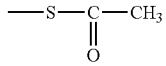

X-8

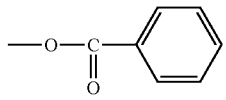

-continued
X-9
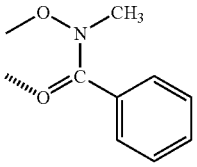
X-10
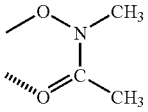
X-11
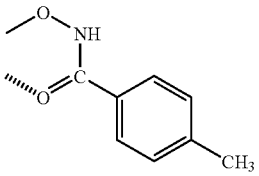
X-12
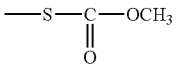
X-13
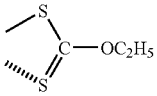
X-14
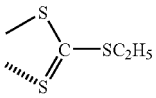
X-15
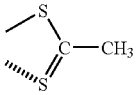
X-16
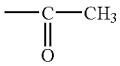
X-17
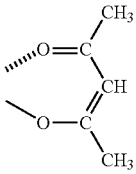
X-18
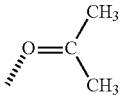
X-19
—CO
X-20
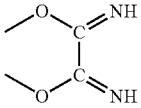
X-21
—NCO
X-22
—OCN
X-23
—NCS
X-24
—SCN
X-25
—CN
-continued
X-26
—Cl
X-27
—Br
X-28
—I
X-29
—$OCH_3$
X-30
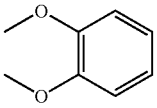
X-31
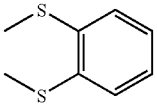
X-32
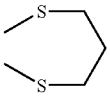
X-33
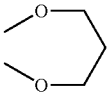
X-34
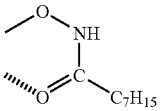
X-35
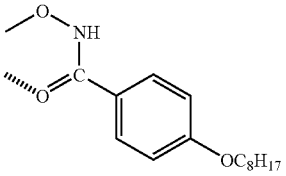
X-36
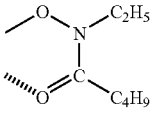
X-37
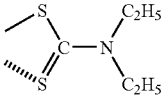
X-38
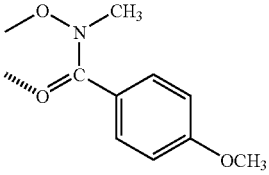
X-39
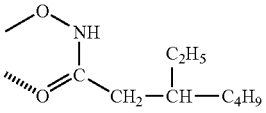

-continued
X-40
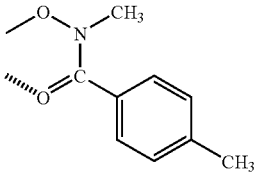
X-41
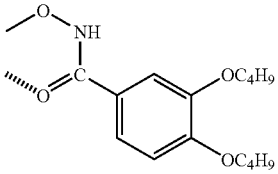
X-42
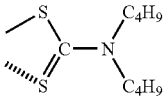
X-43
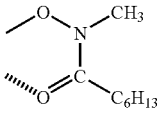
X-44
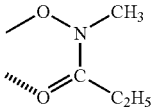
X-45
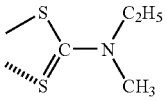
X-46
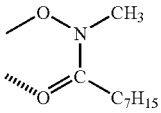
X-47
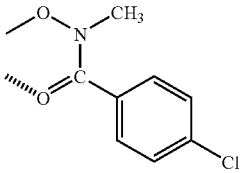
X-48
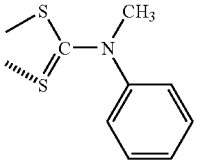
X-49
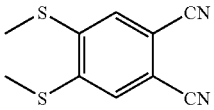
X-50
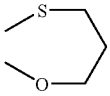
-continued
X-51
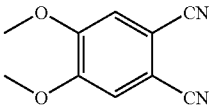
X-52
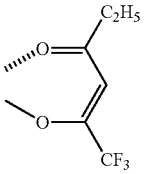
X-53
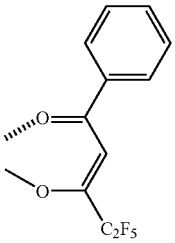
X-54
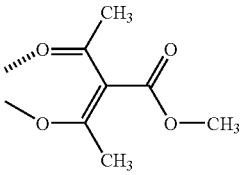
X-55
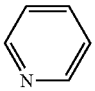
X-56
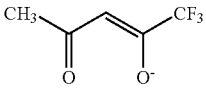
X-57
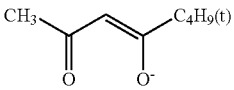
X-58
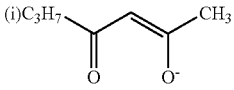
X-59
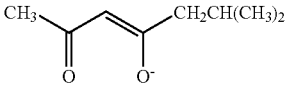
X-60
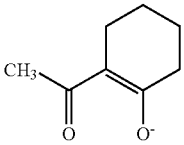
X-61
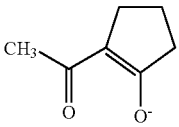

-continued
X-62
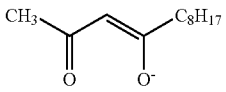
X-63
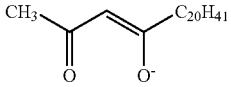
X-64
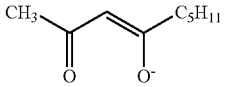
X-65
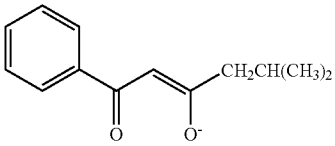
X-66
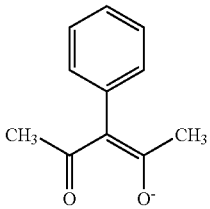
X-67
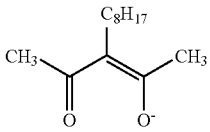
X-68
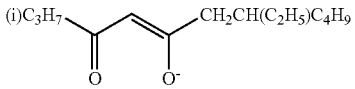
X-69
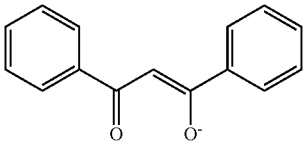
X-70
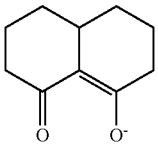
X-71
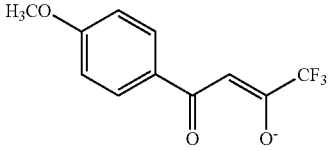
X-72
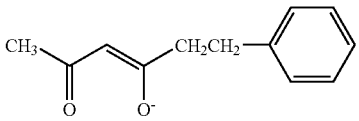
-continued
X-73
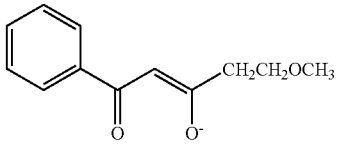
X-74
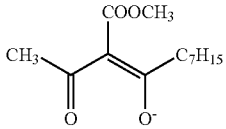
X-75
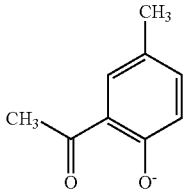
X-76
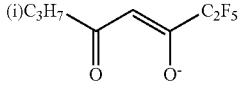
X-77
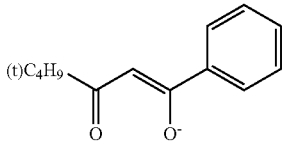
X-78
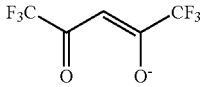
X-79
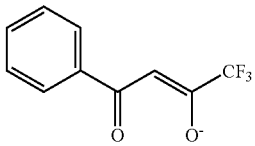
X-80
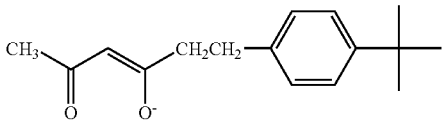
X-81
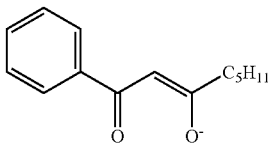
X-82
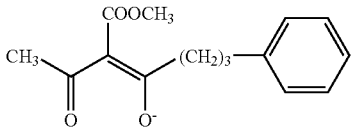
X-83
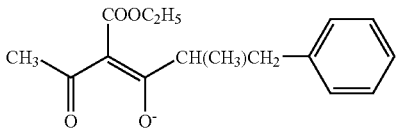

-continued
X-84
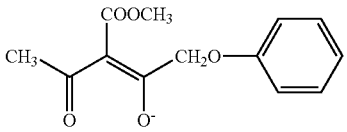
X-85
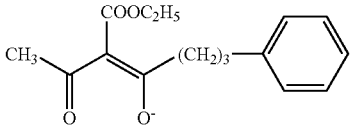
X-86
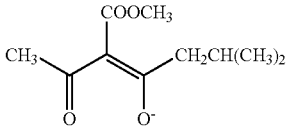
X-87
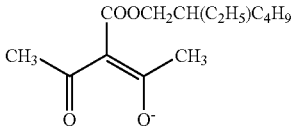
X-88
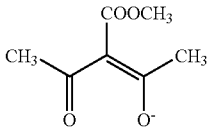
X-89
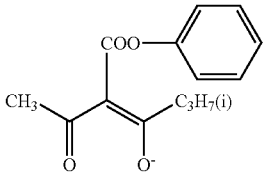
X-90
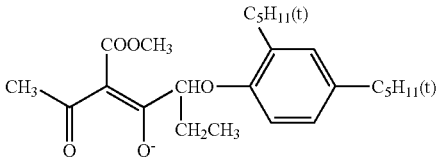
X-91
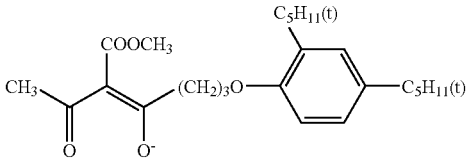
X-92
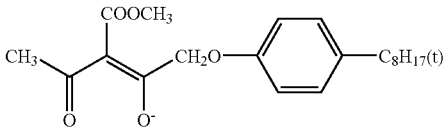
X-93
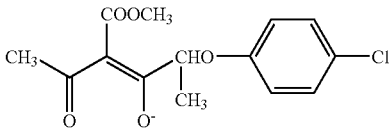
-continued
X-94
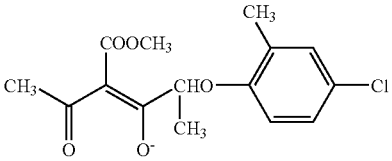
X-95
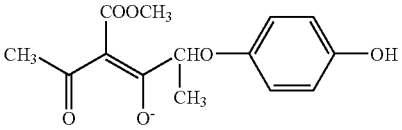
X-96
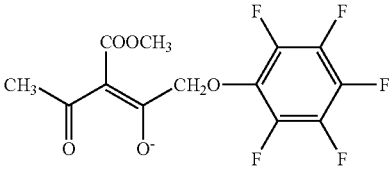
X-97
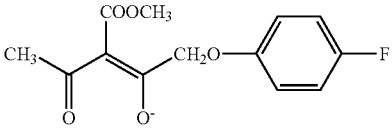
X-98
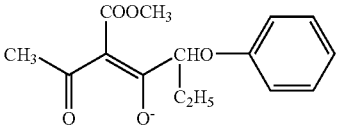
X-99
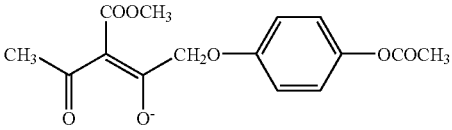
X-100
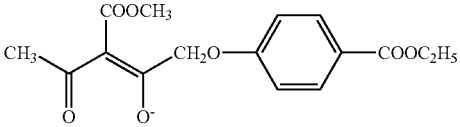
X-101
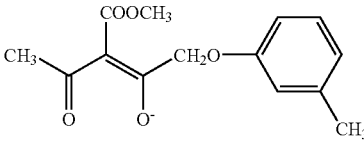
X-102
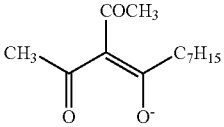
X-103
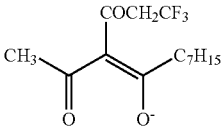

-continued

X-104

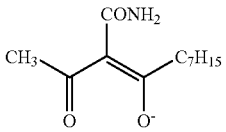

X-105

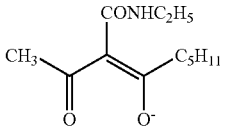

X-106

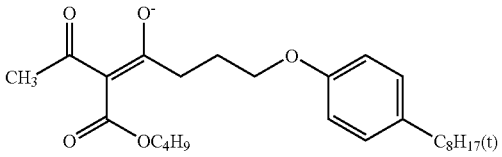

X-107

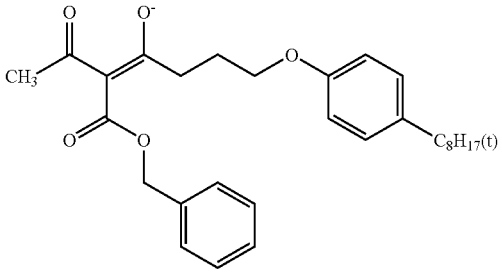

X-108

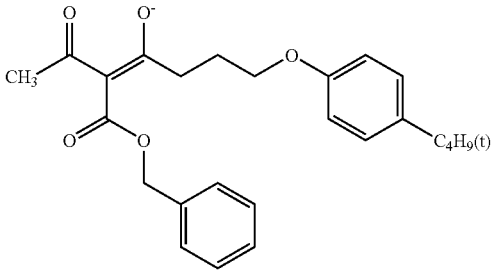

X-109

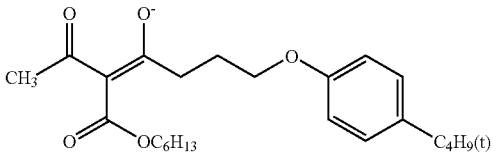

X-110

$ClO_4^-$

X-111

$BF_4^-$

X-112

$PF_4^-$

X-113

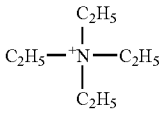

-continued

X-114

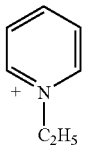

The structure represented by the following formula (9) is also preferred as a ligand:

formula (9)

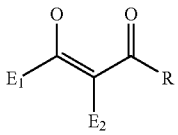

wherein $E_1$ and $E_2$ are each an electron-withdrawing group exhibiting a Hammett substituent constant (σp) of 0.1 to 0.9; and R is an alkyl group, an aryl group, a heterocyclic group, an alkoxy group or an amino group, which may be substituted with substituents.

There will be described the group of $E_1$ and $E_2$, having a σp value of 0.1 to 0.9. As a Hammett substituent constant (σp) value are preferably used values described in, for example, Hansch, C. Leo et al., J. Med. Chem. 16, 1207 (1973); ibid. 20, 304 (1977).

Examples of a substituent or atom having a σp value of 0.10 or more include a chlorine atom, bromine atom, iodine atom, carboxyl group, cyano group, nitro group, halogen-substituted alkyl group, (e.g., trichloromethyl, trifluoromethyl, chloromethyl, trifluoromethylthiomethyl, trifluoromethanesulfonylmethyl, perfluorobutyl), an aliphatic, aromatic or heterocyclic acyl group (e.g., formyl, acetyl, benzoyl), an aliphatic, aromatic or heterocyclic sulfonyl group (e.g., trifluoromethanesulfonyl, methanesulfonyl, benzenesulfonyl), carbamoyl group (e.g., carbamoyl, methylcarbamoyl, phenylcarbamoyl, 2-chlorophenylcarbamoyl), alkoxycarbonyl group (e.g., methoxycarbonyl, ethoxycarbonyl, diphenylmethylcarbonyl), substituted aromatic group (e.g., pentachlorophenyl, pentafluorophenyl, 2,4-dimethanesulfonylphenyl, 2-trifluoromethylphenyl), heterocyclic residue (e.g., 2-benzoxazolyl, 2-benzothiazolyl, 1-phenyl-2-benzimidazolyl, 1-tetrazolyl), azo group (e.g., phenylazo), ditrifluoromethylamino group, trifluoromethoxy group, alkylsulfonyloxy group (e.g., methanesulfonyloxy), acyloxyl group (e.g., acetyloxy, benzoyloxy), arylsulfonyloxy group (e.g., benzenesulfonyloxy), phospholyl group (e.g., dimethoxyphospholyl, diphenylphospholyl), and sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl, N-ethyl-N-dodecylsulfamoyl, N,N-diethylsulfamoyl).

Examples of a substituent having a σp value of 0.35 or more, include cyano group, nitro group, carboxyl group, fluorinated alkyl group (e.g., trifluoromethyl, perfluoromethyl), an aliphatic, aromatic or heterocyclic acyl group (e.g., acetyl, benzoyl, formyl), an aliphatic, aromatic or heterocyclic sulfonyl group (e.g., trifluoromethanesulfonyl, methanesulfonyl, benzenesulfonyl), carbamoyl group (e.g., carbamoyl, methylcarbamoyl, phenylcarbamoyl, 2-chlorophenylcarbamoyl), alkoxycarbonyl group (e.g., methoxycarbonyl, ethoxycarbonyl, diphenylmethylcarbonyl), fluorine- or sulfonyl-substituted aromatic group (e.g., pentafluorophenyl, 2,4-dimethanesulfonylphenyl), heterocyclic residue (e.g., 1-tetrazolyl), azo group (e.g., phenylazo), alkylsulfonyloxy group (e.g., methanesulfonyloxy), phospholyl (e.g., dimethoxyphospholyl, diphenylphospholyl) and sulfamoyl group.

Examples of a substituent having a σp value of 0.60 or more, include cyano group, nitro group, and an aliphatic, aromatic or heterocyclic sulfonyl group (e.g., trifluoromethane-sulfonyl, methanesulfonyl, benzenesulfonyl).

Preferred examples of $E_1$ and $E_2$ include a halogenated alkyl group (specifically, fluorinated alkyl), carbonyl group, cyano group, alkoxycarbonyl group, alkylsulfonyl group, and alkylsulfonyloxy group. A substituent of R is preferably an alkyl group, alkoxy group, and amino group, and more preferably an alkyl group or alkoxy group.

Specific examples of a ligand represented by formula (9) are shown below but are by no means limited to these.

X-115

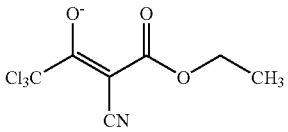

X-116

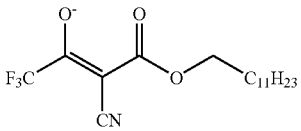

X-117

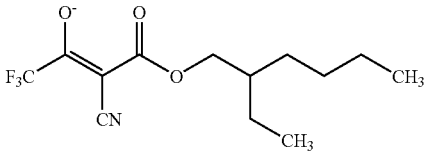

X-118

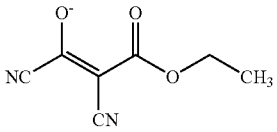

X-119

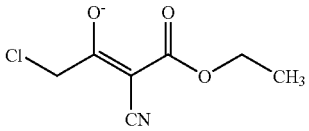

X-120

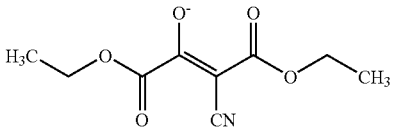

X-121

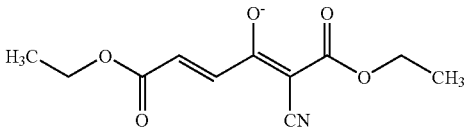

-continued

X-122

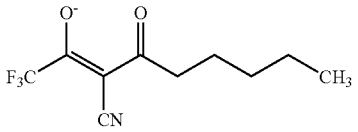

X-123

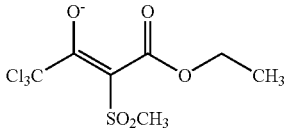

X-124

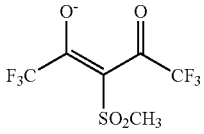

X-125

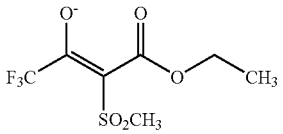

X-126

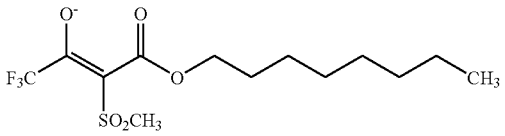

$L_1$ and $L_2$ include any compound capable of forming a di- or tri-dentate coordinate bond, such as polymethine dyes, e.g., azomethine dyes, azo dyes, indoaniline dyes and merocyanine dyes, but azomethine dyes or (poly)methine dyes are preferred and the structure represented by formula (2) to (8) to be described later is more preferred. As described in $X_1$ and $X_2$, it is preferred to have a site capable of chelating; n, m and 1 are each 0 or 1.

$W_1$ represents a counter ion when a counter ion is required for neutralization of charge. For instance, ionicity of a dye or its net ionic charge, i.e., whether a dye is cationic or anionic or has a net ionic charge or not, depends on its metal, ligand or substituent. A substituent having a dissociative group may dissociate to have a negative charge, in which overall charge of the molecule is neutralized with $W_1$. Typical cations include an inorganic or organic ammonium ion (e.g., tetraalkylammonium ion, pyridinium ion), an alkali metal ion and proton. Anions may be any ones of inorganic and organic anions, and specific examples thereof include a halide anion (e.g., fluoride ion, chloride ion, bromide ion, iodide ion), a substituted arylsulfonic acid ion (e.g., p-toluenesulfonic acid ion, p-chlorobenzenesulfonic acid ion), an aryldisulfonic acid ion (e.g., 1,3-benzenedisulfonic acid ion, 1,5-naphthalenedisulfonic acid ion, 2,6-naphthalenedisulfonic acid ion), an alkylsulfate ion (e.g., methylsulfate ion), sulfate ion, thiocyanate ion, perchlorate ion, tetrafluoroborate ion, hexafluorophosphate ion, picrate ion, acetate ion and trifluoromethanesulfonic acid ion.

In the foregoing formula (1), at least one of $L_1$ and $L_2$ is preferably represented by the following formula (2):

formula (2)

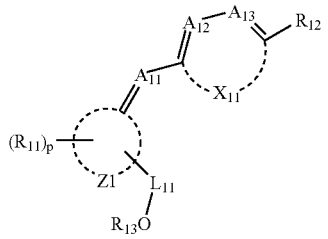

wherein $R_{11}$ is a hydrogen atom or a substituent; $R_{13}$ is a substituent; $R_{12}$ is —$NR_{14}R_{15}$ or —$OR_{16}$; $A_{11}$, $A_{12}$ and $A_{13}$ are each independently —$CR_{17}$= or —N=; $X_{11}$ is an atomic group necessary to form a 5- or 6-membered aromatic or heterocyclic ring; Z1 is an atomic group necessary to form a 5- or 6-membered nitrogen-containing heterocyclic ring, which may be substituted by one or more substituents and the substituents may combine with each other to form a condensed ring; $R_{14}$ to $R_{17}$ are each a hydrogen atom or a substituent; $L_{11}$ is a linkage group having one or two carbon atoms or a part of a ring structure, provided that $L_{11}$ may combine with $R_{13}$ to form a 5- or 6-membered ring; p is an integer of 0 to 3.

The substituent represented by $R_{11}$ and $R_{13}$ is not specifically limited. Examples of such a substituent include an alkyl group (e.g., methyl, ethyl, propyl, isopropyl, tert-butyl, pentyl, hexyl, octyl, dodecyl, tridecyl, tetradecyl, pentadecyl), a cycloalkyl group (e.g., cyclopentyl, cyclohexyl), an alkenyl group (e.g., vinyl, allyl), an alkynyl group (e.g., ethynyl, propargyl), an aryl group (e.g., phenyl. naphthyl), a heteroallyl group (e.g., furyl, thienyl, pyridyl, pyridazyl, pyrimidyl, pyrazyl, triazyl, imidazolyl, pyrazolyl, thiazolyl, benzoimidazolyl, benzooxazolyl, quinazolyl, phthalazyl), a heterocyclic group (e.g., pyrrolidyl, imidazolidyl, morpholyl group, oxazolidyl), an alkoxy group (e.g., methoxy, ethoxy, propyloxy, pentyloxy, hexyloxy, octyloxy, dodecyloxy), a cycloalkoxy group (e.g., cyclopentyloxy, cyclohexyloxy), an aryloxy group (e.g., phenoxy, naphthyloxy), an alkylthio group (e.g., methylthio, ethylthio, propylthio, pentylthio, hexylthio, octylthio, dodecylthio), a cycloalkylthio group (e.g., cyclopentylthio, cyclohexylthio), an arylthio group (e.g., phenylthio, naphthylthio), an alkoxycarbonyl group (e.g., methyloxycarbonyl, ethyloxycarbonyl, butyloxycarbonyl, octyloxycarbonyl, dodecyloxycarbonyl), an aryloxycarbonyl group (e.g., phenyloxycarbonyl, naphthyloxycarbonyl), a sulfamoyl group (e.g., aminosulfonyl, methylaminosulfonyl, dimethylaminosulfonyl, butylaminosulfonyl, hexylaminosulfonyl, cyclohexylaminosulfonyl, octylaminosulfonyl, dodecylaminosulfonyl, phenylaminosulfonyl, naphthylaminosulfonyl, 2-pyridylaminosulfonyl), an acyl group (e.g., acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl), an acyloxy group (e.g., acetyloxy, ethylcarbonyloxy, butylcarbonyloxy, octylcarbonyloxy, dodecylcarbonyloxy, phenylcarbonyloxy), an amido group (e.g., methylcarbonylamino, ethylcarbonylamino, dimethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino), a carbamoyl group (e.g., aminocarbony, methylaminocarbonyl, dimethylaminocarbonyl, propylaminocarbonyl, pentylaminocarbonyl, cyclohexylaminocarbonyl, octylaminocarbonyl, 2-ethylhexylaminocarbonyl, dodecylaminocarbonyl, phenylaminocarbonyl, naphthylaminocarbonyl, 2-pyridylaminocarbonyl), a ureido group (e.g., methylureido, ethylureido, pentylureido, cyclohexylureido, octylureido, dodecylureido, phenylureido, naphthylureido, 2-pyridylureido), a sulfinyl group (e.g., methylsulfinyl, ethylsulfinyl, butylsulfinyl, cyclohexylsulfinyl, 2-ethylhexylsulfinyl, dodecysulfinyl, phenylsulfinyl, naphthylsulfinyl, 2-pyridylsulfinyl), an alkylsulfonyl group (e.g., methylsulfinyl, ethylsulfinyl, butylsulfinyl, cyclohexylsulfinyl, 2-ethylhexylsulfinyl, dodecylsulfinyl), an arylsulfonyl group (e.g., phenylsulfonyl, naphthylsulfonyl, 2-pyridylsulfonyl), an amino group (e.g., amino, ethylamino, dimethylamino, butylamino, cyclopentylamino, 2-ethylhexylamino, dodecylamino, anilino, naphthylamine, 2-pyridylamino), cyano group, nitro group and a halogen atom (e.g., fluorine atom, chlorine atom, bromine atom).

$R_{11}$ is preferably an alkyl group, an aryl group, a heterocyclic group, an alkoxy group, a sulfamoyl group, a ureido group, an amino group, an alkoxycarbonyl group or a carbamoyl group, and more preferably, an alkyl group, an aryl group, an alkoxycarbonyl group or carbamoyl group.

$R_{13}$ is preferably a hydrogen atom, an alkyl group, an aryl group or a heterocyclic group, and more preferably an alkyl group (specifically, a group).

In —$NR_{14}R_{15}$ or —$OR_{16}$ represented by $R_{12}$, —$NR_{14}R_{15}$ is preferred in terms of $\epsilon$ (molar extinction function) but —$OR_{16}$ is also preferred in terms of wavelength adjustment. $R_{14}$ to $R_{16}$ are each a hydrogen or a substituent, and the substituent is the same as cited in $R_{11}$ but preferably a hydrogen atom, an alkyl group, an aryl group, a heterocyclic group, an acyl group, or an alkylsulfonyl group, and more preferably a hydrogen, an alkyl group, an aryl group or an acyl group. 0062 $A_{11}$, $A_{12}$ and $A_{13}$ are each —$CR_{17}$= or —N=, and preferably —$CR_{17}$=. $R_{17}$ is a hydrogen atom or a substituent. The substituent is the same as defined in $R_{11}$, preferably a hydrogen atom, a halogen atom, an alkyl group, an acylamino group or an alkoxycarbonyl group, and more preferably a hydrogen atom or an alkyl group.

Examples of a 5- or 6-membered aromatic or heterocyclic ring of $X_{11}$ include a benzene ring, a naphthalene ring, a pyridine ring, a furan ring, a thiophene ring, an imidazole ring and a thiazole ring, and of these, a benzene ring, pyridine ring and a thiophene ring are preferred.

Examples of a 5- or 6-membered heterocyclic ring containing at least one nitrogen atom, represented by Z1, include a pyridine ring, a pyrimidine ring, a quinoline ring, a pyrazole ring, an imidazole ring, pyrrole ring, pyrazoline ring (e.g., pyrazolidine-3,5-dione). This heterocyclic ring may be substituted by substituents and these substituents may combine with each other to form a condensed ring and preferably, a structure of formula (3) to (8) is cited.

$L_{11}$ represents a linkage group having one or two carbon atoms or a part of a ring structure and examples thereof include a substituted or unsubstituted methylene or ethylene group, ethenylene group or a linkage group represented by the following formula (10):

formula (10)

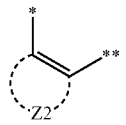

wherein Z2 is a 5- or 6-membered aromatic or heterocyclic group, which may be substituted, provided that Z1 links at the position designated as "*" and $OR_{13}$ links at the position designated as "**"

$L_{11}$ is preferably a methylene group. In formula (10), the ring formed by Z2 is preferably a benzene ring or a naphthalene ring, and a substituent on $L_{11}$ and $R_{13}$ preferably combine with each other to form a 5- or 6-membered ring. The said ring structure may be substituted by substituents. Preferred examples of such a substituents include a halogen atom, an alkoxy group, an amino group, an acylamino group, as sulfonylamino group and a ureido group (more preferably, a halogen atom, an alkoxy group, an amino group or an acylamino group).

It also preferably contains a group capable of chelating. The group capable of chelating refers to a substituent group containing an atom having an unshared electron pair (lone pair). Specific examples thereof include a heterocyclic group, hydroxy group, carbonyl group, oxycarbonyl group, carbamoyl group, alkoxy group, heterocycle-oxy group, carbonyloxy group, urethane group, sulfonyloxy group, amino group, imino group, sulfonylamino group, sulfamoylamino group, acylamino group, ureido group, sulfonyl group, sulfamoyl group, alkylthio group, arylthio group, and heterocycle-thio group. Of these groups, hydroxy group, carbonyl group, oxycarbonyl group, carbamoyl group, alkoxy group, carbonyloxy group, urethane group, sulfonyloxy group, amino group, imino group, sulfonylamino group, acylamino group, ureido group, alkylthio group, and arylthio group is preferred. Further, hydroxy group, carbonyl group, carbamoyl group, alkoxy group, sulfonylamino group, and acylamino group are preferred.

In the foregoing formula (2), the heterocyclic ring formed by Z1 is preferably represented by the following formula (3) or (4):

formula (3)

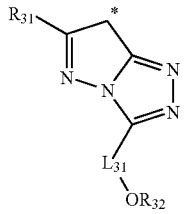

formula (4)

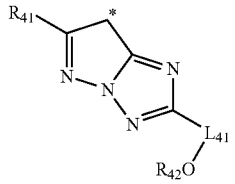

wherein $R_{31}$ and $R_{41}$ are each a hydrogen atom or a substituent; $R_{32}$ and $R_{42}$ are each a substituent; $L_{31}$ and $L_{41}$ are each a linkage group having one or two carbon atoms or a part of a ring structure and links to $A_{11}$ of formula (2) at the position designated "*".

In formulas (3) and (4), a substituent represented by $R_{31}$, $R_{32}$, $R_{41}$ and $R_{42}$ is the same as defined in $R_{11}$ of the foregoing formula (2). $R_{31}$ and $R_{41}$ are each preferably a hydrogen atom, an alkyl group, alkenyl group, aryl group, heterocyclic group, acylamino group, alkylsulfonylamino group, arylsulfonylamino group, amino group, alkylthio group, ureido group, alkoxycarbonylamino group, carbamoyl group, carboxyl group, or alkoxycarbonyl group; more preferably, an alkyl group, carboxyl group, or carbamoyl group, and still more preferably an alkyl group (specifically, methyl, tert-butyl, trifluoromethyl), carbamoyl group or alkoxycarbonyl group.

$R_{32}$ and $R_{42}$ are the same as defined in $R_{13}$ of formula (2) and preferred one is the same.

$L_{31}$ and $L_{41}$ are each a linkage group having one of two carbon atoms or a part of a ring structure, which are the same as defined in $L_{11}$ of formula (2), and preferred one is the same.

In the foregoing formula (2), the heterocyclic ring formed by Z1 is preferably represented by the following formula (5) or (6):

formula (5)

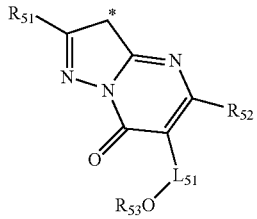

formula (6)

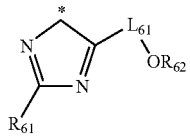

wherein $R_{51}$, $R_{52}$ and $R_{61}$ are each a hydrogen atom or a substituent; $R_{53}$ and $R_{62}$ are each a substituent: $L_{51}$ and $L_{61}$ are each a linkage group having one or two carbon atoms or a part of a ring structure and binds to $A_{11}$ of the formula (2) at the position designated "*".

In foregoing formulas (5) and (6), $R_{51}$, $R_{52}$, and $R_{61}$ are each a hydrogen atom or a substituent and the substituent is the same as defined in $R_{11}$ of formula (2). $R_{51}$ is preferably a hydrogen atom, an alkyl group, aryl group, heterocyclic group, carbamoyl group, alkoxycarbonyl group, aryloxycarbonyl group, cyano group, sulfamoyl group, alkylsulfonyl group or arylsulfonyl group; and more preferably aryl group, heterocyclic group, carbamoyl group, alkoxycarbonyl group or cyano group.

$R_{52}$ is preferably a hydrogen atom, a halogen atom, an alkyl group, acylamino group, alkoxycarbonyl group, amino group, alkylthio group, and arylthio group; and more preferably a hydrogen atom, a halogen atom, an alkyl group or acylamino group.

$R_{61}$ is preferably a hydrogen atom, an alkyl group, aryl, heterocyclic group, acylamino group, alkylsulfonylamino group, arylsulfonylamino group, amino group, alkylthio group, arylthio group, ureido group, alkoxycarbonylamino group, acyl group, acylcarbonyl group or carbamoyl group; and more preferably a hydrogen atom, an alkyl group, aryl group, heterocyclic group, acylamino group or alkoxy group.

$R_{53}$ and $R_{62}$ are each a substituent and are the same as defined in $R_{13}$ of the foregoing formula (2) and preferred one is the same as in formula (2).

$L_{51}$ and $L_{61}$ are each a linkage group having one of two carbon atoms or a part of a ring structure, which are the same as defined in $L_{11}$ of formula (2), and preferred one is the same.

In the foregoing formula (2), the heterocyclic ring formed by Z1 is preferably represented by the following formula (7) or (8):

formula (7)

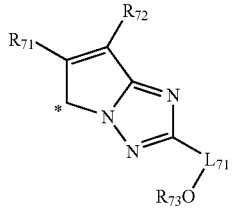

formula (8)

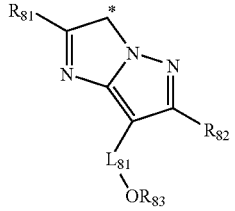

wherein $R_{71}$, $R_{72}$, $R_{81}$ and $R_{82}$ are each a hydrogen atom or a substituent; $R_{73}$ and $R_{83}$ are each a substituent: $L_{71}$ and $L_{81}$ are each a linkage group having one or two carbon atoms or a part of a ring structure and binds to $A_{11}$ of the formula (2) at the position designated "*".

In foregoing formulas (7) and (8), $R_{71}$, $R_{72}$, $R_{73}$, $R_{81}$, $R_{82}$ and $R_{83}$ are each the same as defined in $R_{11}$ of formula (2). $R_{71}$ and $R_{72}$ are each a hydrogen atom, an alkyl group, aryl group, carbamoyl group, alkoxycarbonyl group, aryloxycarbonyl group, carboxyl group, cyano group, sulfamoyl group, alkylsulfonyl group, arylsulfonyl group or nitro group; and more preferably an alkoxycarbonyl group or cyano group.

$R_{81}$ is preferably a hydrogen atom, an alkyl group, aryl, heterocyclic group, acylamino group, alkylsulfonylamino group, arylsulfonylamino group, amino group, alkylthio group, arylthio group, alkoxyl group, aryloxy group, ureido group, alkoxycarbonylamino group, acyl group, alkoxycarbonyl group or carbamoyl group; and more preferably a hydrogen atom, an alkyl group, aryl group, acyl group, acylamino group, alkoxycarbonyl group or carbamoyl group.

$R_{82}$ is the same as defined in $R_{31}$ of formula (3) and preferred one is the same as in formula (3). $R_{73}$ and $R_{83}$ are each the same as defined in $R_{13}$ of formula (2) and preferred one is the same as in formula (2).

$L_{71}$ and $L_{81}$ are each a linkage group having one of two carbon atoms or a part of a ring structure, which are the same as defined in $L_{11}$ of formula (2), and preferred one is the same.

Specific examples of dye ligand of formulas (2) through (8) and a metal chelate dye represented by formula (1) are shown below but by no means limited to these.

TABLE 1

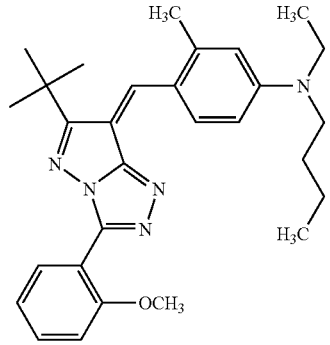

L-1

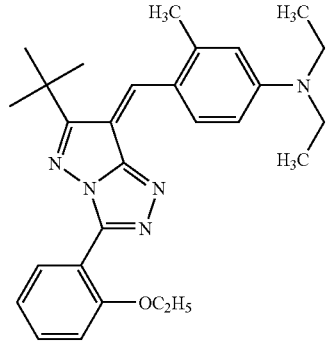

L-2

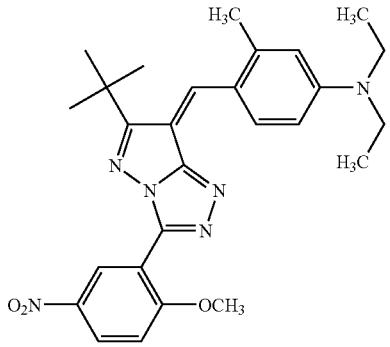

L-3

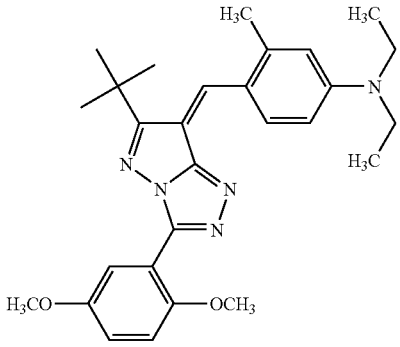

L-4

TABLE 1-continued
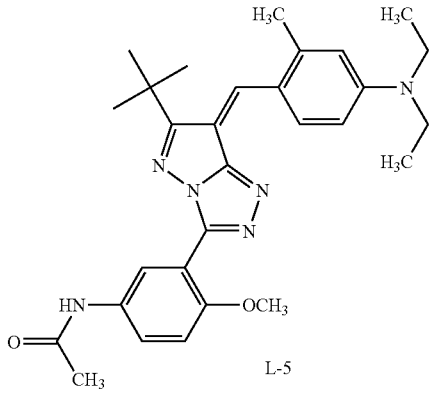
L-5
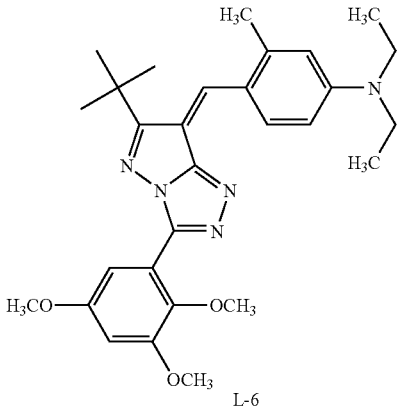
L-6
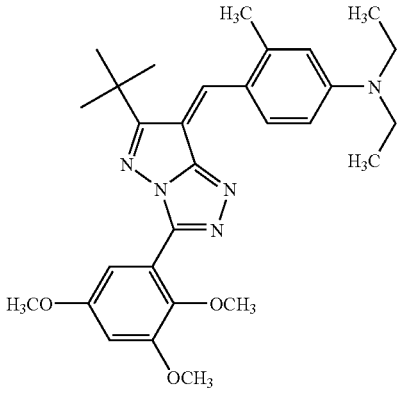
L-7
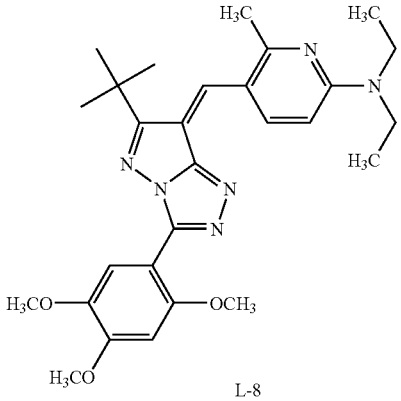
L-8
TABLE 1-continued
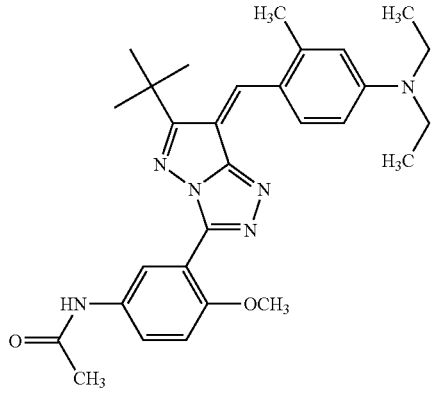
L-9
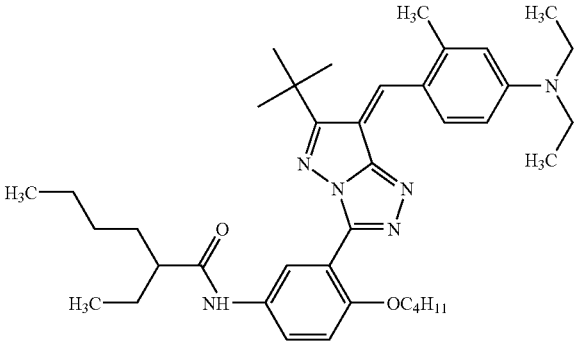
L-10
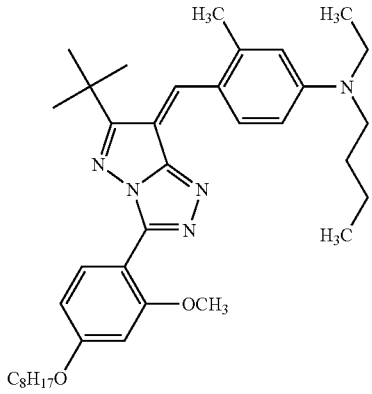
L-11
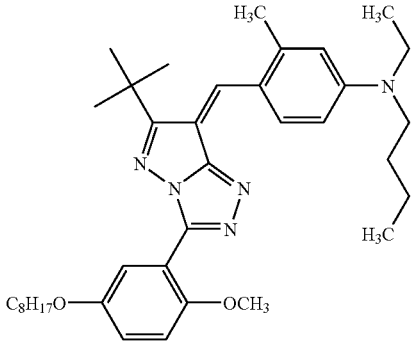
L-12

TABLE 1-continued
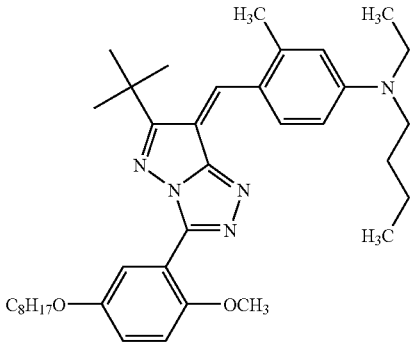
L-13
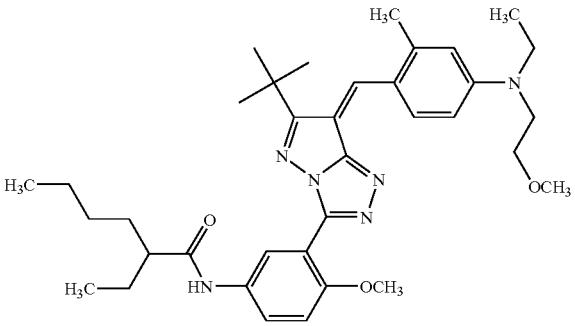
L-14
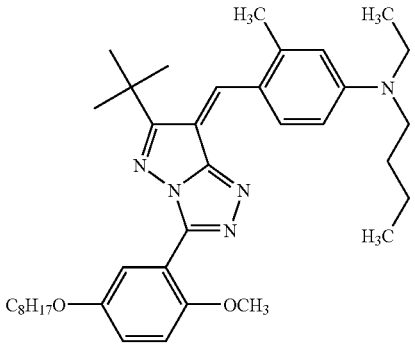
L-15
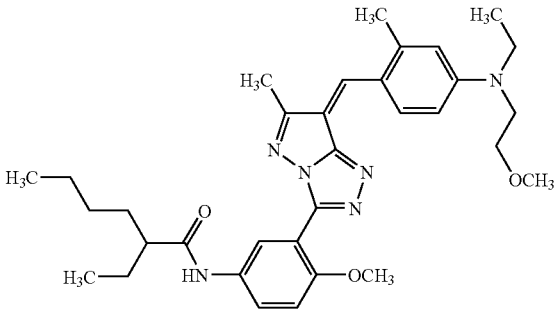
L-16
TABLE 1-continued
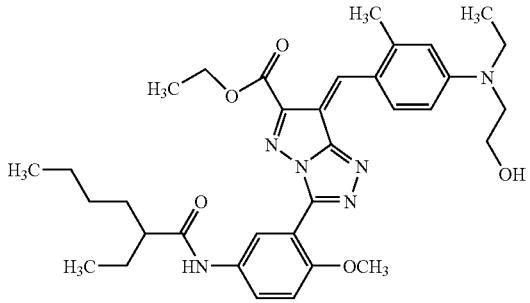
L-17
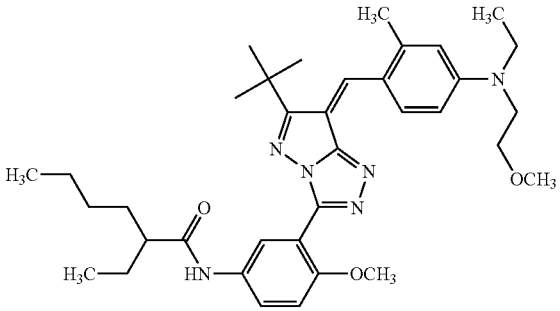
L-18
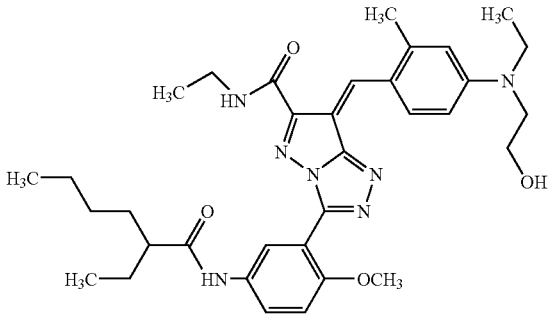
L-19
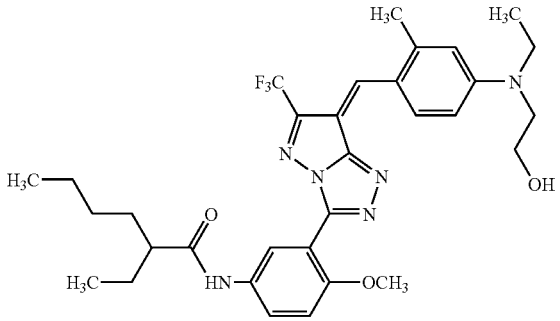
L-20

TABLE 1-continued
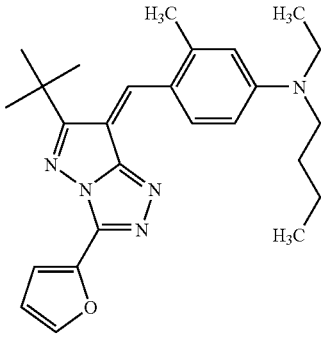
L-21
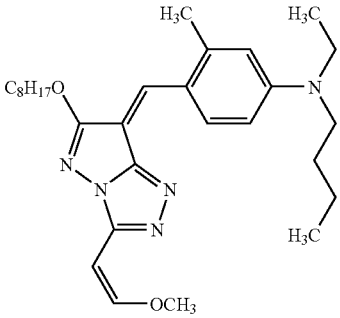
L-22
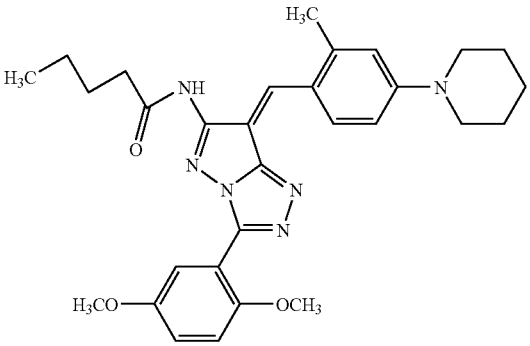
L-23
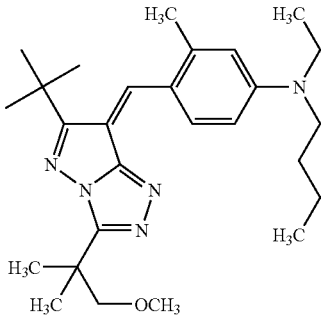
L-24
TABLE 1-continued
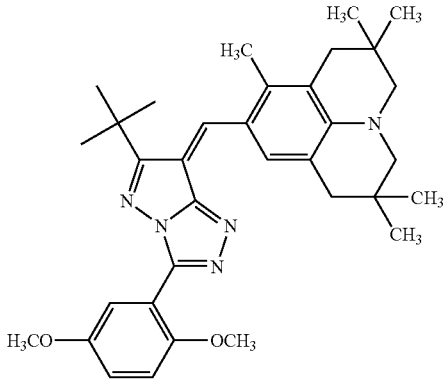
L-25
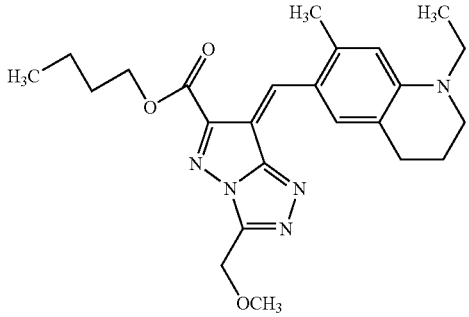
L-26
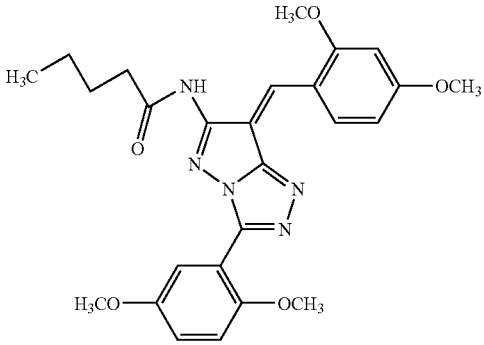
L-27
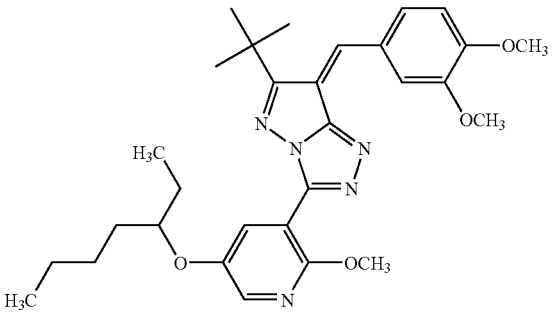
L-28

TABLE 1-continued
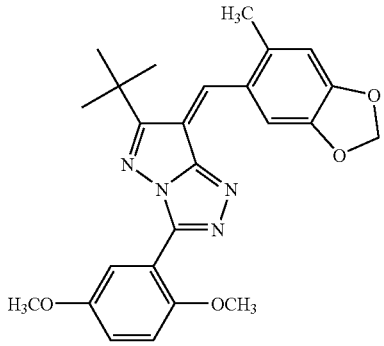
L-29
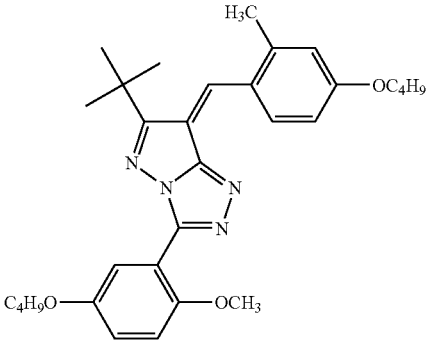
L-30
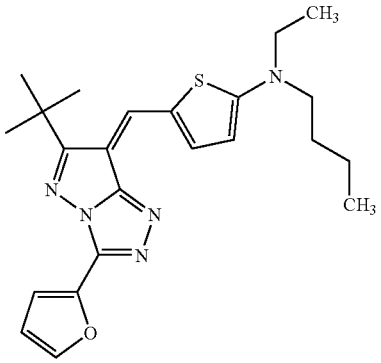
L-31
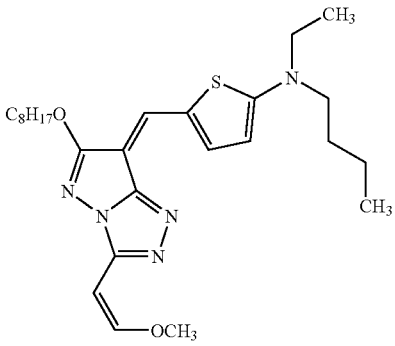
L-32
TABLE 1-continued
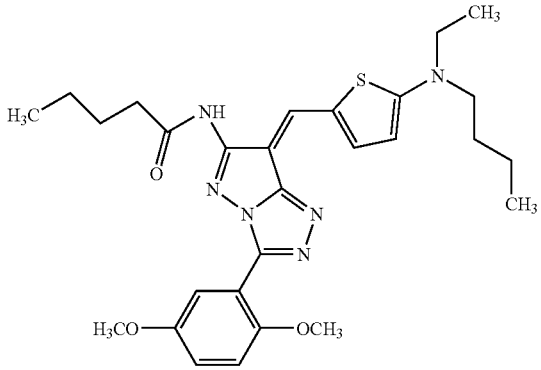
L-33
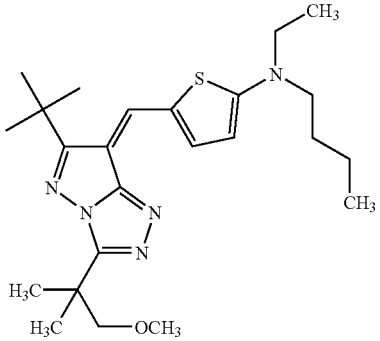
L-34
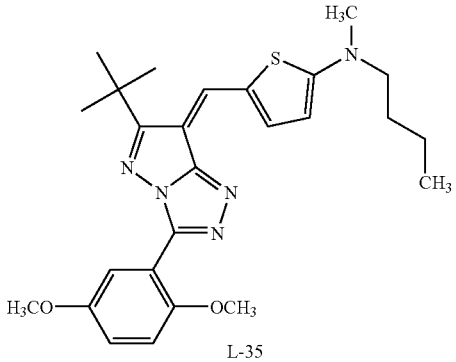
L-35
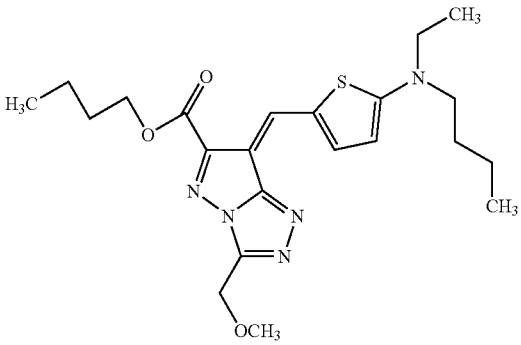
L-36

TABLE 1-continued
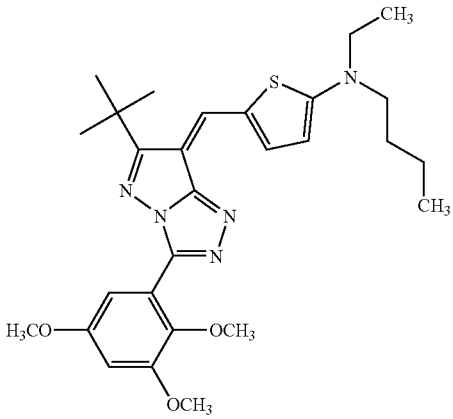
L-37
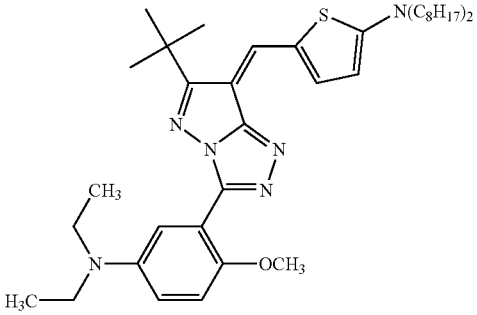
L-38
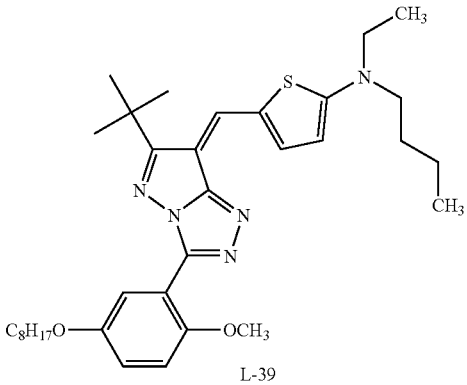
L-39
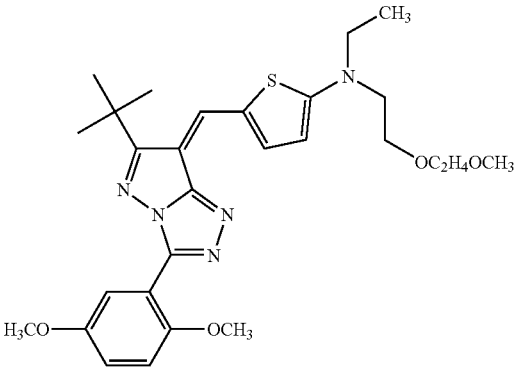
L-40
TABLE 1-continued
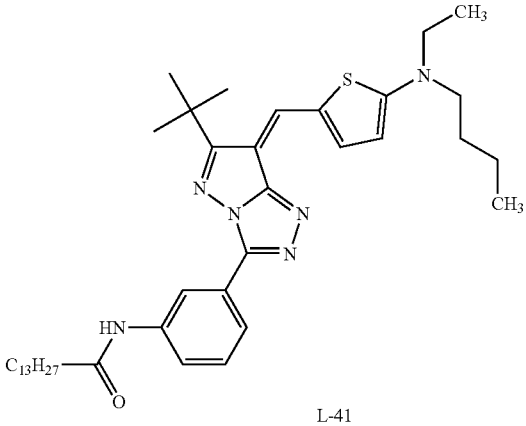
L-41
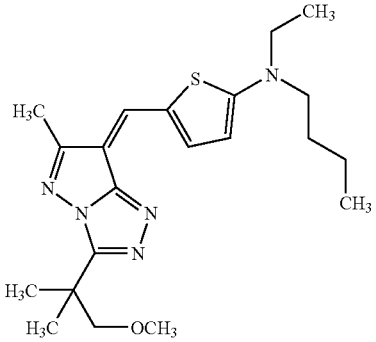
L-42
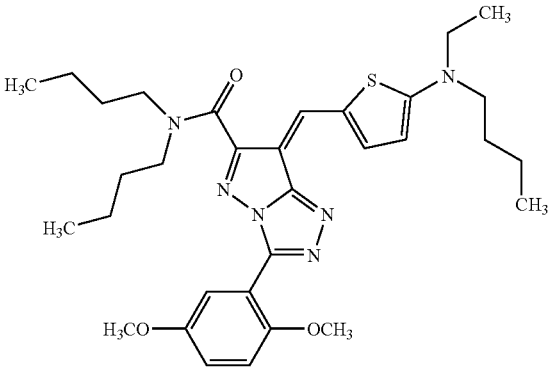
L-43
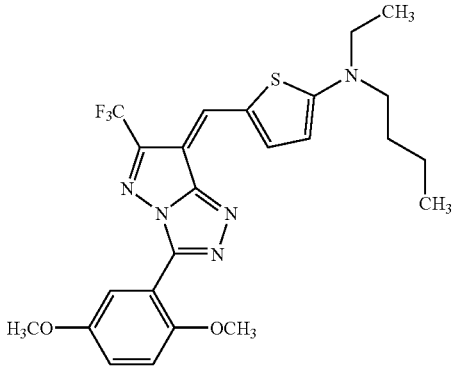
L-44

TABLE 1-continued
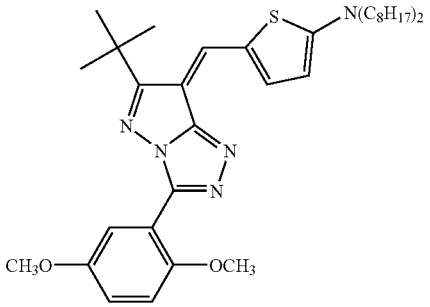
L-45
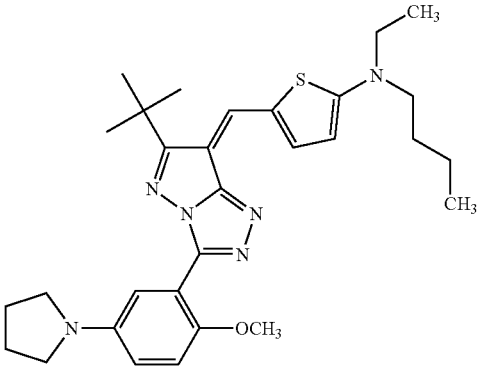
L-46
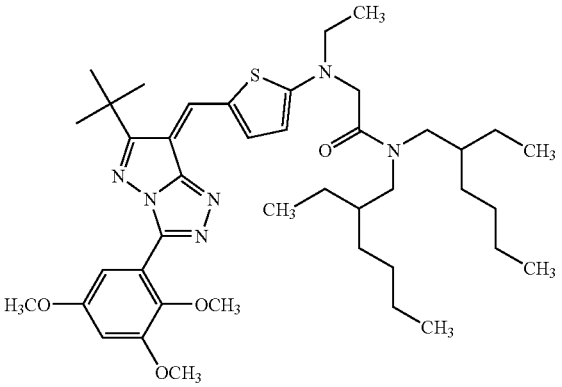
L-47
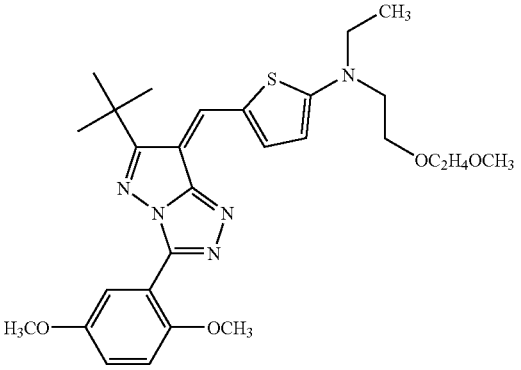
L-48
TABLE 1-continued
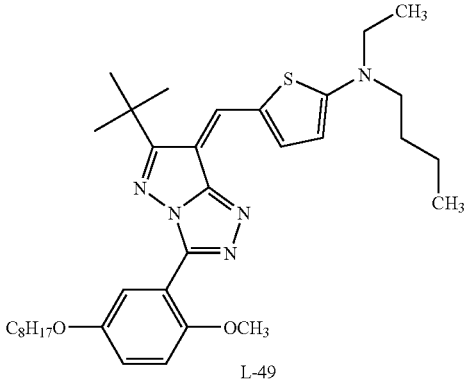
L-49
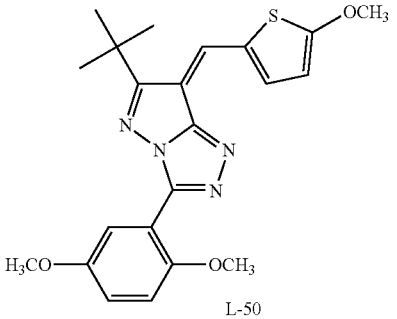
L-50
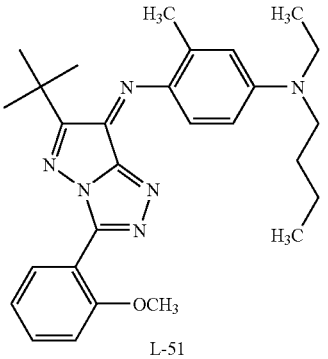
L-51
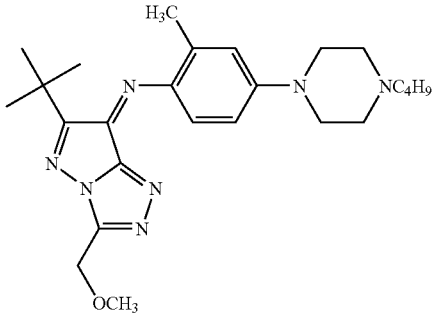
L-52

TABLE 1-continued
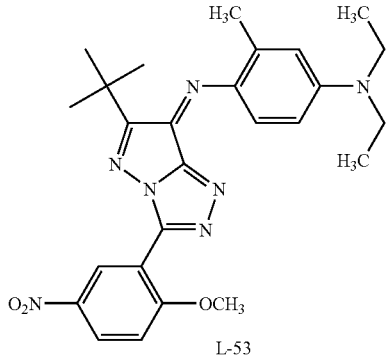
L-53
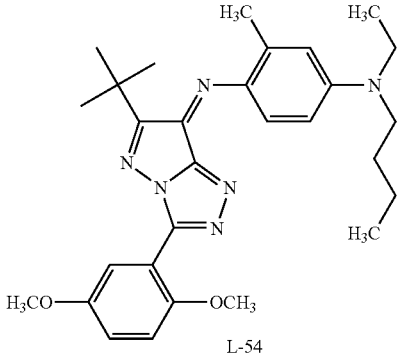
L-54
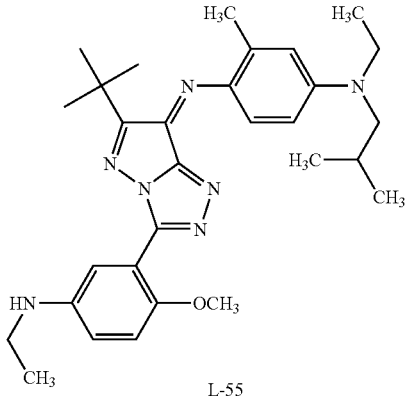
L-55
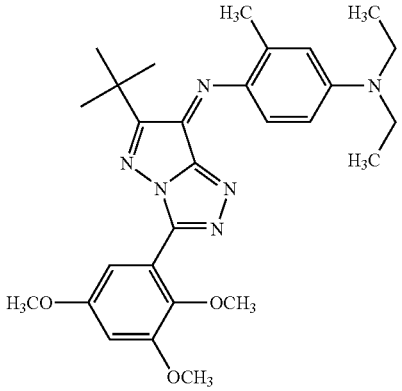
L-56
TABLE 1-continued
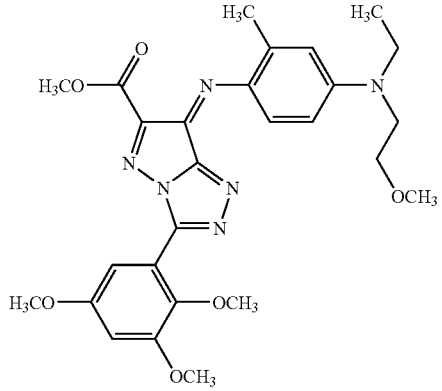
L-57
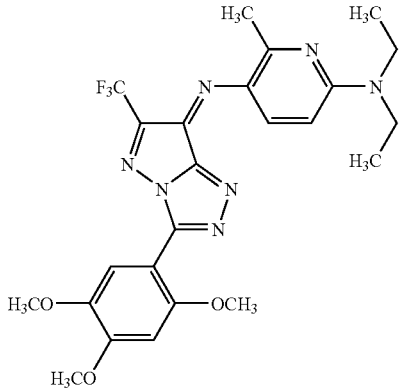
L-58
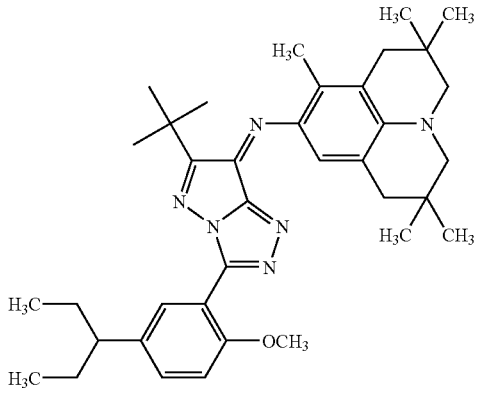
L-59
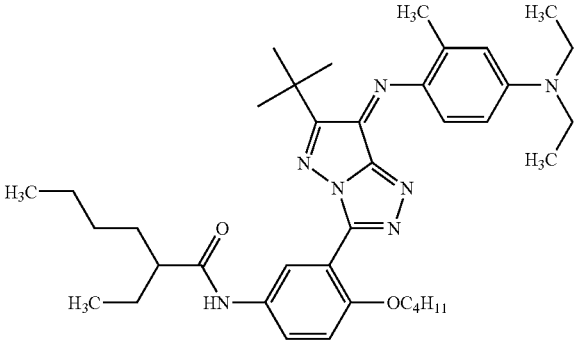
L-60

TABLE 1-continued
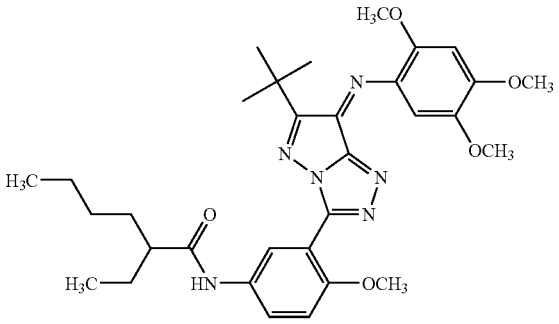
L-61
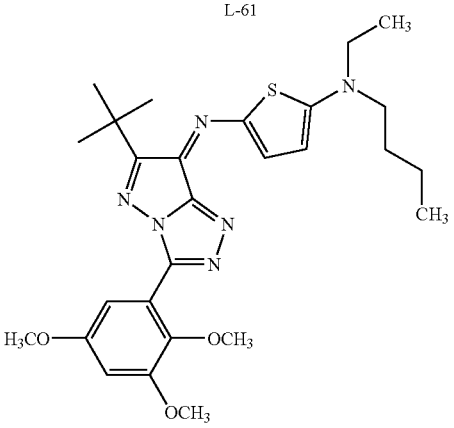
L-62
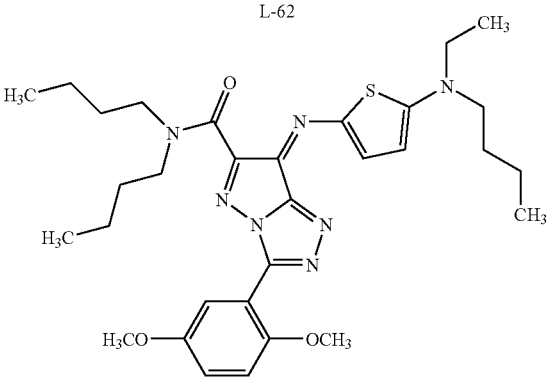
L-63
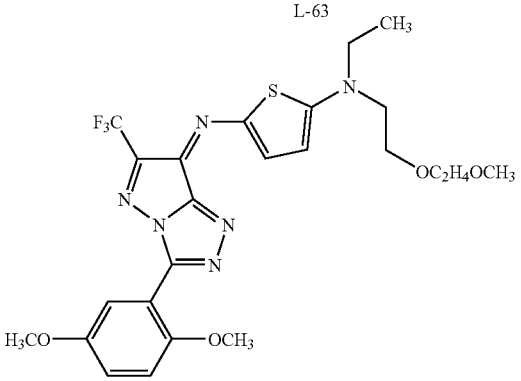
L-64
TABLE 1-continued
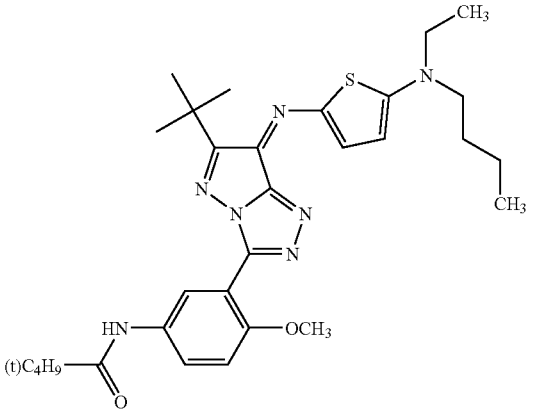
L-65
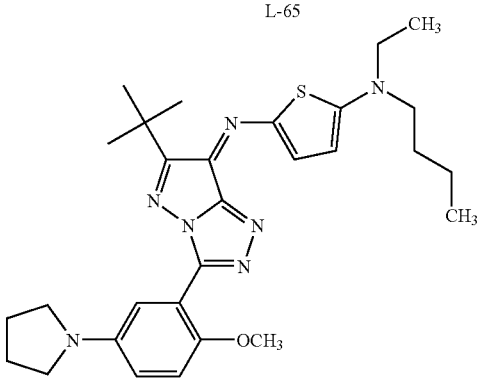
L-66
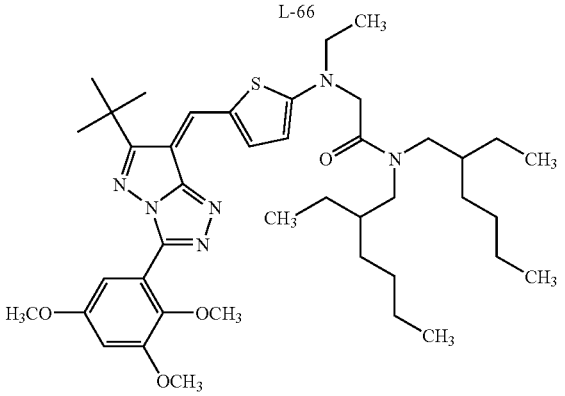
L-67
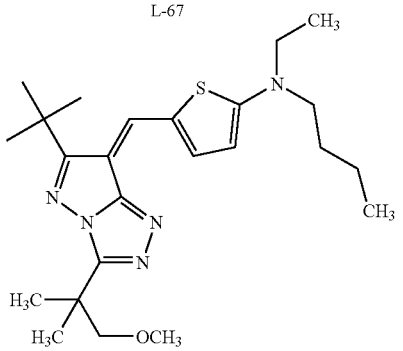
L-68

TABLE 1-continued
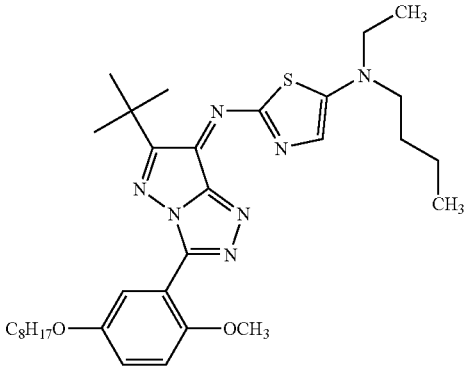
L-69
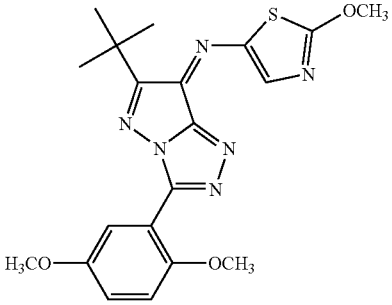
L-70
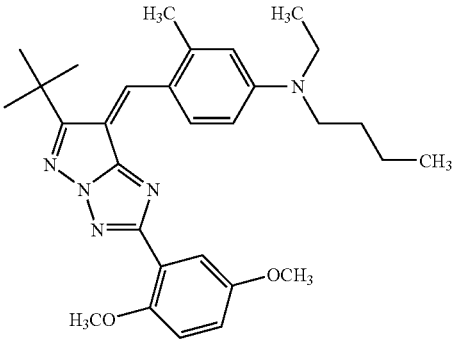
L-71
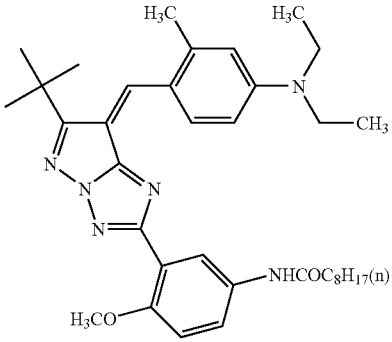
L-72
TABLE 1-continued
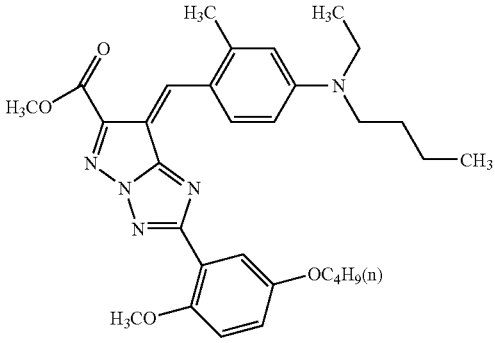
L-73
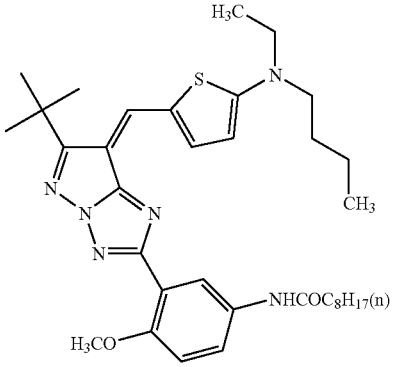
L-74
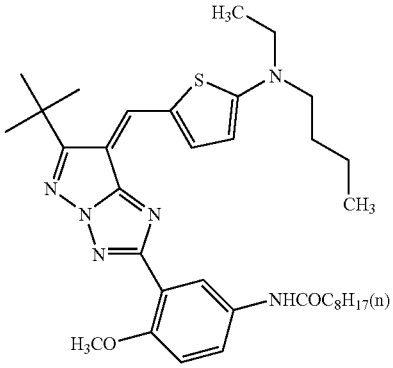
L-75
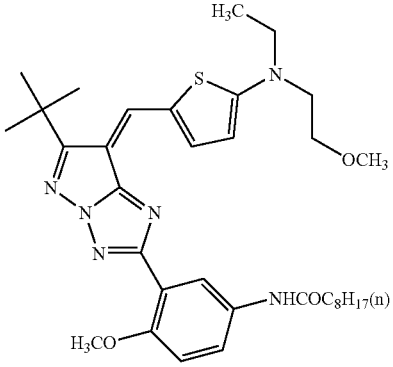
L-76

TABLE 1-continued
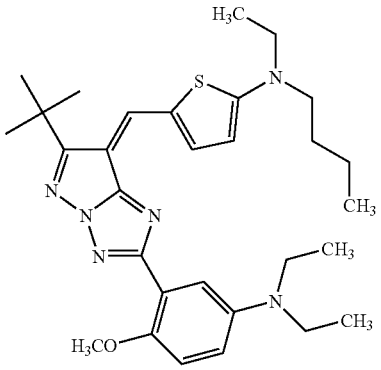
L-77
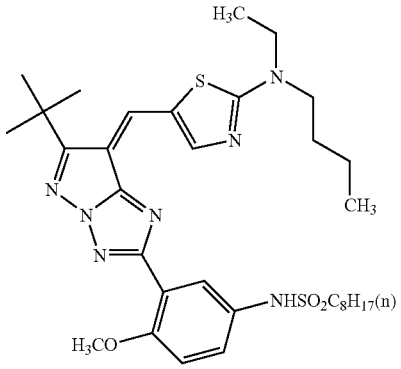
L-78
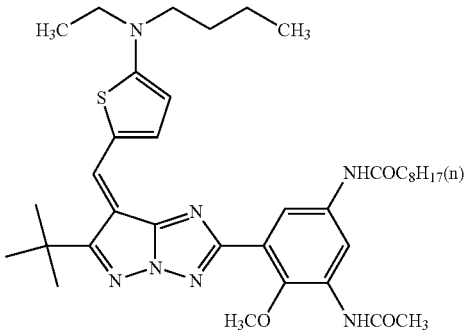
L-79
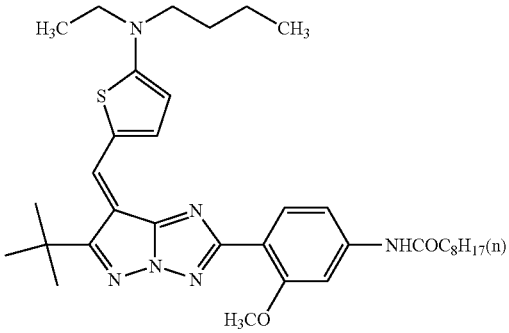
L-80
TABLE 1-continued
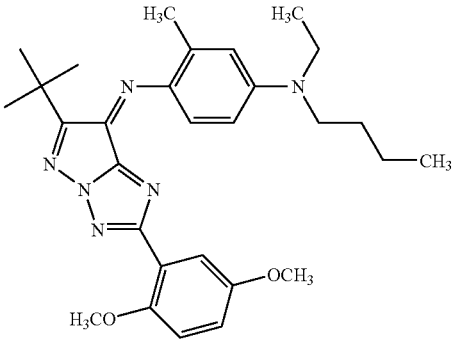
L-81
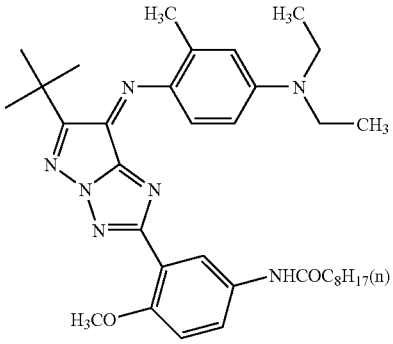
L-82
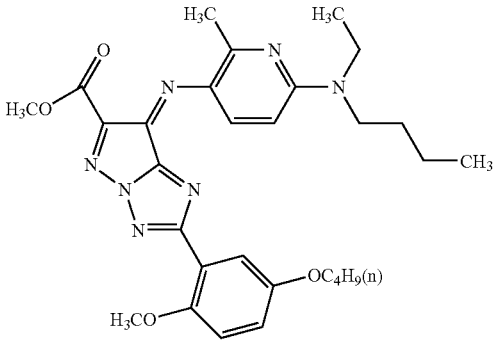
L-83
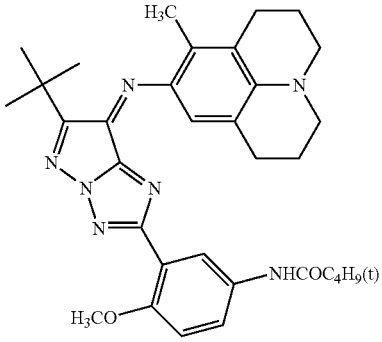
L-84

TABLE 1-continued
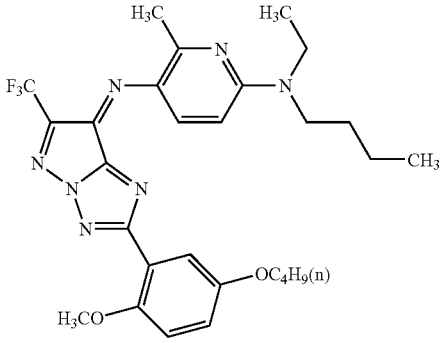
L-85
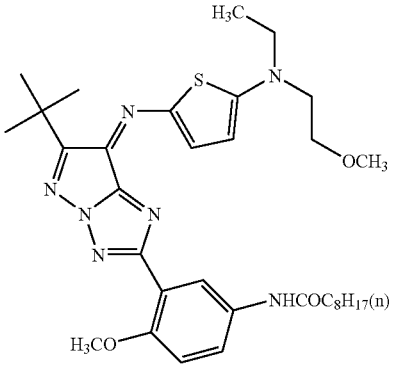
L-86
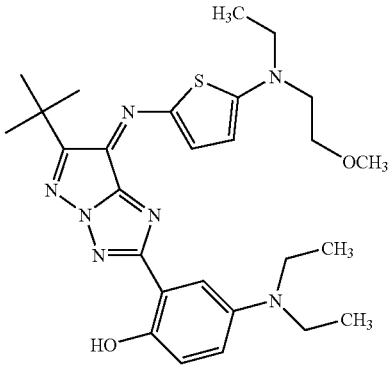
L-87
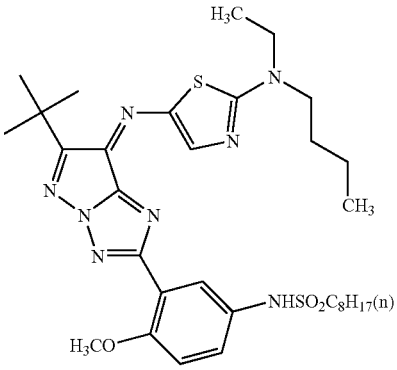
L-88
TABLE 1-continued
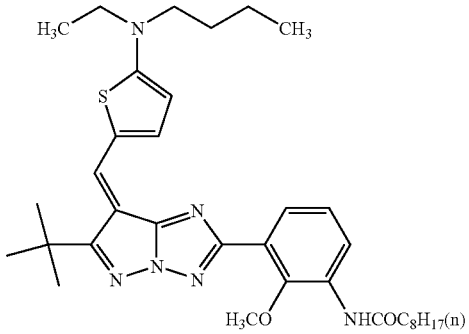
L-89
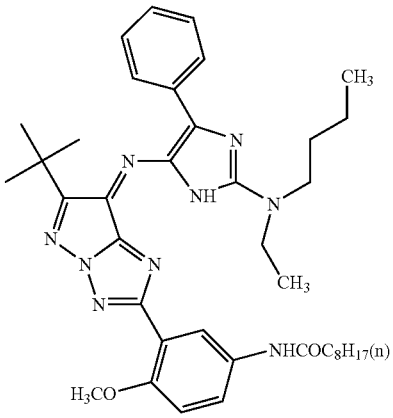
L-90
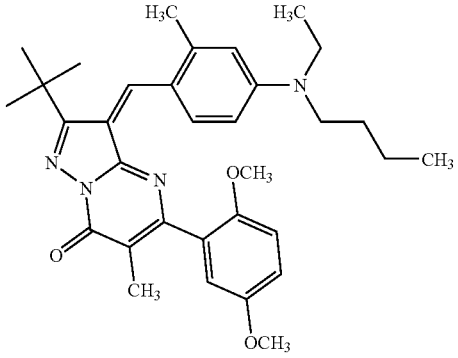
L-91
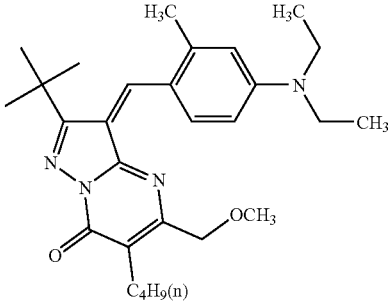
L-92

TABLE 1-continued
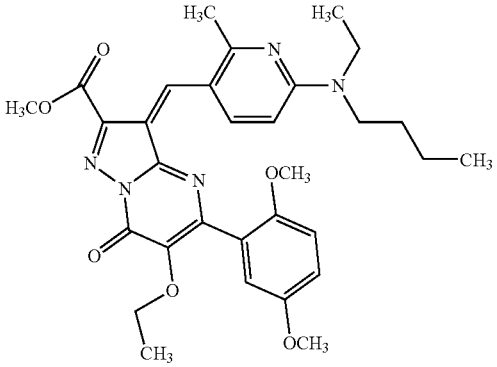
L-93
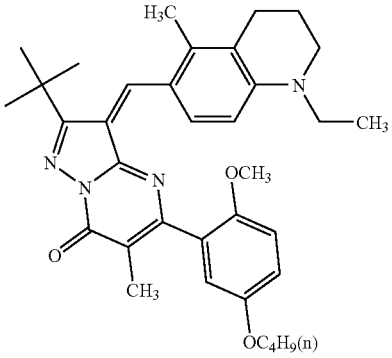
L-94
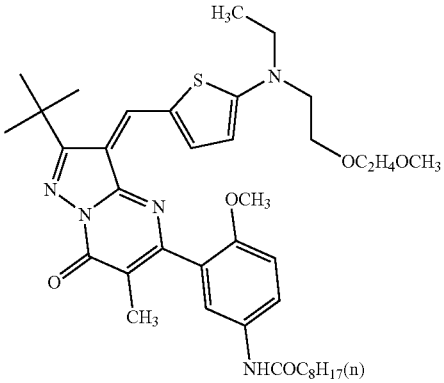
L-95
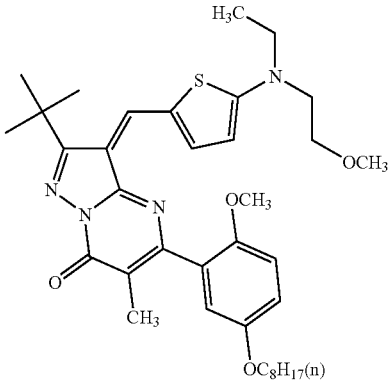
L-96
TABLE 1-continued
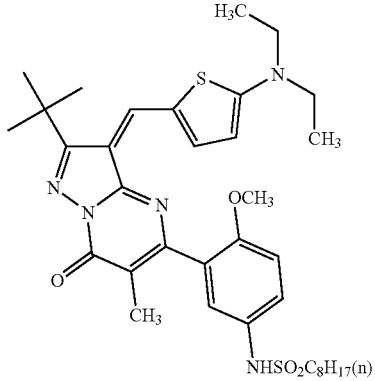
L-97
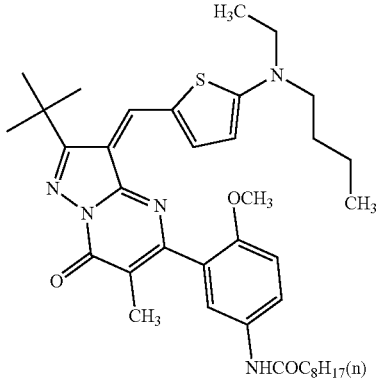
L-98
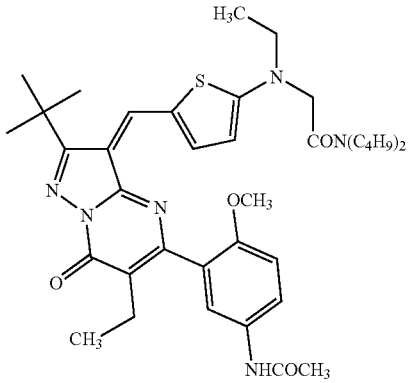
L-99
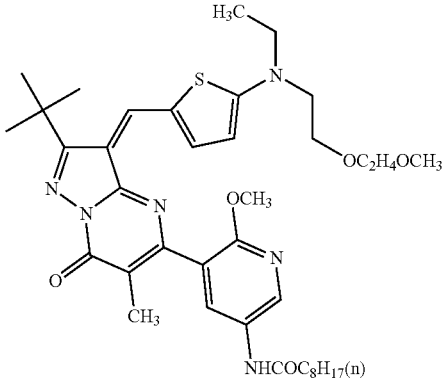
L-100

TABLE 1-continued
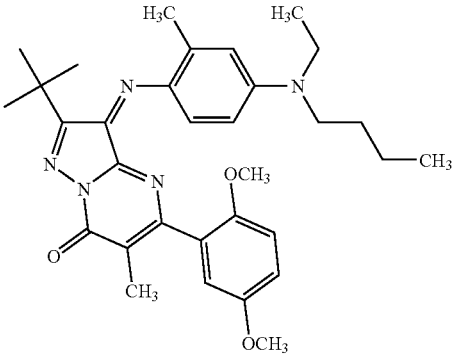
L-101
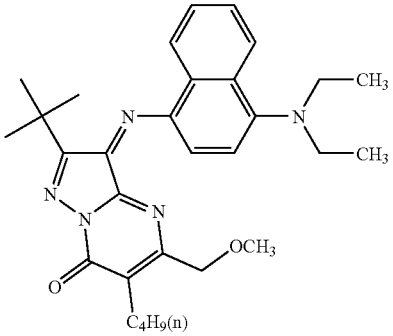
L-102
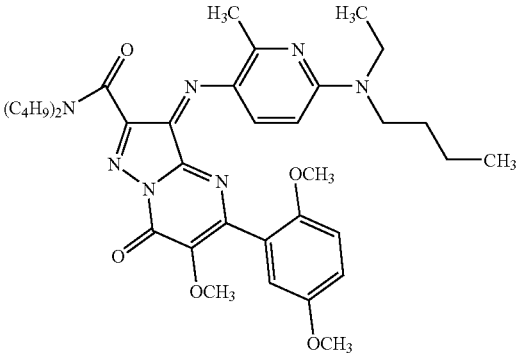
L-103
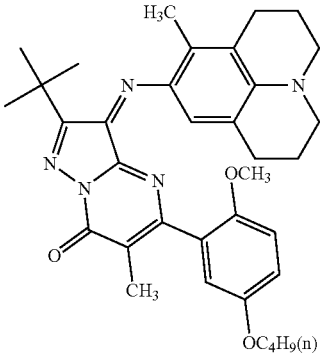
L-104
TABLE 1-continued
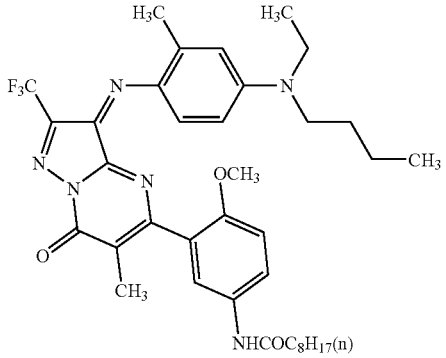
L-105
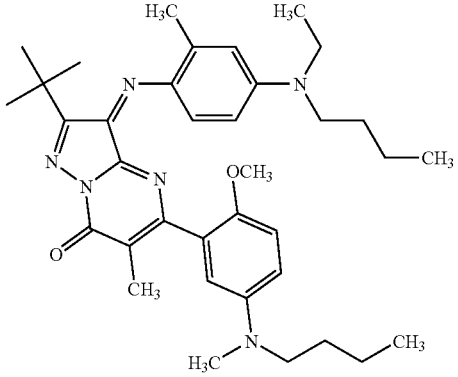
L-106
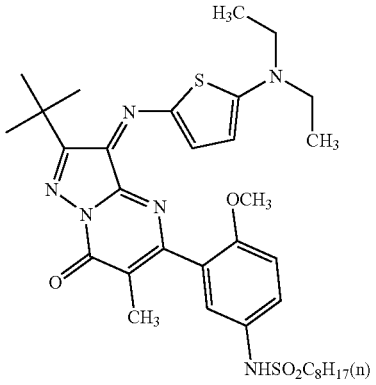
L-107
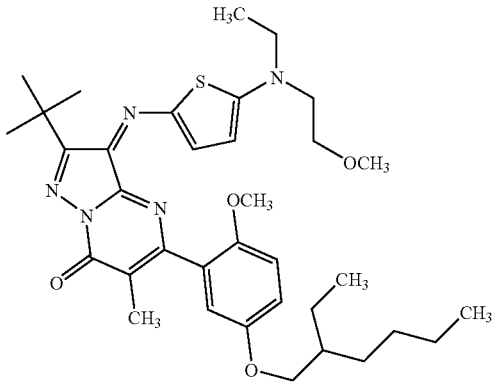
L-108

TABLE 1-continued
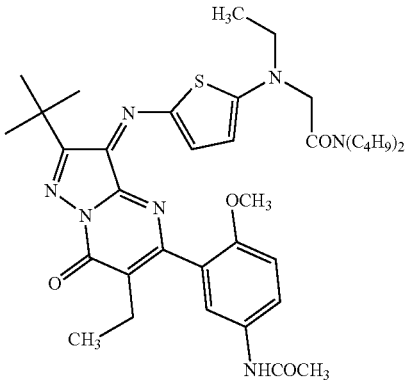
L-109
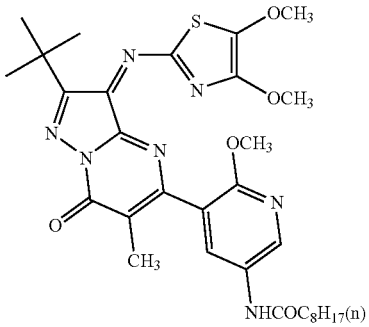
L-110
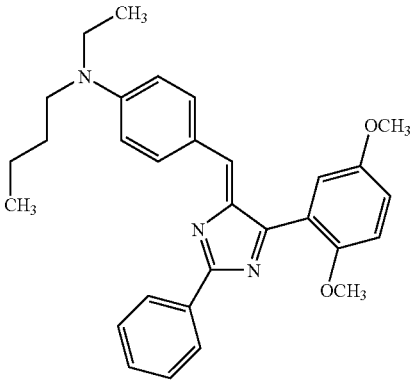
L-111
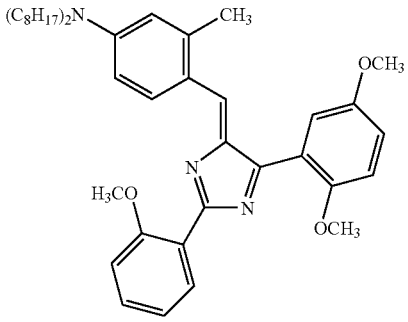
L-112
TABLE 1-continued
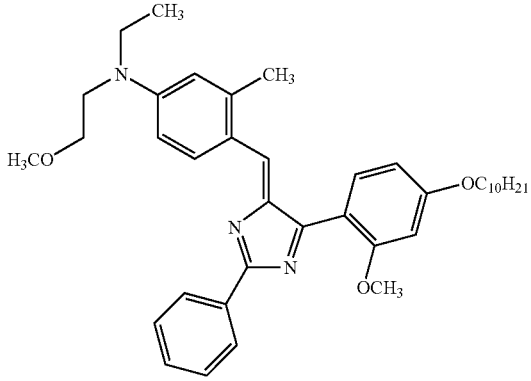
L-113
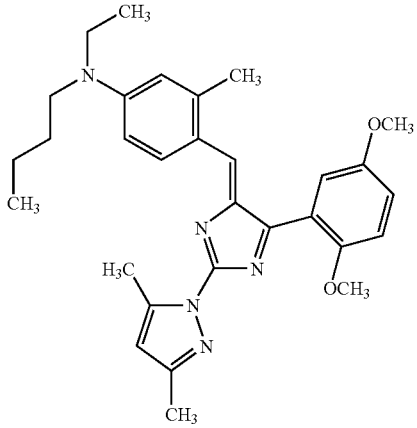
L-114
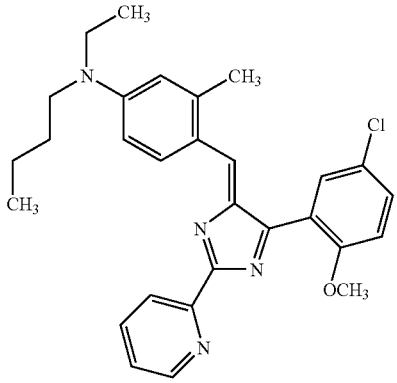
L-115
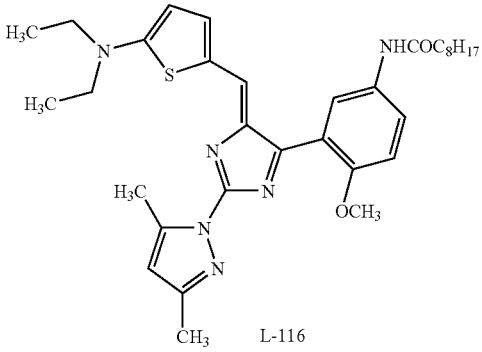
L-116

TABLE 1-continued
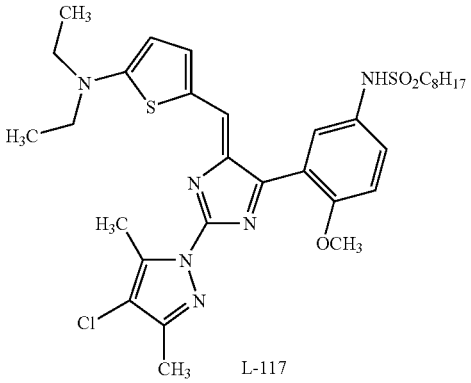
L-117
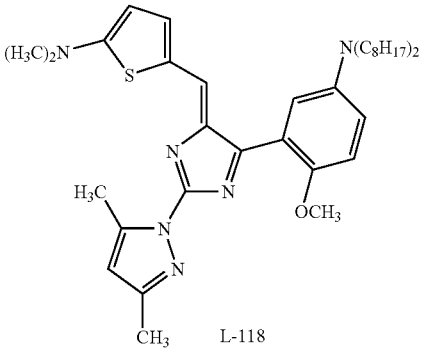
L-118
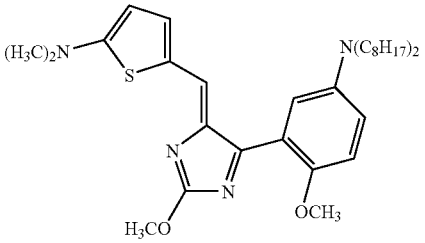
L-119
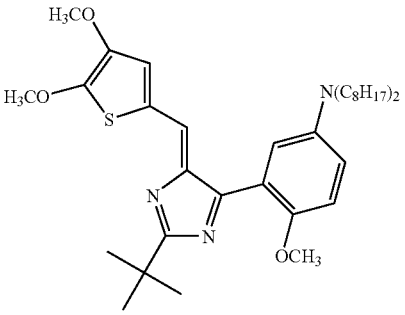
L-120
TABLE 1-continued
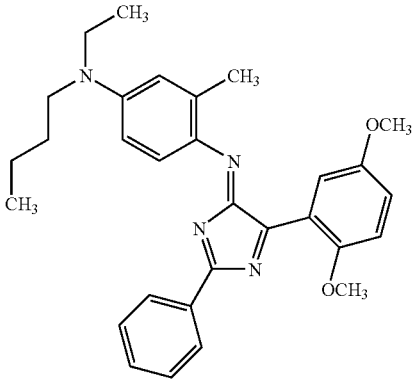
L-121
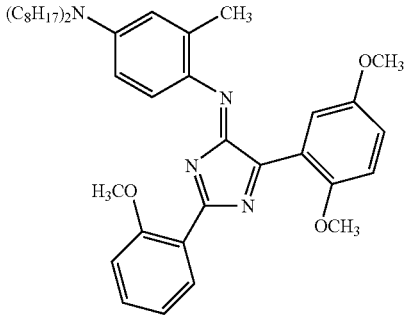
L-122
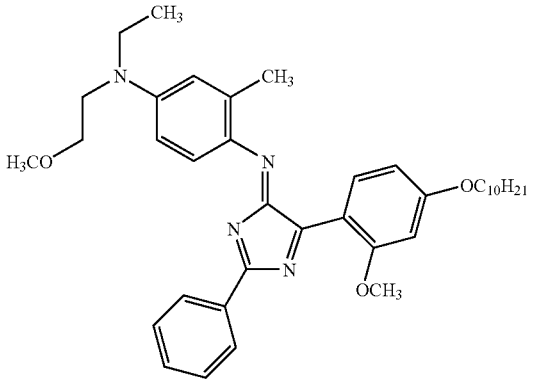
L-123
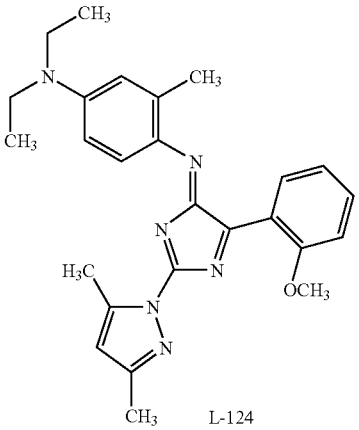
L-124

TABLE 1-continued
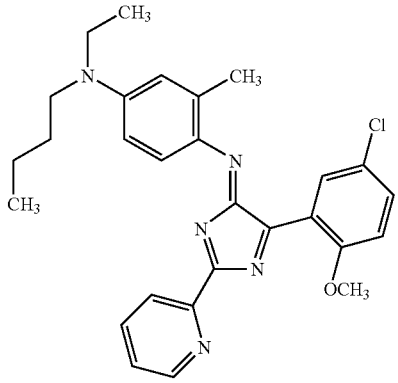
L-125
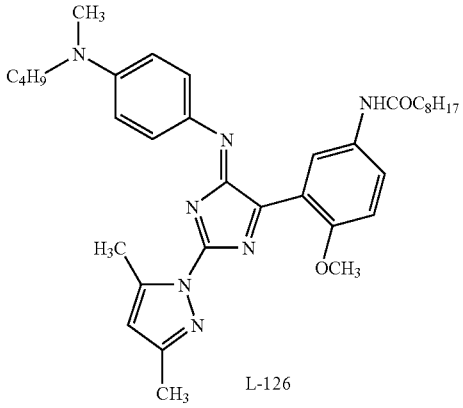
L-126
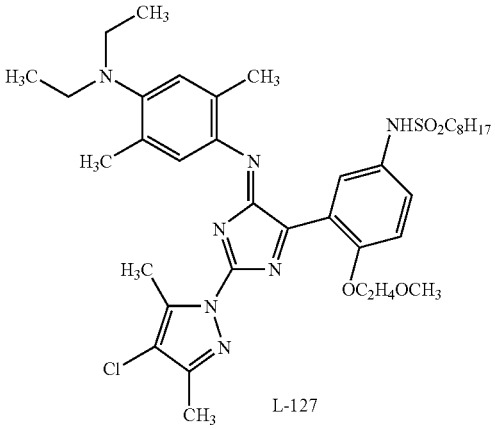
L-127
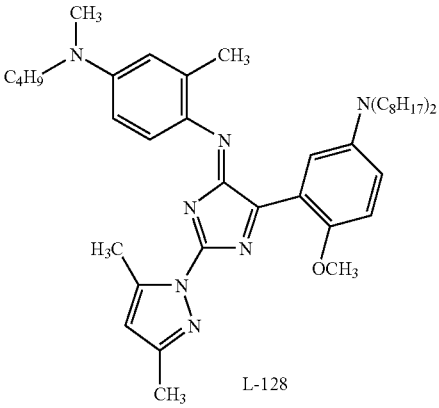
L-128
TABLE 1-continued
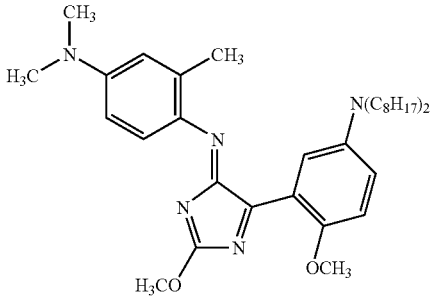
L-129
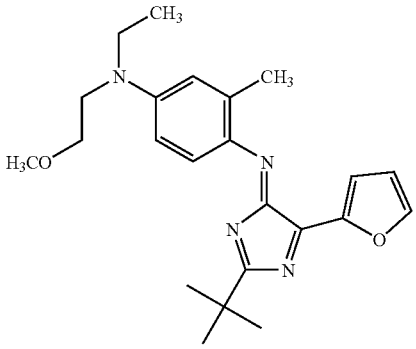
L-130
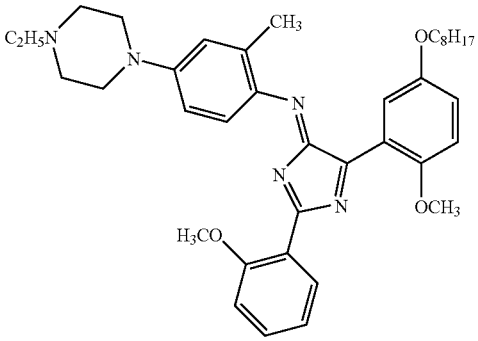
L-131
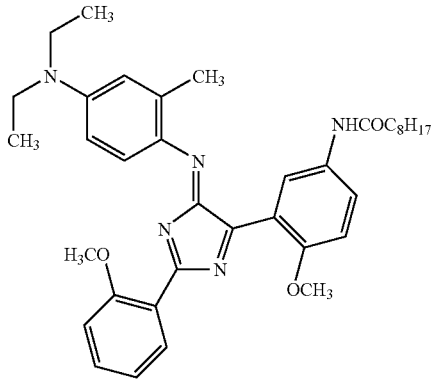
L-132

TABLE 1-continued
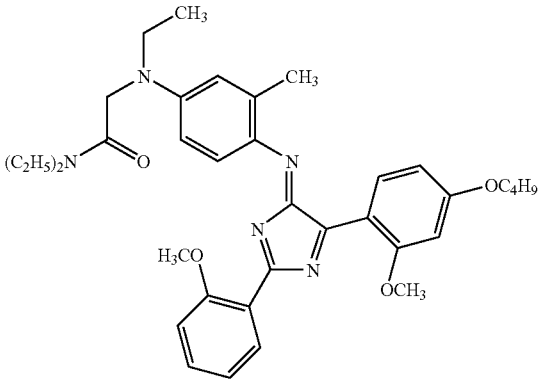
L-133
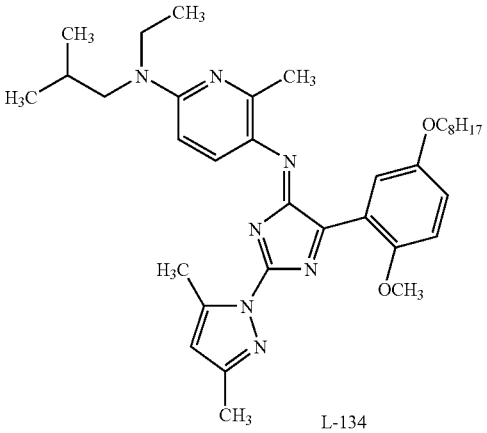
L-134
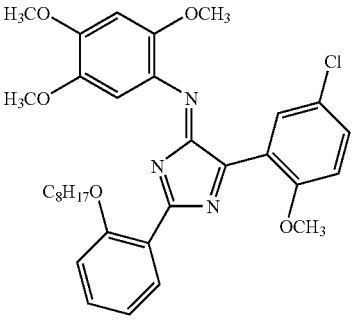
L-135
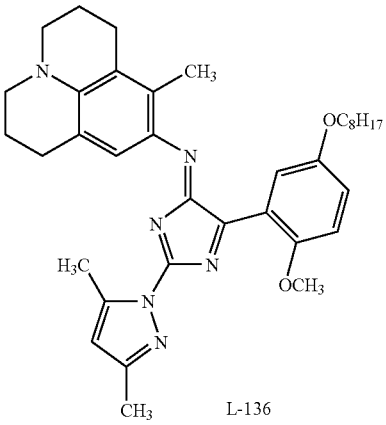
L-136
TABLE 1-continued
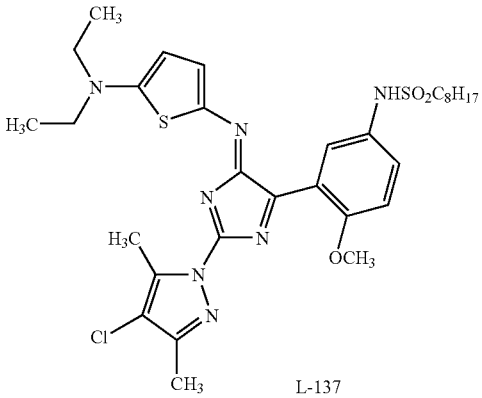
L-137
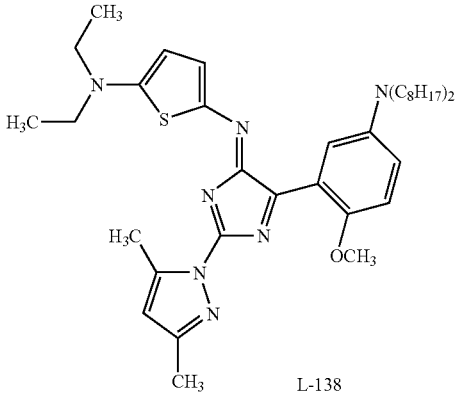
L-138
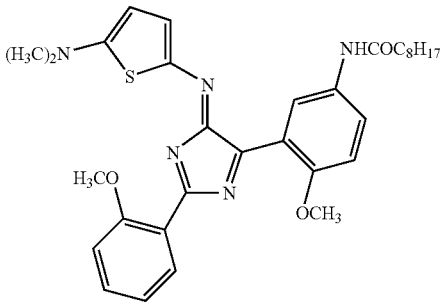
L-139
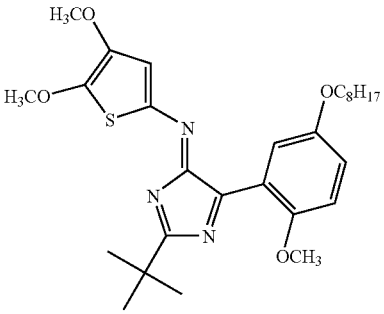
L-140

TABLE 1-continued
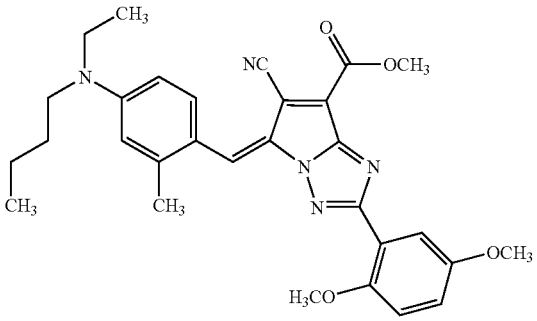
L-141
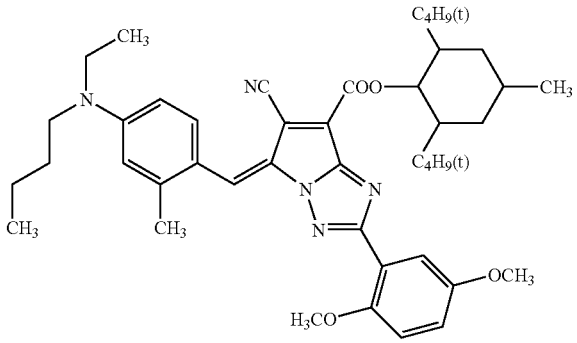
L-142
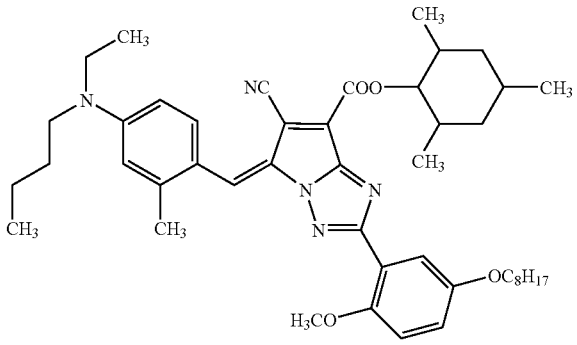
L-143
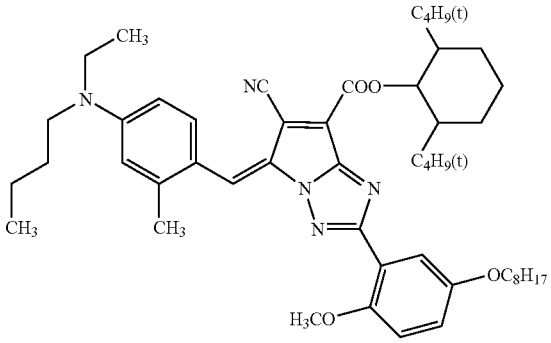
L-144
TABLE 1-continued
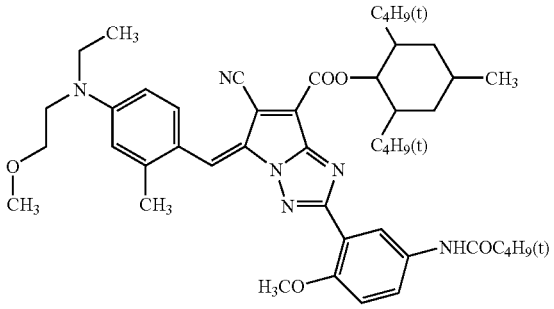
L-145
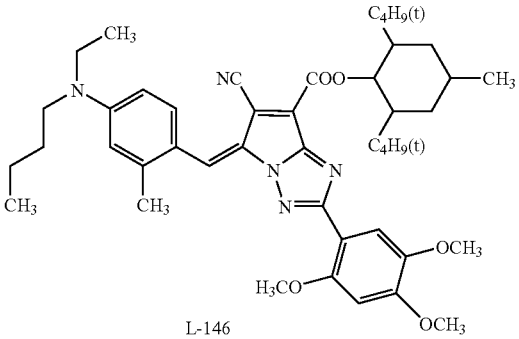
L-146
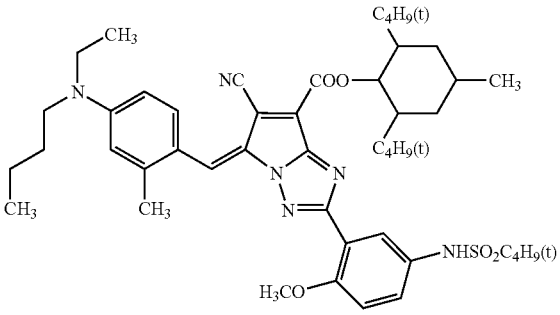
L-147
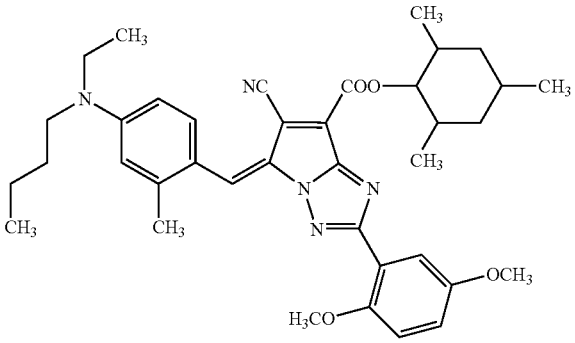
L-148

TABLE 1-continued
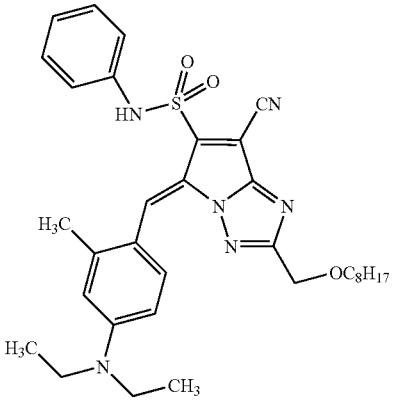
L-149
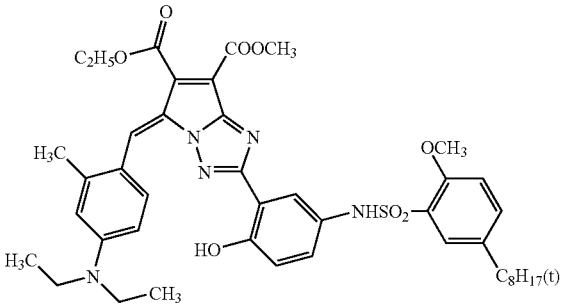
L-150
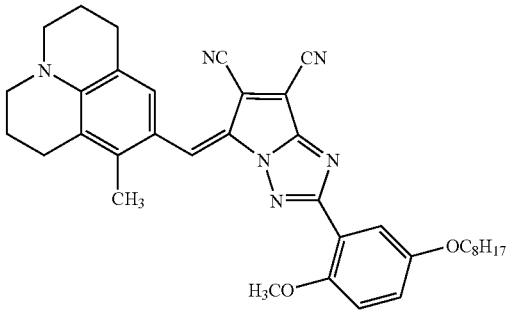
L-151
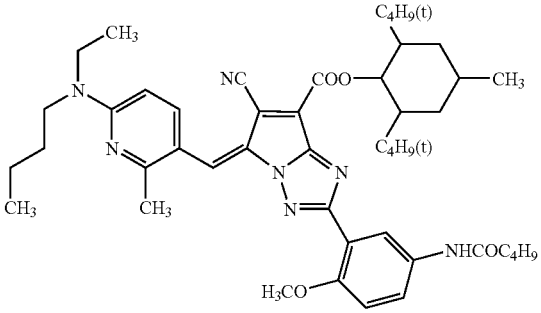
L-152
TABLE 1-continued
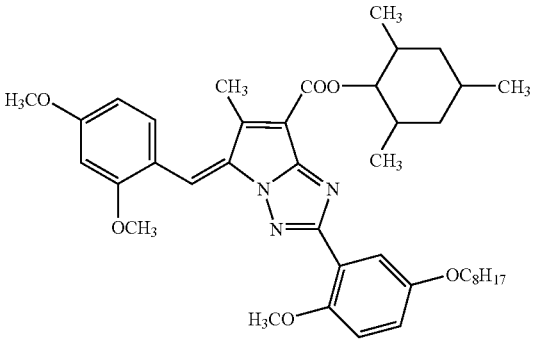
L-153
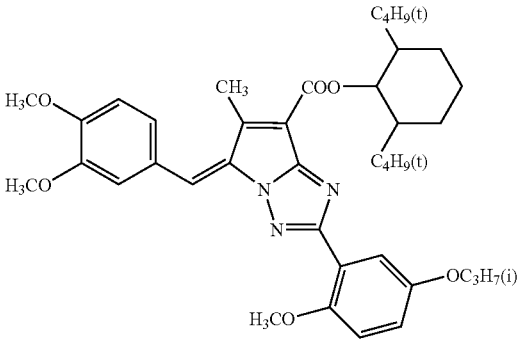
L-154
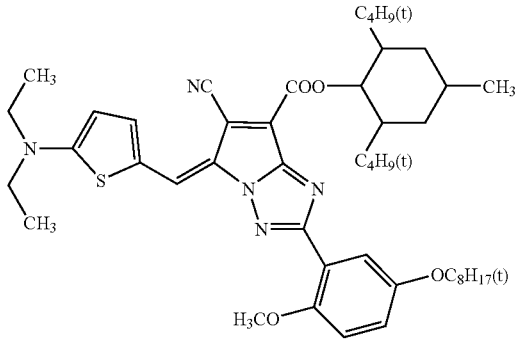
L-155
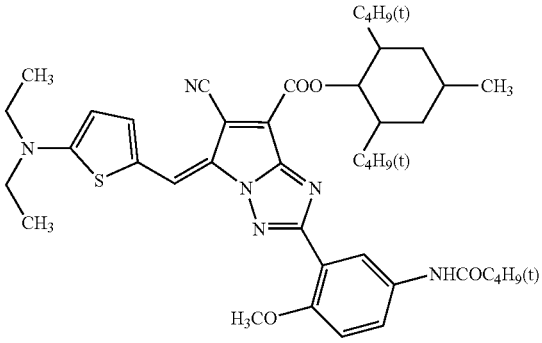
L-156

TABLE 1-continued
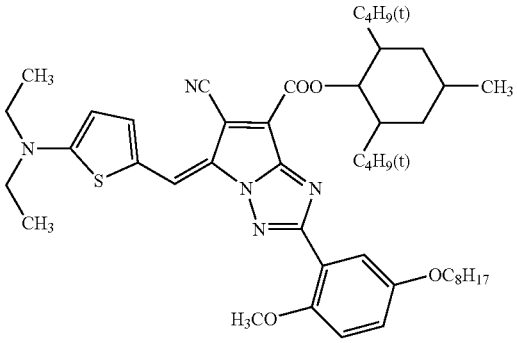
L-157
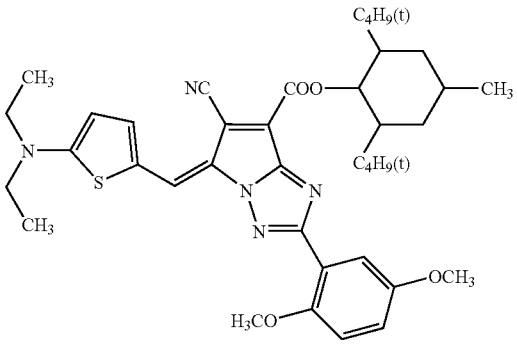
L-158
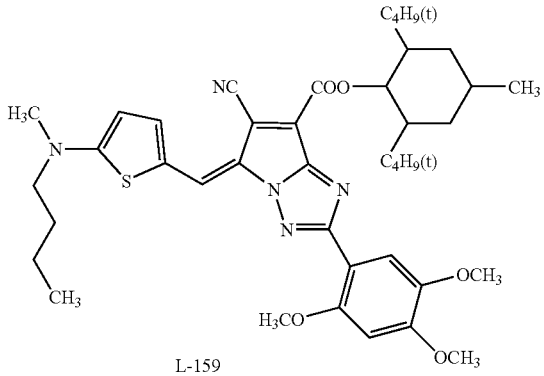
L-159
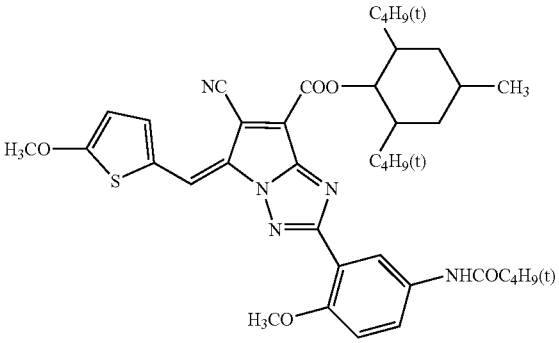
L-160
TABLE 1-continued
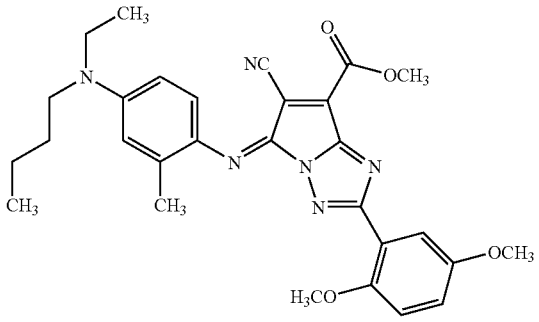
L-161
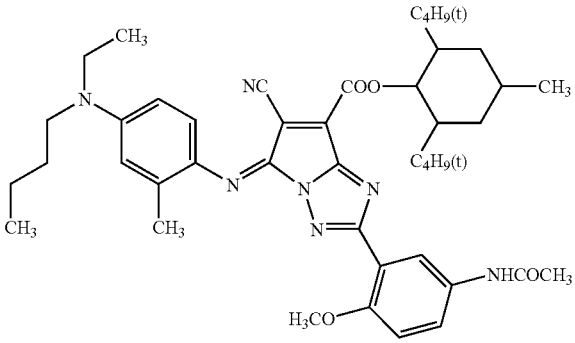
L-162
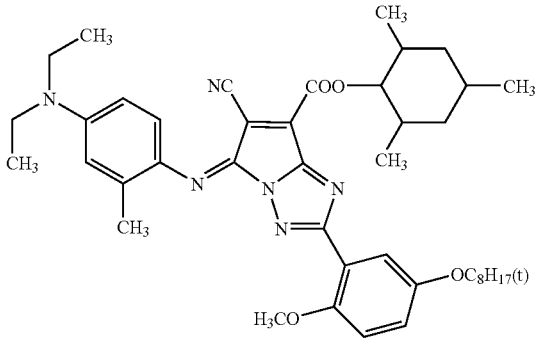
L-163
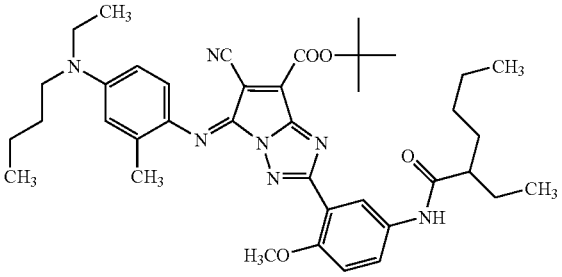
L-164

TABLE 1-continued
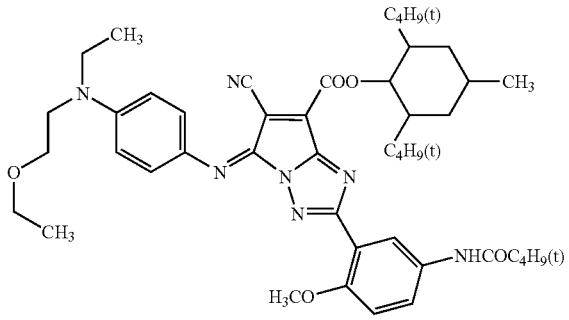
L-165
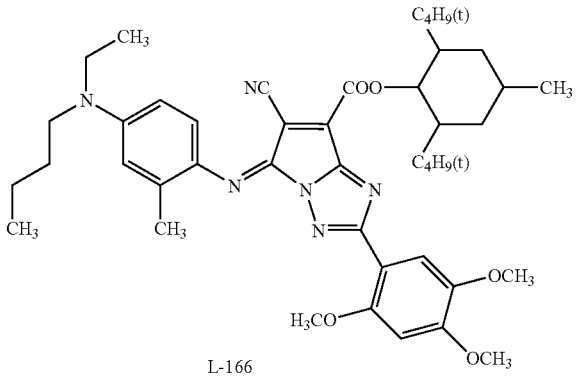
L-166
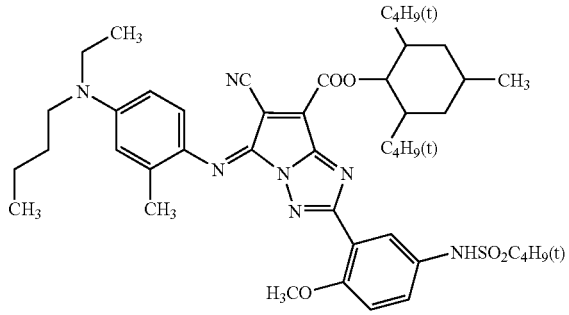
L-167
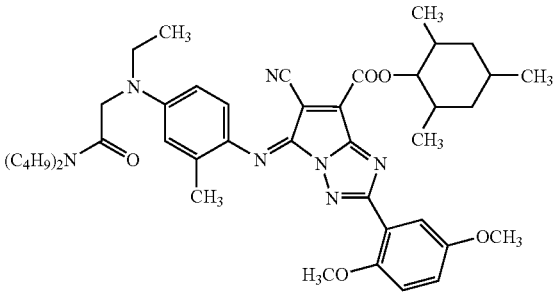
L-168
TABLE 1-continued
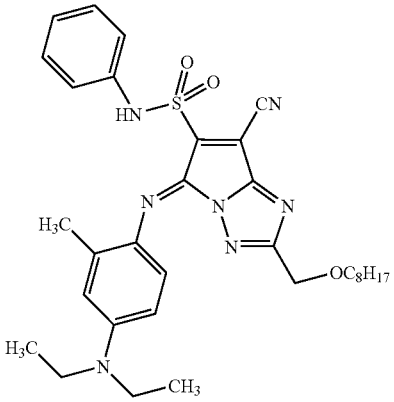
L-169
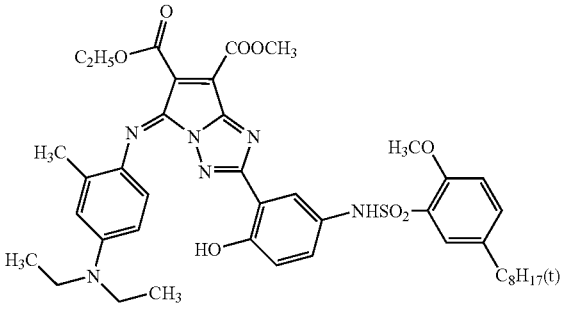
L-170
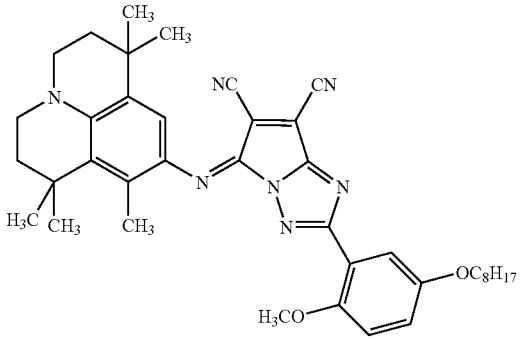
L-171
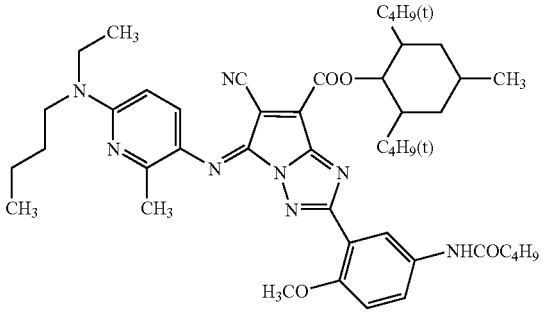
L-172

TABLE 1-continued
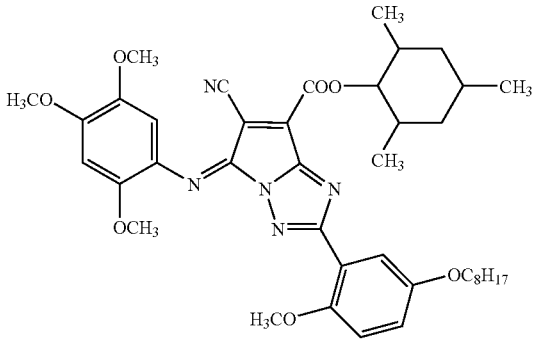
L-173
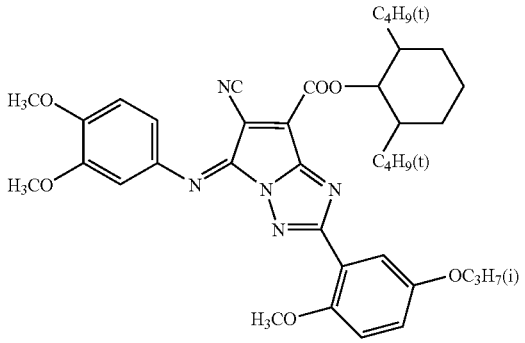
L-174
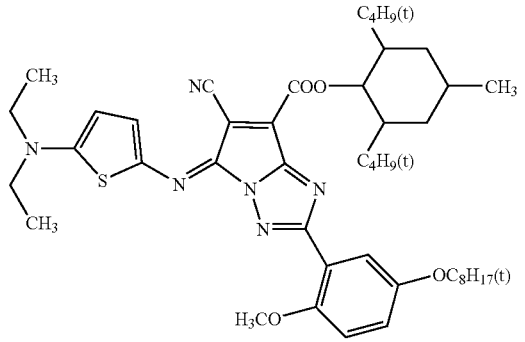
L-175
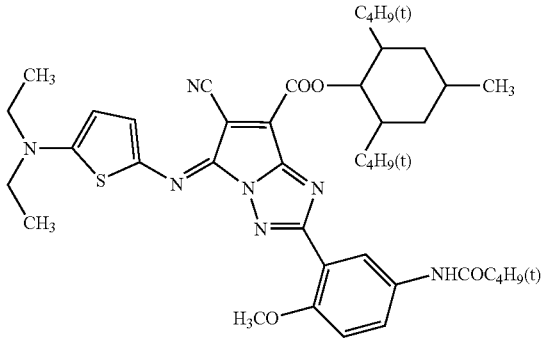
L-176
TABLE 1-continued
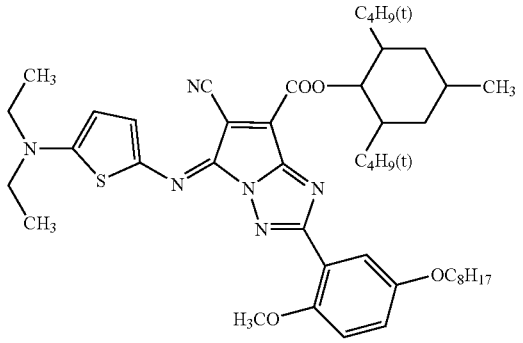
L-177
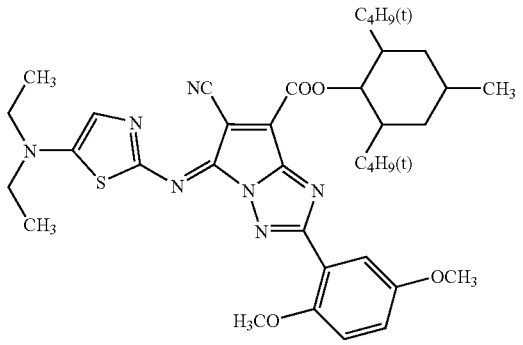
L-178
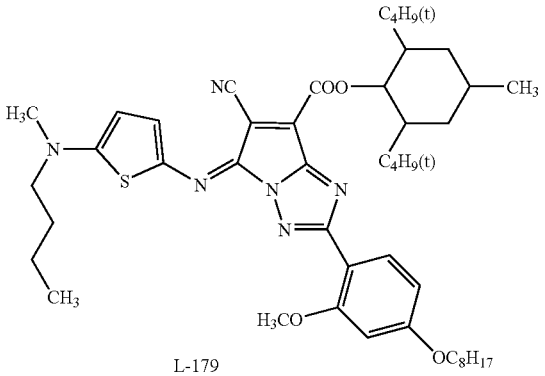
L-179
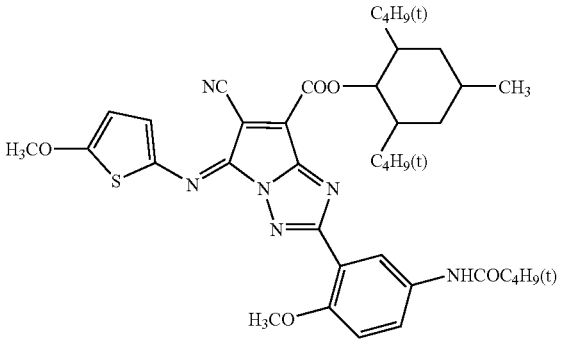
L-180

TABLE 1-continued
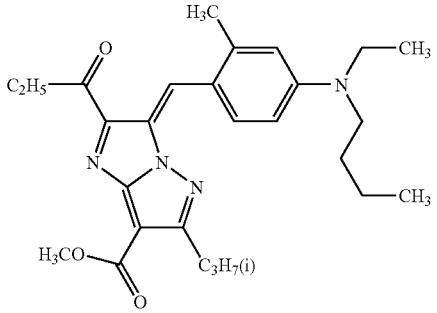
L-181
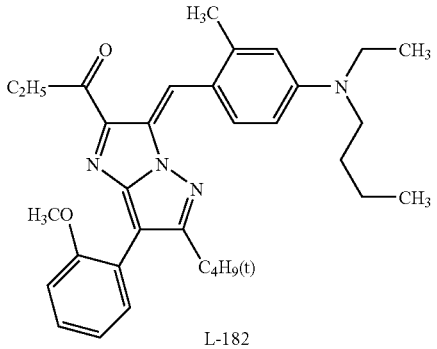
L-182
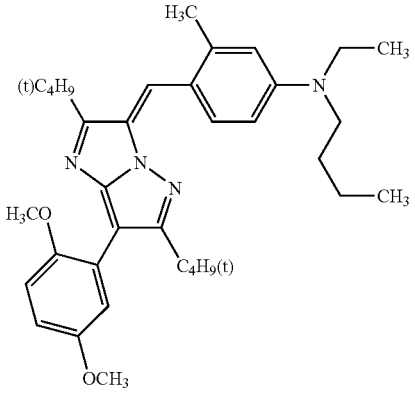
L-183
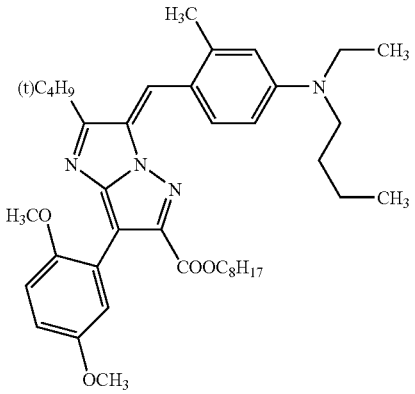
L-184
TABLE 1-continued
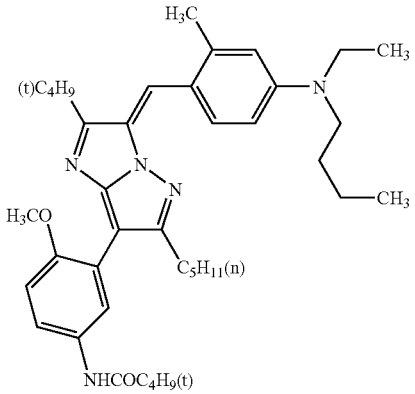
L-185
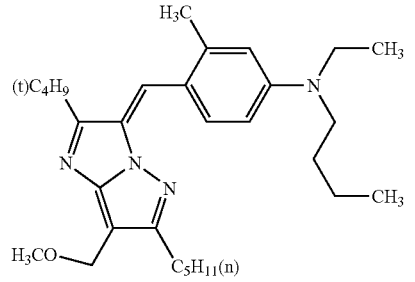
L-186
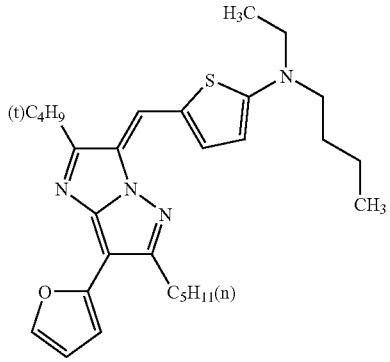
L-187
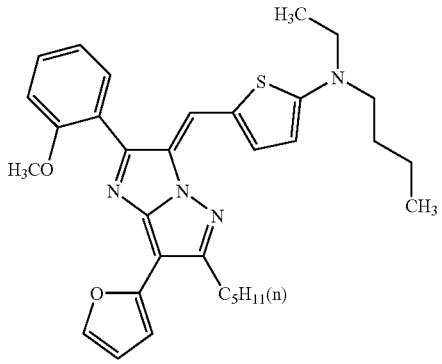
L-188

TABLE 1-continued
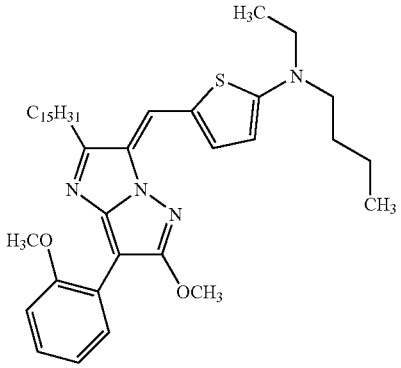
L-189
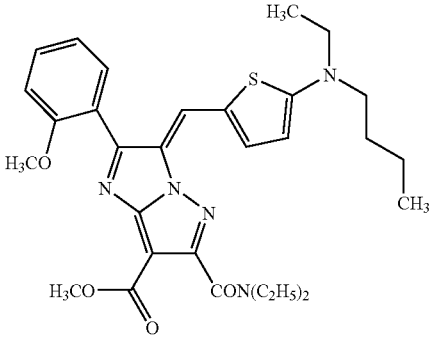
L-190
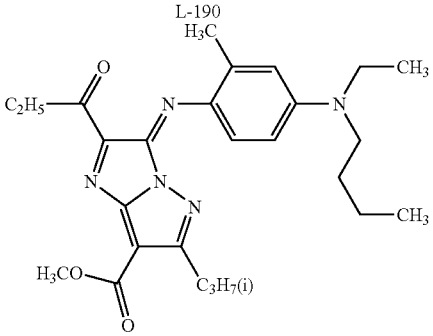
L-191
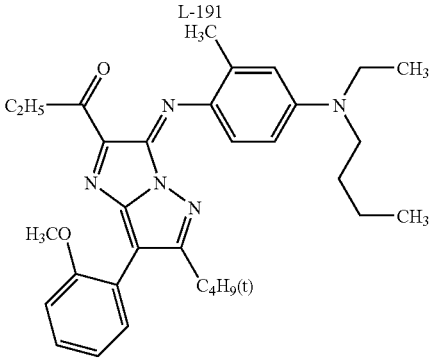
L-192
TABLE 1-continued
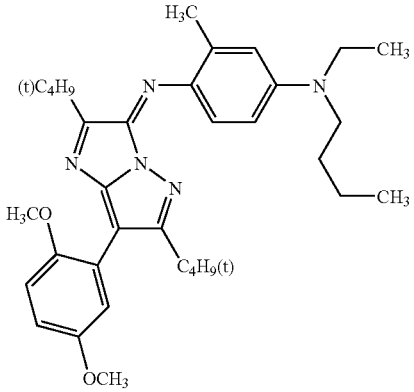
L-193
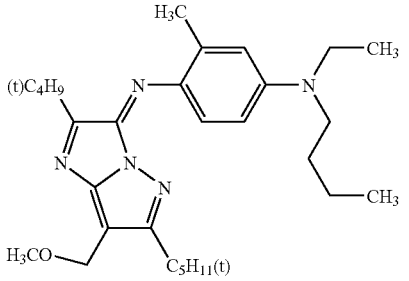
L-194
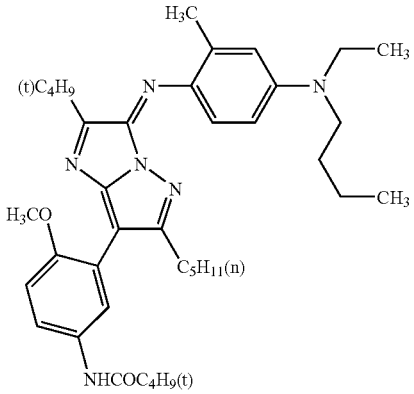
L-195
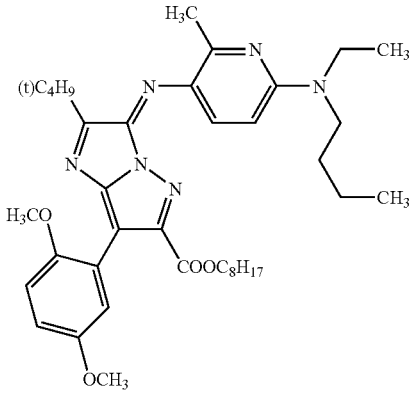
L-196

TABLE 1-continued

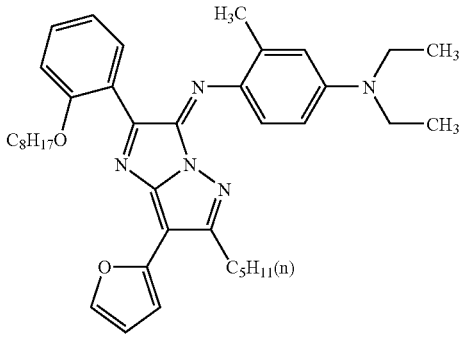

L-197

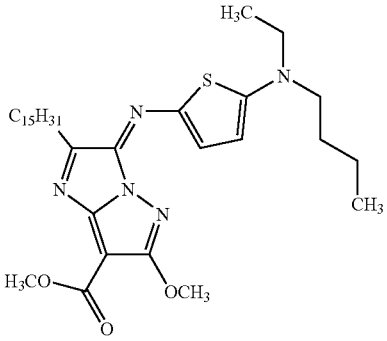

L-198

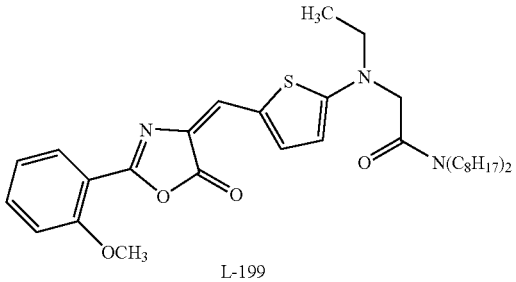

L-199

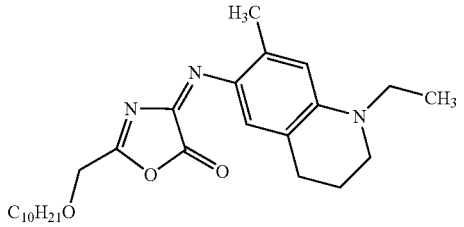

L-200

| Compound No. | Metal Ion | $L_1$, $L_2$ | | $X_1$, $X_2$, $W_1$ | | |
|---|---|---|---|---|---|---|
| MD-1 | $Cu^{2+}$ | L-1 | L-1 | X-26 | X-26 | — |
| MD-2 | $Cu^{2+}$ | L-4 | L-4 | X-111 | X-111 | — |
| MD-3 | $Cu^{2+}$ | L-13 | L-13 | X-4 | X-4 | — |
| MD-4 | $Cu^{2+}$ | L-13 | L-13 | X-116 | X-116 | — |
| MD-5 | $Cu^{2+}$ | L-18 | L-18 | X-78 | X-78 | — |
| MD-6 | $Cu^{2+}$ | L-21 | L-21 | X-52 | X-52 | — |
| MD-7 | $Cu^{2+}$ | L-25 | L-25 | X-112 | X-112 | — |
| MD-8 | $Cu^{2+}$ | L-28 | L-28 | X-52 | X-52 | — |
| MD-9 | $Cu^{2+}$ | L-35 | L-35 | X-111 | X-111 | — |
| MD-10 | $Cu^{2+}$ | L-35 | L-35 | X-116 | X-116 | — |
| MD-11 | $Cu^{2+}$ | L-38 | L-38 | X-116 | X-4 | — |
| MD-12 | $Cu^{2+}$ | L-39 | L-39 | X-116 | X-116 | — |
| MD-13 | $Cu^{2+}$ | L-42 | L-42 | X-78 | X-78 | — |
| MD-14 | $Cu^{2+}$ | L-44 | L-44 | X-53 | X-53 | — |
| MD-15 | $Cu^{2+}$ | L-45 | L-45 | X-116 | X-116 | — |
| MD-16 | $Cu^{2+}$ | L-50 | L-50 | X-110 | X-110 | — |
| MD-17 | $Cu^{2+}$ | L-54 | L-54 | X-116 | X-116 | — |
| MD-18 | $Cu^{2+}$ | L-60 | L-60 | X-116 | X-116 | — |
| MD-19 | $Cu^{2+}$ | L-61 | L-61 | X-111 | X-111 | — |
| MD-20 | $Cu^{2+}$ | L-65 | L-65 | X-78 | X-78 | — |
| MD-21 | $Cu^{2+}$ | L-71 | L-71 | X-116 | X-116 | — |
| MD-22 | $Cu^{2+}$ | L-77 | L-77 | X-78 | X-78 | — |
| MD-23 | $Cu^{2+}$ | L-81 | L-81 | X-111 | X-111 | — |
| MD-24 | $Cu^{2+}$ | L-84 | L-84 | X-52 | X-52 | — |
| MD-25 | $Cu^{2+}$ | L-90 | L-90 | X-26 | X-26 | — |
| MD-26 | $Cu^{2+}$ | L-91 | L-91 | X-78 | X-78 | — |
| MD-27 | $Cu^{2+}$ | L-92 | L-92 | X-110 | X-110 | — |
| MD-28 | $Cu^{2+}$ | L-96 | L-96 | X-116 | X-116 | — |
| MD-29 | $Cu^{2+}$ | L-97 | L-97 | X-112 | X-112 | — |
| MD-30 | $Cu^{2+}$ | L-101 | L-101 | X-111 | X-111 | — |
| MD-31 | $Cu^{2+}$ | L-105 | L-105 | X-78 | X-78 | — |
| MD-32 | $Cu^{2+}$ | L-106 | L-106 | X-116 | X-116 | — |
| MD-33 | $Cu^{2+}$ | L-108 | L-108 | X-116 | X-116 | — |
| MD-34 | $Cu^{2+}$ | L-114 | L-114 | X-23 | X-23 | — |
| MD-35 | $Cu^{2+}$ | L-118 | L-118 | X-52 | X-52 | — |
| MD-36 | $Cu^{2+}$ | L-124 | L-124 | X-111 | X-111 | — |
| MD-37 | $Cu^{2+}$ | L-125 | L-125 | X-78 | X-78 | — |
| MD-38 | $Cu^{2+}$ | L-126 | L-126 | X-116 | X-116 | — |
| MD-39 | $Cu^{2+}$ | L-128 | L-128 | X-125 | X-125 | — |
| MD-40 | $Cu^{2+}$ | L-132 | L-132 | X-78 | X-78 | — |
| MD-41 | $Cu^{2+}$ | L-135 | L-135 | X-4 | X-4 | — |
| MD-42 | $Cu^{2+}$ | L-139 | L-139 | X-111 | X-111 | — |
| MD-43 | $Cu^{2+}$ | L-144 | L-144 | X-117 | X-117 | — |
| MD-44 | $Cu^{2+}$ | L-145 | L-145 | X-123 | X-123 | — |
| MD-45 | $Cu^{2+}$ | L-153 | L-153 | X-118 | X-118 | — |
| MD-46 | $Cu^{2+}$ | L-160 | L-160 | X-74 | X-74 | — |
| MD-47 | $Cu^{2+}$ | L-163 | L-163 | X-126 | X-126 | — |
| MD-48 | $Cu^{2+}$ | L-164 | L-164 | X-111 | X-111 | — |
| MD-49 | $Cu^{2+}$ | L-166 | L-166 | X-78 | X-78 | — |
| MD-50 | $Cu^{2+}$ | L-167 | L-167 | X-112 | X-112 | — |
| MD-51 | $Cu^{2+}$ | L-173 | L-173 | X-54 | X-54 | — |
| MD-52 | $Cu^{2+}$ | L-178 | L-178 | X-52 | X-52 | — |
| MD-53 | $Cu^{2+}$ | L-179 | L-179 | X-53 | X-53 | — |
| MD-54 | $Cu^{2+}$ | L-186 | L-186 | X-78 | X-78 | — |
| MD-55 | $Cu^{2+}$ | L-191 | L-191 | X-116 | X-116 | — |
| MD-56 | $Cu^{2+}$ | L-195 | L-195 | X-4 | X-4 | — |
| MD-57 | $Cu^{2+}$ | L-197 | L-197 | X-26 | X-26 | — |
| MD-58 | $Cu^{2+}$ | L-199 | L-199 | X-52 | X-52 | — |
| MD-59 | $Cu^{2+}$ | L-6 | L-6 | X-78 | X-78 | — |
| MD-60 | $Zn^{2+}$ | L-10 | L-10 | X-116 | X-116 | — |
| MD-61 | $Zn^{2+}$ | L-17 | L-17 | X-122 | X-122 | — |
| MD-62 | $Zn^{2+}$ | L-20 | L-20 | X-115 | X-115 | — |
| MD-63 | $Zn^{2+}$ | L-35 | L-35 | X-111 | X-111 | — |
| MD-64 | $Zn^{2+}$ | L-47 | L-47 | X-116 | X-116 | — |
| MD-65 | $Zn^{2+}$ | L-55 | L-55 | X-52 | X-52 | — |
| MD-66 | $Zn^{2+}$ | L-56 | L-56 | X-78 | X-78 | — |
| MD-67 | $Zn^{2+}$ | L-59 | L-59 | X-116 | X-116 | — |
| MD-68 | $Zn^{2+}$ | L-67 | L-67 | X-78 | X-78 | — |
| MD-69 | $Zn^{2+}$ | L-71 | L-71 | X-52 | X-52 | — |
| MD-70 | $Zn^{2+}$ | L-74 | L-74 | X-78 | X-78 | — |
| MD-71 | $Zn^{2+}$ | L-82 | L-82 | X-116 | X-116 | — |
| MD-72 | $Zn^{2+}$ | L-86 | L-86 | X-125 | X-125 | — |
| MD-73 | $Zn^{2+}$ | L-94 | L-94 | X-116 | X-116 | — |
| MD-74 | $Zn^{2+}$ | L-95 | L-95 | X-112 | X-112 | — |
| MD-75 | $Zn^{2+}$ | L-105 | L-105 | X-4 | X-4 | — |
| MD-76 | $Zn^{2+}$ | L-109 | L-109 | X-26 | X-26 | — |
| MD-77 | $Zn^{2+}$ | L-113 | L-113 | X-111 | X-111 | — |
| MD-78 | $Zn^{2+}$ | L-119 | L-119 | X-26 | X-26 | — |
| MD-79 | $Zn^{2+}$ | L-121 | L-121 | X-116 | X-116 | — |
| MD-80 | $Zn^{2+}$ | L-127 | L-127 | X-117 | X-117 | — |
| MD-81 | $Zn^{2+}$ | L-138 | L-138 | X-78 | X-78 | — |
| MD-82 | $Zn^{2+}$ | L-147 | L-147 | X-111 | X-111 | — |
| MD-83 | $Zn^{2+}$ | L-157 | L-157 | X-78 | X-78 | — |
| MD-84 | $Zn^{2+}$ | L-169 | L-169 | X-116 | X-116 | — |
| MD-85 | $Zn^{2+}$ | L-177 | L-177 | X-23 | X-23 | — |

TABLE 1-continued

| | | | | | | |
|---|---|---|---|---|---|---|
| MD-86 | $Zn^{2+}$ | L-187 | L-187 | X-111 | X-111 | — |
| MD-87 | $Zn^{2+}$ | L-194 | L-194 | X-52 | X-52 | — |
| MD-88 | $Zn^{2+}$ | L-200 | L-200 | X-4 | X-4 | — |
| MD-89 | $Cu^{2+}$ | L-41 | — | X-4 | X-110 | — |
| MD-90 | $Cu^{2+}$ | L-2 | L-2 | — | — | — |
| MD-91 | $Cu^{2+}$ | L-2 | — | X-4 | X-4 | X-113 |
| MD-92 | $Cu^{2+}$ | L-125 | — | X-4 | X-111 | — |
| MD-93 | $Zn^{2+}$ | L-41 | — | X-4 | X-110 | — |
| MD-94 | $Zn^{2+}$ | L-2 | — | X-26 | X-26 | X-113 |

Dye ligands of the foregoing formulas (2) through (8) can be synthesized by commonly known methods, as described in, for example, JP-A Nos. 63-226653, 10-193807, 11-78258, 6-250357, 2-155693, 1-110565, 2-668, 2-28264, 2-53865, and 2-53866; British Patent No. 1,252,418; JP-A Nos. 64-63194, 2-208094, 3-205189, 2-265791, 2-310087, 2-53866, 4-91987, 63-205288, and 3-226750; British Patent No. 1,183,515; JP-A Nos. 4-190348, 63-113077, 3-275767, 4-13774, 4-89287, 7-175187, 10-60296, 11-78258, and 2004-138834. Metal chelate dyes can be synthesized with reference to conventionally known methods, as described in JP-A Nos. 2000-191934 and 2001-159832.

Next, examples of the synthesis method of dye ligands of the foregoing formula (2) through (8) and the synthesis method of metal chelate dyes of the foregoing formula (1) are shown below, but are by no means limited to these.

Synthesis Example 1

Synthesis of L-35

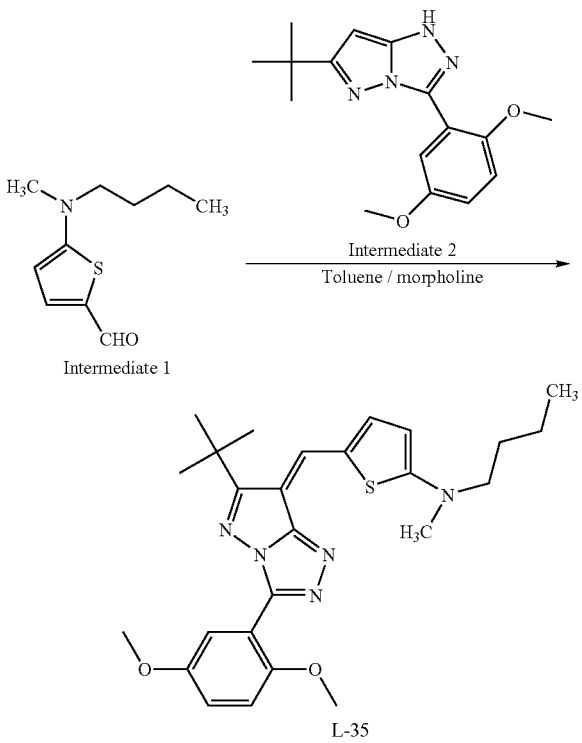

To 2.21 g of intermediate 1 and 3.00 g of intermediate 2 were added 50 ml of toluene and 1.00 g of morpholine with stirring, refluxed with heating and reacted over a period of 4 hr., while dehydrating by using an ester tube. After completion of reaction, the reaction mixture was concentrated, purified in column chromatography and recrystallized in methanol to obtain 4.25 g of L-35. The obtained product was identified in MAS, $^1$H-NMR and IR spectrum to confirm an objective material.

Synthesis Example 2

Synthesis of MD-9

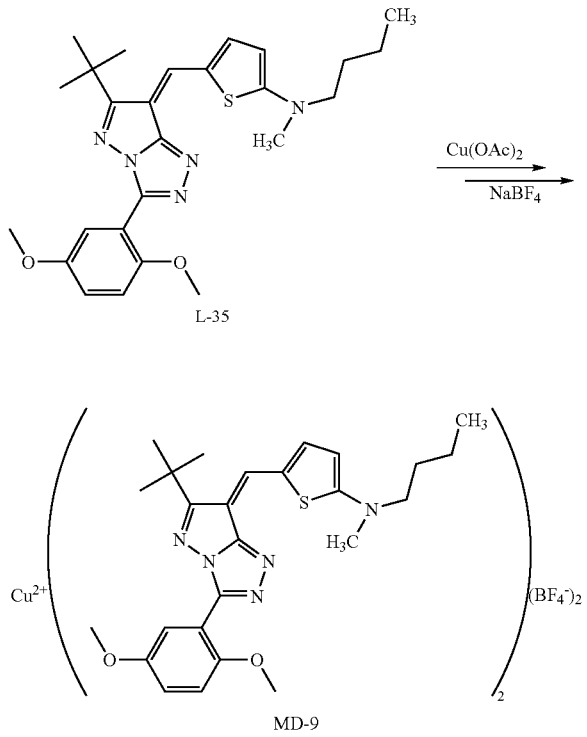

To 3.84 g of L-35 were added 60 ml of methanol and 0.73 g of copper acetate and dissolved with heating, and further stirred at room temperature over 1 hr. Then, 0.88 g of sodium tetrafluoroborate was added thereto and dissolved with heating. After stirred over 1 hr., precipitated crystals were filtered, washed with methanol and dried to obtain 4.31 g of MD-9. The obtained product was identified in UV spectrum and elemental analysis to confirm an objective material.

Synthesis Example 3

Synthesis of MD-10

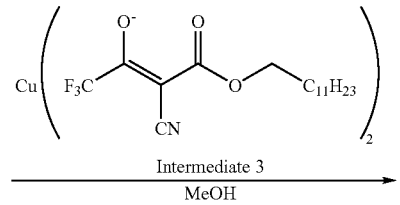

-continued

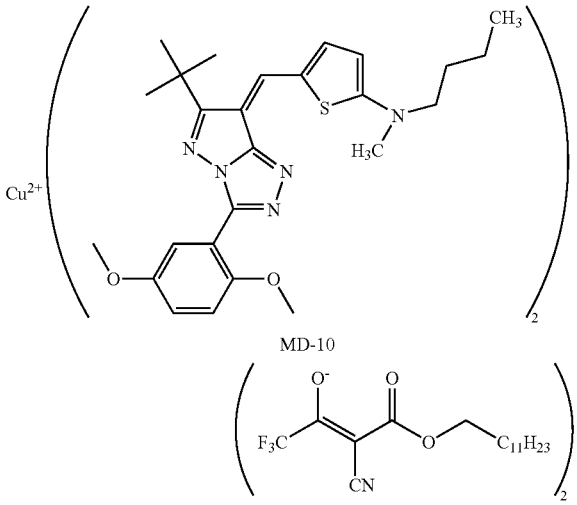

MD-10

To 4.80 g of L-35 was added 60 ml of methanol and dissolved with heating. Further thereto, a solution of 4.49 g of the intermediate 3 dissolved in 10 ml methanol was dropwise added over 5 min. and stirred over a period of 1 hr at room temperature. The reaction mixture was concentrated and dissolved in 100 ml of methanol, neutralized, washed and concentrated to obtain 8.72 g of MD-10. The obtained product was identified in UV spectrum and elemental analysis to confirm an objective material.

Synthesis Example 4

Synthesis of L-124

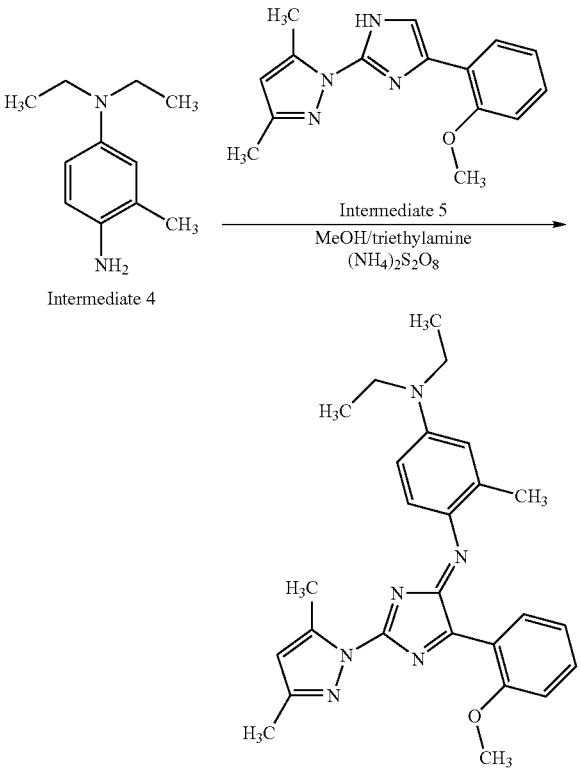

Intermediate 4

L-124

To 5.36 g of intermediate 5 were added 120 ml of methanol and 21.2 ml of triethylamine and dissolved with stirring. Further thereto, 13.0 g of ammonium persulfate dissolved in 20 ml of water and 3.74 g of intermediate 4 dissolved in 20 ml water and 20 ml methanol was dropwise added over 20 min. with stirring. After completion of addition, the reaction mixture was stirred at room temperature for 1 hr. and filtered, and a precipitated inorganic salt was washed with methanol. The filtrate was concentrated, dissolved in 200 ml of ethyl acetate and adjusted to a pH of 1 with 1 M hydrochloric acid. After separated, the reaction product was neutralized, washed and concentrated. The concentrate was purified in column chromatography and recrystallized in acetonitrile to obtain 7.52 g of L-124. The obtained product was identified in MAS, $^1$H-NMR and IR spectrum to confirm an objective material.

Synthesis Example 5

Synthesis of MD-36

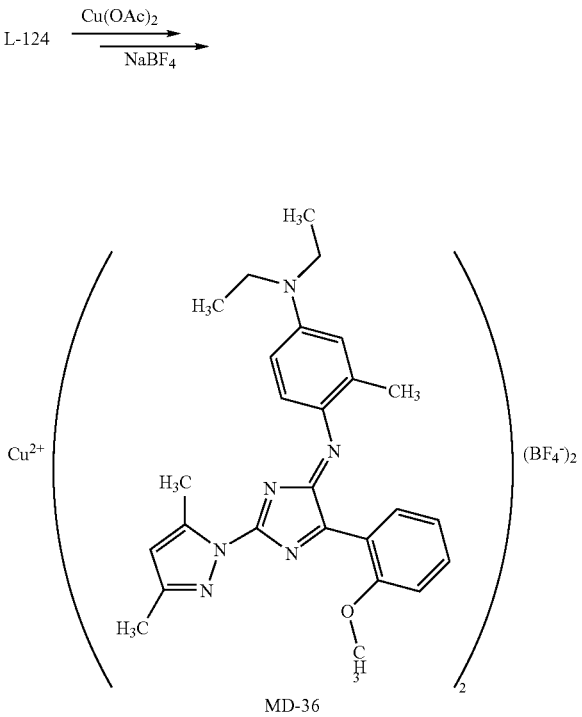

MD-36

To 3.54 g of L-124 were added 60 ml of methanol and 0.73 g of copper acetate and dissolved with heating, and further stirred at room temperature over 1 hr. Then, 0.88 g of sodium tetrafluoroborate was added thereto and dissolved with heating. After stirred over 1 hr., precipitated crystals were filtered, washed with methanol and dried to obtain 4.04 g of MD-36. The obtained product was identified in UV spectrum and elemental analysis to confirm an objective material.

Synthesis Example 6

Synthesis of L-164

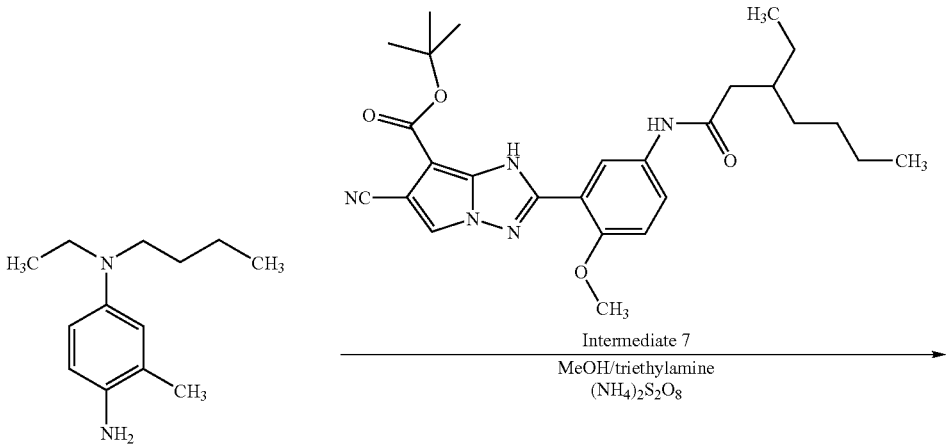

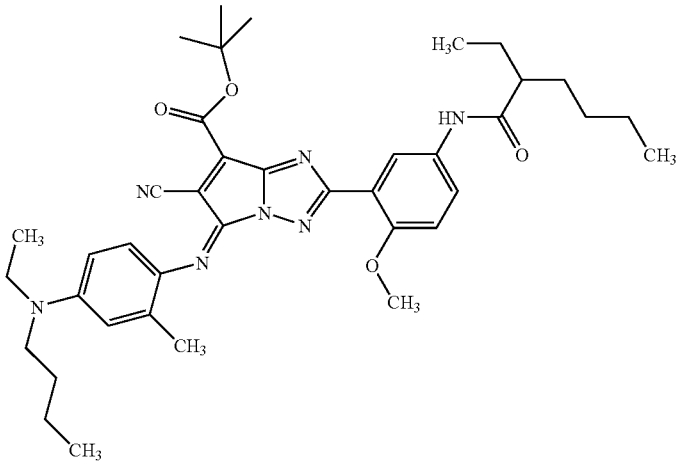

L-164

To 9.87 g of intermediate 7 were added 120 ml of methanol and 21.2 ml of triethylamine and dissolved with stirring. Further thereto, 13.0 g of ammonium persulfate dissolved in 20 ml of water and 4.33 g of intermediate 6 dissolved in 20 ml water and 20 ml methanol was dropwise added over 20 min. with stirring. After completion of addition, the reaction mixture was stirred at room temperature for 1 hr. and filtered, and a precipitated inorganic salt was washed with methanol. The filtrate was concentrated, dissolved in 200 ml of ethyl acetate and adjusted to a pH of 1 with 1 M hydrochloric acid. After separated, the reaction product was neutralized, washed and concentrated. The concentrate was purified in column chromatography and recrystallized in acetonitrile to obtain 11.13 g of L-164. The obtained product was identified in MAS, $^1$H-NMR and IR spectrum to confirm an objective material.

Synthesis Example 7

Synthesis of MD-48

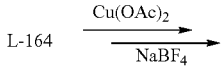

-continued

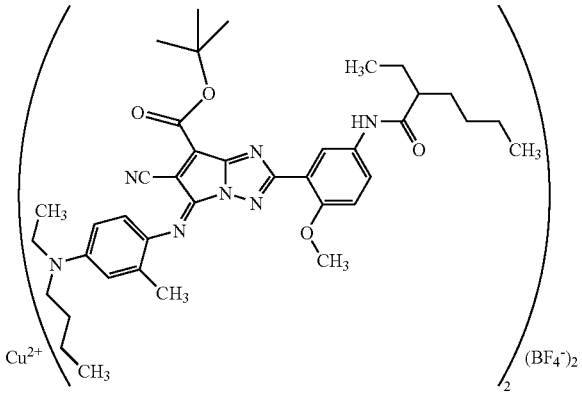

MD-48

To 5.57 g of L-164 were added 60 ml of methanol and 0.73 g of copper acetate and dissolved with heating, and further stirred at room temperature over 1 hr. Then, 0.88 g of sodium tetrafluorobarate was added thereto and dissolved with heating. After stirred over 1 hr., precipitated crystals were filtered, washed with methanol and dried to obtain 6.92 g of MD-48. The obtained product was identified in UV spectrum and elemental analysis to confirm an objective material.

Synthesis Example 8

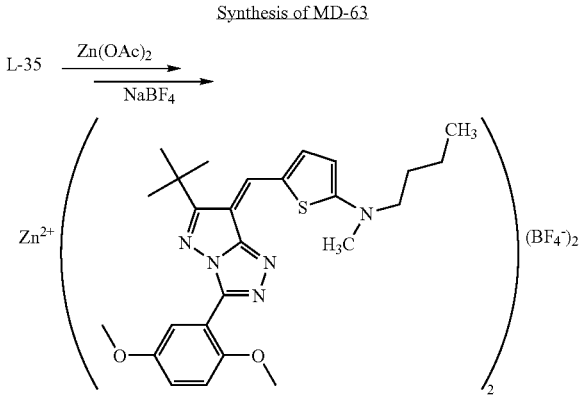

MD-63

To 3.84 g of L-35 were added 60 ml of methanol and 0.88 g of zinc acetate dihydrate and dissolved with heating, and further stirred at room temperature over 1 hr. Then, 0.44 g of sodium tetrafluoroborate was added thereto and dissolved with heating. After stirred over 1 hr., precipitated crystals were filtered, washed with methanol and dried to obtain 4.31 g of MD-63. The obtained product was identified in UV spectrum and elemental analysis to confirm an objective material.

An electrophotographic toner of the invention can be manufactured by directly dispersing a dye dispersion in a binding resin, or by mixing a dispersion of colored microparticles in a binding resin and using a desired additives, employing commonly known methods such as a kneading/pulverizing method, suspension polymerization method, emulsion polymerization method, emulsifying granulation method and encapsulation method. Of these manufacturing methods, when taking into account miniaturization of toner particle along with high image quality, emulsion polymerization is preferable in terms of manufacture cost and manufacture stability.

Thus, toner particles are manufactured in such a manner that a thermoplastic resin emulsion manufactured by emulsion polymerization is mixed with a dispersion of toner constituents such as a solid dispersion of a dye and allowed to cause gradual flocculation, while balancing repulsion of the particle surface caused by pH-adjustment and coagulation due to addition of an electrolyte to perform coalescence.

A dye dispersion can be made by directly dispersing a dye using commonly known dispersing machines such as an ink mill, a bead dispersing machine, a high-speed stirring disperser and a medium type dispersing machine, but can also be prepared in a manner similar to the case of a colored microparticle dispersion described below. Thus, a dye is dissolved (or dispersed) in an organic solvent and dispersed (or emulsified) in water, followed by removal of the organic solvent to obtain a dye dispersion.

In one of the embodiments of the electrophotographic toner, at least colored microparticles can be dispersed in a thermoplastic resin. The colored microparticles contain a dye and a resin different in composition from the thermoplastic resin. Thus, instead of allowing a dye to be directly dispersed or dissolved in a binding resin (namely, thermoplastic resin) to form a toner, the colored microparticles are dispersed in the thermoplastic resin.

Figure 2:
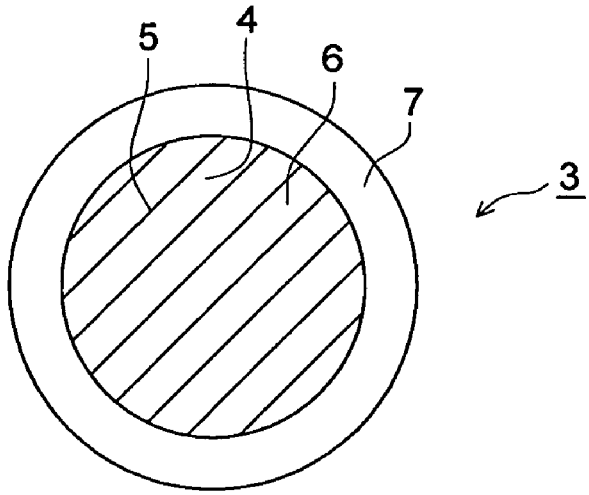
FIG. 2 illustrates the section of a colored microparticle having a core/shell structure comprising an interior (core) covered with resin (shell).

In the colored microparticles, the dye is dissolved in a resin at the molecular level, which enables to be free of any light-shielding particles in a toner, thereby resulting an enhanced transparency in a single toner color and even in overlapped colors. FIG. 1 illustrates the section of an electrophotographic toner particle (1) in which colored microparticles (3) are dispersed in a thermoplastic resin (2). The colored microparticles are each comprised of a dye (5) and a resin (4) differing in composition from the thermoplastic resin (2). In the electrophotographic toner of the invention, as shown in FIG. 2, the colored microparticle (3) may be covered with a shelling resin (or a shell, designated as 7). In that regard, a combination of a resin forming the interior (core, designated 6) of the colored microparticle (3) and a thermoplastic resin (binding resin) is not specifically limited, resulting in greater freedom of material. Further, a shelling resin which is the same with respect to each of the four colors of a toner (namely, yellow, magenta, cyan and black), enables manufacturing under similar manufacturing conditions, leading to an enhanced advantage in cost. Transfer of a dye as a colorant to the outside of the colored microparticles (bleeding-out) is prevented, causing no concern of sublimation of a dye or oil staining caused in the fixing stage which often occurs in toners using dyes.

Next, there will be described manufacture of colored microparticles, as below.

Colored microparticles relating to the invention can be obtained in the following manner, for example. A resin and a dye are dissolved (or dispersed) in an organic solvent and emulsified in water, followed by removal of the organic solvent to obtain colored microparticles. When covering the colored microparticles with a shelling resin (shell), an ethylenically unsaturated polymerizable monomer is added to the colored microparticles and emulsion polymerization is performed in the presence of an activator to allow a resin to deposit onto the core surface to obtain colored microparticles having a core/shell structure. Alternatively, an aqueous dispersion of resin microparticles is formed through emulsion polymerization. Subsequently, the aqueous dispersion is mixed with a dye dissolved in an organic solvent to allow the dye to be impregnated within the resin microparticles to obtain colored microparticles. Further, the thus obtained colored microparticles may be shelled by various methods.

The shell is preferably comprised of organic resin. Shelling is performed, for example, in such a manner that a resin dissolved in organic solvent is dropwise added to allow the resin to adsorb onto the surface of colored microparticles, concurrently with deposition. In the invention, shelling is performed preferably in such a manner that colored microparticles containing a colorant and a resin are formed as a core, and then, an ethylenically unsaturated polymerizable monomer is added thereto and emulsion polymerization is performed in the presence of an activator to achieve deposition on the core surface simultaneously with polymerization to form a shell.

In the invention, the core/shell structure refers to a form in which at least two kinds of resin exist with being phase-separated, together with a dye. Accordingly, the core may be covered completely or only partially with a shell. A part of resin forming the shell may be allowed to enter the interior of the core. Further, at least one layer differing in composition may be located between the core and the shell to form a multilayer structure.

In one preferred embodiment of the invention, colored microparticles each form a core/shell structure, comprising a core of a colored portion formed of a resin and a dye within the colored microparticles and a shell covering the core with a shelling resin.

Thermoplastic resin contained in the electrophotographic toner of the invention is preferably one which is adhesive onto colored microparticles and is also soluble in solvents. There is also usable a thermosetting resin capable of forming a three-dimensional structure, a precursor of which is solvent-soluble. Any thermoplastic resin usable as a binding resin for a toner is usable but is preferably a styrene resin, an acrylate resin such as alkyl acrylate or alkyl methacrylate resin, a styrene-acryl copolymeric resin, a polyester resin, a silicone resin, an olefin resin, an amide resin and an epoxy resin. To enhance transparency and color reproduction of an overlapped image is required a resin having enhanced transparency and exhibiting melt characteristics of a low melt viscosity and also sharp melting characteristic. Suitable resins exhibiting such characteristics include styrene resin, acryl resin and polyester resin.

A binding resin preferably exhibits a number-average molecular weight (Mn) of 3,000 to 6,000 (preferably, 3,500 to 5,500), a ratio of weight-average molecular weight (Mw) to number-average molecular weight (Mn), Mw/Mn of 2 to 6 (preferably, 2.5 to 5.5), a glass transition temperature of 50 to 70° C. (preferably, 55 to 70° C.), and a softening temperature of 90 to 110° C. (preferably, 90 to 105° C.). A number-average molecular weight of a binding resin of less than 3,000 often causes image defects such as peeling in the imaging area upon bending a solid image (deterioration in bending fixability), while that of more than 6,000 results in lowered heat-fusibility in fixing, leading to deteriorated fixability. A Mw/Mn of less than 2 often causes off-set, while that of more than 6 results in lowered sharp melt characteristics, leading to lowered light-transmittance of a toner and deteriorated color mixture property at the time of full color image formation. A glass transition temperature of less than 50° C. results in insufficient heat resistance, easily causing coagulation of toner particles during storage, while that of more than 70° C. results in difficulty in melting, leading to lowered fixability and deteriorated color-mixing property in full color image formation. a softening temperature of less than 90° C. easily causes high-temperature offset, while that of more than 110° C. results in deterioration in fixing strength, light-transmission, color-mixing property and glossiness of a full-color image.

There will be described resin forming the interior (core) of colored microparticles relating to the invention. Resins usable for the interior (core) of the colored microparticles may be any one which is different in composition from the foregoing thermoplastic resin and examples thereof include a (meth)acrylate resin, polyester resin, polyamide resin, polyimide resin, polystyrene resin, polyepoxy resin, amino resin, fluorinated resin, phenol resin, polyurethane resin, polyethylene resin, polyvinyl chloride resin polyvinyl alcohol resin, polyether resin, polyether ketone resin, polyphenylene sulfide resin, polycarbonate resin and aramid resin. Preferred of these resins is a resin obtained by polymerization of ethylenically unsaturated monomers, such as (meth(acrylate resin, polystyrene resin, polyethylene resin, polyvinyl chloride resin and polyvinyl alcohol. Specifically, (meth)acrylate resin and polystyrene resin are preferred.

A (meth)acrylate resin is synthesized by homopolymerization or copolymerization of various methacrylate type monomers or acrylate monomers and a desired (meth)acrylate resin can be obtained by varying monomer species or a monomer composition. There are also usable resins obtained by copolymerization of a (meth)acrylate monomer with an ethylenically unsaturated copolymerizable monomer except for (meth)acrylate monomers. A blend of a (meth)acrylate resin and other resins is also usable.

Examples of a monomer constituent forming a (meth)acrylate resin include (meth)acrylic acid, methyl (meth)acrylate, ethyl(meth)acrylate, propyl(meth)acrylate, butyl(meth)acrylate, isopropyl(meth)acrylate, stearyl (meth)acrylate, 2-hydroxyethyl(meth)acrylate, acetoacetoxyethyl(meth)acrylate, dimethylaminoethyl (meth)acrylate, 2-hydroxypropyl(meth) acrylate, di(ethylene glycol)ethyl ether (meth)acrylate, ethylene glycol methyl ether (meth)acrylate, isobonyl(meth) acrylate, chloroethyltrimethylammonium (meth)acrylate, trifluoroethyl (meth)acrylate, octafluoropentyl(meth)acrylate, 2-acetoamidomethyl(meth)acrylate, 2-methoxyethyl (meth)acrylate, 2-dimethylaminoethyl(meth)acrylate, 3-trimethoxysilanepropyl(meth)acrylate, benzyl(meth)acrylate, tridecyl(meth)acrylate, 4-hydroxybutyl(meth)acrylate, tetrahydrofurfuryl(meth)acrylate, dodecyl(meth)acrylate, octadecyl(meth)acrylate, 2-ethylaminoethyl(meth)acrylate, 2-ethylhexyl(meth)acrylate, cyclohexyl(meth)acrylate, phenyl(meth)acrylate, and glycidyl(meth)acrylate. Preferred of these are (meth)acrylic acid, methyl (meth)acrylate, ethyl (meth)acrylate, propyl(meth)acrylate, butyl(meth)acrylate, stearyl(meth)acrylate, 2-hydroxyethyl (meth)acrylate, acetoactoxyethyl(meth)acrylate, benzyl (meth)acrylate, tridecyl (meth)acrylate, dodecyl (meth)acrylate, and 2-ethylhexyl (meth)acrylate.

Styrene resin include, for example, a homopolymer of a styrene monomer, a random copolymer, block copolymer or graft copolymer obtained by copolymerization of a styrene monomer and an ethylenically unsaturated copolymerizable monomer. In addition to the foregoing polymers, a polymer blend or a polymer alloy is also included. Examples of a styrene monomer include styrene; a nuclear-alkylated styrene such as α-methylstyrene, α-ethylstyrene, α-methylstyrene-p-methylstyrene, o-methylstyrene, m-methylstyrene and p-methylstyrene; and a nuclear-chlorinated styrene such as o-chlorostyrene, m-chlorostyrene, p-chlorostyrene, p-bromostyrene, dichlorostyrene, dibromostyrene, trichlorostyrene, and tribromostyrene. of these is preferred α-methylstyrene.

Resin usable in the invention can be synthesized by homopolymerization or copolymerization of the foregoing monomers. Examples thereof include copolymeric resin of benzyl methacrylate/ethyl methacrylate or butyl acrylate, copolymeric resin of methyl methacrylate/2-ethylhexyl methacrylate, copolymeric resin of methyl methacrylate/methacrylic acid/stearyl methacrylate/acetoacetoxyethyl methacrylate, copolymeric resin of styrene/acetoacetoxyethyl methacrylate/stearyl methacrylate, copolymeric resin of styrene/2-hydroxyethyl methacrylate/stearyl methacrylate, and copolymeric resin of 2-ethylhexyl methacrylate/2-hydroxyethyl methacrylate.

The number-average molecular weight of a resin usable in the invention is preferably from 500 to 100,000, and more preferably 1,000 to 30,000 in terms of durability and formability of fine particles.

A shelling resin which covers the core of colored particles to form a shell is not specifically limited and examples thereof include a poly(meth)acrylate resin, polyester resin, polyamide resin, polyimide resin, polystyrene resin, polyepoxy resin, amino resin, fluorinated resin, phenol resin, polyurethane resin, polyethylene resin, polyvinyl chloride resin polyvinyl alcohol resin, polyether resin, polyether ketone resin, polyphenylene sulfide resin, polycarbonate resin and aramid resin. Of these resins, poly(meth)acrylate resin is preferred in terms of combination with a toner-binding resin.

A poly(meth)acrylate resin is synthesized by homopolymerization or copolymerization of various methacrylate type monomers or acrylate monomers and a desired (meth)acrylate resin can be obtained by varying monomer species or a monomer composition. A poly(meth)acrylate resin may be blended with other resins.

Examples of a monomer constituent forming a (meth)acrylate resin include (meth)acrylic acid, methyl (meth)acrylate, ethyl(meth)acrylate, propyl(meth)acrylate, butyl(meth)acrylate, isopropyl(meth)acrylate, stearyl (meth)acrylate, 2-hydroxyethyl(meth)acrylate, acetoacetoxyethyl(meth)acrylate, dimethylaminoethyl (meth)acrylate, 2-hydroxypropyl(meth)acrylate, di(ethylene glycol)ethyl ether(meth)acrylate, ethylene glycol methyl ether(meth)acrylate, isobonyl(meth)acrylate, chloroethyltrimethylammonium(meth)acrylate, trifluoroethyl (meth)acrylate, octafluoropentyl(meth)acrylate, 2-acetoamidomethyl(meth)acrylate, 2-methoxyethyl (meth)acrylate, 2-dimethylaminoethyl(meth)acrylate, 3-trimethoxysilanepropyl(meth)acrylate, benzyl(meth)acrylate, tridecyl(meth)acrylate, 4-hydroxybutyl(meth)acrylate, tetrahydrofurfuryl(meth)acrylate, dodecyl(meth)acrylate, octadecyl(meth)acrylate, 2-ethylaminoethyl(meth)acrylate, 2-ethylhexyl(meth)acrylate, cyclohexyl(meth)acrylate, phenyl(meth)acrylate, and glycidyl(meth)acrylate. Preferred of these are (meth)acrylic acid, methyl (meth)acrylate, ethyl (meth)acrylate, propyl(meth)acrylate, butyl(meth)acrylate, stearyl(meth)acrylate, 2-hydroxyethyl (meth)acrylate, acetoactoxyethyl(meth)acrylate, benzyl (meth)acrylate, tridecyl (meth)acrylate, dodecyl (meth)acrylate, and 2-ethylhexyl (meth)acrylate. Of these are preferred methyl(meth)acrylate, ethyl(meth)acrylate, propyl(meth)acrylate and butyl(meth) acrylate.

The shelling-resin usable in the invention may be a copolymer with a reactive emulsifying agent.

Emulsifying agents usable in the invention may be anionic or nonionic ones but compounds containing any one of the following substituents A, B and C:

A: a straight chain alkyl, branched alkyl, substituted or unsubstituted aromatic substituent group having at least 6 carbon atoms, B: a nonionic or anionic substituent group displaying surface active capability, and C: a polymerizable group capable of performing radical polymerization.

Examples of a straight chain alkyl group of "A" include heptyl, octyl, nonyl, decyl and dodecyl. Examples of a branched alkyl group include 2-ethylhexyl. Examples of an aromatic group include phenyl, nonylphenyl and naphthyl. Examples of a nonionic or anionic substituent group displaying emulsifying capability (surface active capability) of "B" include polyethylene oxide, polypropylene oxide and a copolymer of alkylene oxides. Examples of an anionic substituent group include a carboxylic acid, phosphoric acid, sulfonic acid and their salts. A polyalkylene oxide having the foregoing anionic substituent group at the endo-position is one of anionic substituent groups. The substituent group of "B" is preferably an anionic group and more preferably one forming a salt at the endo position.

The polymerizable group capable of performing radical polymerization of "C" is a group capable of causing polymerization or cross-linking reaction by a radical-active species, and examples thereof include a group having an ethylenically unsaturated bond, such as vinyl group, allyl group, 1-propenyl group, isopropenyl group, acryl group, methacryl group, maleimido group, acrylamide group, and styryl group.

A reactive emulsifying agent usable in the invention is a compound represented by the following formula (A), (B) or (C):

formula (A)

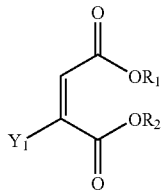

wherein $R_1$ is a straight chain alkyl, branched alkyl, or substituted or unsubstituted aromatic group having 6 to 20 carbon atoms, for example, a straight chain alkyl group such as heptyl, octyl, nonyl, decyl and dodecyl; a branched alkyl group such as 2-ethylhexyl; an aromatic group such as phenyl, nonylphenyl and naphthyl; $R_2$ is a group containing a polymerizable group capable of performing radical polymerization, as described in the foregoing "C", such as acryl, methacryl or maleimido group; Y is sulfonic acid, carboxylic acid or their salts.

Compounds of formula (A) can be readily synthesized by methods known in the art and are also commercially available, including, for example, LATEMUL S-120, LATEMUL S-120A, LATEMUL S-180 and LATEMUL S-180A, produced by Kao Corp.; Eleminol JS-2, produced by Sanyo Kasei Kogyo Co., Ltd.

Formula (B) is represented as below:

formula (B)

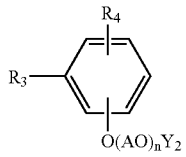

wherein $R_3$ is the same as defined in $R_1$ of formula (A), $R_4$ is the same as defined in $R_2$ of formula (A), Y is a hydrogen atom, sulfonic acid, carboxylic acid or their salts, and AO represents an alkylene oxide.

Compounds of formula (B) can be readily synthesized by methods known in the art and are also commercially available, including, for example, NE-series of ADEKA REASOAP NE-10, ADEKA REASOAP NE-20 and ADEKA REASOAP NE-30, SE-series of ADEKA REASOAP SE-10N, ADEKA REASOAP SE-20N and ADEKA REASOAP SE-30N, which as all available from ASAHI DENKA KOGYO K.K.; RN-series of AQUALON RN-10, AQUALON RN-20, AQUALON RN-30, AQUALON RN-50, HS-series of AQUALON HS-10 and AQUALON HS-20, AQUALON HS-30, and AQUALON BC-series, which are all available from DAIICHI SEIYAKU CO., LTD.

Formula (C) is represented as below:

formula (C)

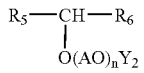

wherein $R_5$ is the same as defined in $R_1$ of formula (A), $R_6$ is the same as defined in $R_2$ of formula (A), $Y_3$ is the same as defined in $Y_1$ of formula (A) and AO is the same as defined in AO of formula (B).

Compounds of formula (C) can be readily synthesized by methods known in the art and are also commercially available, including, for example, AQUALON KH-05, AQUALON KH-10 and AQUALON KH-20, which are available from DAIICHI KOGYO SEIYAKU CO., LTD.

In the foregoing formulas (B) and (C), the average polymerization degree of an alkylene oxide chain (AO) is preferably from 1 to 10, and examples thereof include AQUALON KH-05, AQUALON KH-10, AQUALON HS-05 and AQUALON HS-10, which are available from DAIICHI KOGYO SEIYAKU CO., LTD.

In the invention, the reactive emulsifying agent is preferably an anionic one and examples thereof include ADEKA REASOAP SE-series (available from ASAHI DENKA KOGYO K.K., AQUALON HS-series, available from DAIICHI SEIYAKU CO., LTD., LATEMUL S-series, available from Kao Corp. and ELEMINOL JS-series, available from SANYO CHEMICAL INDUSTRIES, LTD.

In the invention, the foregoing reactive emulsifying agent is used usually at 0.1 to 80 parts by weight, preferably 1 to 70 parts by weight, and more preferably 10 to 60 parts by weight per 100 parts by weight of whole resin forming colored microparticles.

Conventional anionic surfactants and/or nonionic surfactants are employed for emulsification in the course of manufacturing colored microparticles relating to the invention.

Examples of conventional nonionic emulsifying agents include polyoxyethylene alkyl ethers such as polyoxyethylene lauryl ether and polyoxyethylene stearyl ether; polyoxyethylene alkylphenyl ethers such as polyoxyethylene nonylphenyl ether; sorbitan higher fatty acid esters such as sorbitan monolaurate, sorbitan monostearate, and sorbitan trioleate; polyoxyethylene sorbitan higher fatty acid esters, such as polyoxyethylene sorbitan monolaurate; polyoxyethylene higher fatty acid esters such as polyoxyethylene monolaurate and polyoxyethylene monostearate; glycerin higher fatty acid esters such as oleic acid monoglyceride and stearic acid monoglyceride; and polyoxyethylene-polyoxypropylene block copolymer.

Examples of conventional anionic emulsifying agents include higher fatty acid salts such as sodium oleate, alkylarylsulfonates such as sodium dodecylbenzenesulfonate, alkyl sulfuric acid esters such as sodium laurylsulfate, polyoxyethylene alkyl ether sulfuric acid estersalts such as polyethoxyethylene lauryl ether sulfuric acid sodium salt, polyoxyethylene alkylaryl ether sulfuric acid esters such as polyoxyethylene nonylphenyl ether sulfuric acid sodium salt, alkyl sulfosuccinic acid ester salts such as monooctyl sulfosuccinic acid sodium salt, dioctyl sulfosuccinic acid sodium salt, and polyoxyethylene laurylsulfosuccinic acid sodium salt, and derivatives of the foregoing.

There will be now described dyes contained in the colored microparticles used in the invention.

Metal chelate dyes relating to the invention may be used alone or in combination with other dyes. Generally known dyes are usable in this invention, and coloring materials are preferably oil-soluble dyes. Usually, oil-soluble dyes which do not contain any water-solubilizing group such as a carboxylic acid or sulfonic acid group, are soluble in organic solvents and not soluble in water, but a dye obtained by salt-formation of a water-soluble dye with a long chain base and thereby being soluble in oil, is also included. There are known, for example, an acid dye, a direct dye and a salt formation dye of a reactive dye with a long chain amine.

Specific examples thereof are described below but are not limited to these: Valifast Yellow 4120, Valifast Yellow 3150, Valifast Yellow 3108, Valifast Yellow 2310N, Valifast Yellow 1101, Valifast Red 3320, Valifast Red 3304, Valifast Red 1306, Valifast Blue 2610, Valifast Blue 2606, Valifast Blue 1603, Oil Yellow GG-S, Oil Yellow 3G, Oil Yellow 129, Oil Yellow 107, Oil Yellow 105, Oil Scarlet 308, Oil Red RR, Oil Red OG, Oil Red 5B, Oil Pink 312, Oil Blue BOS, Oil Blue 613, Oil Blue 2N, Oil Black BY, Oil Black BS, Oil Black 860, Oil Black 5970, Oil Black 5906, Oil Black 5905, which are all available from Orient Kagaku Kogyo Co., Ltd.; Kayaset Yellow SF-G, Kayaset Yellow K-CL, Kayaset Yellow GN, Kayaset Yellow A-G, Kayaset Yellow 2G, Kayaset Red SF-4G, Kayaset Red K-BL, Kayaset Red A-BR, Kayaset Magenta 312, Kayaset Blue K-FL, which are all available from NIPPON KAYAKU CO., LTD.; FS Yellow 1015, FS Magenta 1404, FS cyan 1522, FS Blue 1504, C.I. Solvent Yellow 88, 83, 82, 79, 56, 29, 16, 14, 04, 03, 02, and 01; C.I. Solvent Red 84:1, C.I. Solvent Red 84, 218, 132, 73, 72, 51, 43, 27, 24, 18, and 01; Solvent Blue 70, 67, 44, 40, 35, 11, 02, and 01; C.I. Solvent Black 43, 70, 34, 29, 27, 22, 7, 3, and 3; C.I. Solvent Violet 3; C.I. Solvent Green 3 and 7; Plast Yellow DY352, Plast Red 8375, which are available from Arimoto Kagaku Kogyo Co., Ltd.; MS Yellow HD-180, MS Red G, MS Magenta HM-1450H, MS Blue HM-1384, which are available from Mitsui Kagaku Kogyo; ES Red 3001, ES Red 3002, ES Red 3003, TS Red 305, ES Yellow 1001, ES Yellow 1002, Ts Yellow 118, ES Orange 2001, ES Blue 6001, TS Tuyq Blue 618, which are available from SUMITOMO CHEMICAL CO., LTD.; ACROLEX Yellow 6G, Ceres Blue GNNEOPAN Yellow O75, Ceres Blue GN, MACROLEX Red and Violet R, which as available from Bayer Co.

Disperse dyes are also usable as an oil-soluble dye, examples thereof include C.I. Disperse Yellow 5, 42, 54, 64, 79, 82, 83, 93, 99, 100, 119, 122, 124, 126, 160, 184:1, 186, 198, 199, 204, 224 and 237; C.I. Disperse Orange 13, 29, 31:1, 33, 49, 54, 55, 66, 73, 118, 119 and 163; C.I. Disperse Red 54, 60, 72, 73, 86, 88, 91, 92, 93, 111, 126, 127, 134, 135, 143, 145, 152, 153, 154, 159, 164, 167:1, 177, 181, 204, 206, 207, 221, 239, 240, 258, 277, 278, 283, 311, 323, 343, 348, 356 and 362; C.I. Disperse Violet 33; C.I. Disperse Blue 56, 60, 73, 87, 113, 128, 143, 148, 154, 158, 165, 165:1, 165:2, 176, 183, 185, 197, 198, 201, 214, 224, 225, 257, 266, 267, 287, 354, 358, 365 and 368; C.I. Disperse green 6:1 and 9.

In addition, phenol, naphthols; cyclic methylene compounds such as pyrazolone and pyrazolotriazole, and azomethine dyes and indoaniline dyes derived from couplers such as ring-opening methylene compounds are also usable as an oil-soluble dye.

The volume-average particle size of the colored microparticles relating to this invention is preferably in the range of 10 nm to 1 μm. A volume-average particle size of less than 10 nm markedly increases a surface area per unit volume and decreases inclusion of a dye into resin of the colored microparticle, deteriorating stability of colored microparticles and leading to deteriorated storage stability. A volume-average particle size exceeding 1 μm easily causes sedimentation of particles, leading to deteriorated pot-life. Further in a toner, deterioration in glossiness and transparency occurs. Accordingly, the volume-average particle size of the colored microparticles is preferably 10 nm to 1 μm, more preferably 10 to 500 nm, and still more preferably 10 to 200 nm.

The volume-average particle size can be determined by the dynamic light scattering method, laser diffraction method, centrifugal sedimentation method, FFF method or electric detector method. In this invention determination in the dynamic light scattering method using "Zeta Sizer" (produced by Marbahn CO.) is preferable.

The dye content of the colored microparticle is preferably from 10% to 70% by weight, based on the microparticle. A dye content falling within the foregoing range can obtain a sufficient image density, expresses protective capability for the dye and exhibits superior storage stability as a microparticle dispersion, thereby preventing an increase of the particle size due to aggregation.

In addition to the foregoing thermoplastic resin and colored microparticles, a charge control agent or a off-set preventing agent known in the art may be incorporated to the toner of this invention. Charge control agents usable in this invention are not specifically limited. As a negative charge control agent used for color toners are usable colorless, white or light color charge control agents. Preferred example thereof include zinc or chromium metal complex of salicylic acid derivatives, carixarene compounds, organic borane compounds, and fluorine-containing quaternary ammonium salt compounds. There are usable salicylic acid metal complexes described, for example, in JP-A Nos. 53-127726 and 62-145255; carixarene compounds described, for example, in JP-A No. 2-201378; organic borane compounds described, for example, in JP-A Nos. 2-221967 and 3-1162. Such a charge control agent is used preferably in an amount of 0.1 to 10 parts by weight per 100 parts by weight of thermoplastic resin (binding resin), and more preferably 0.5 to 5.0 parts by weight.

Off-set preventing agents usable in this invention are not specifically limited and specific examples thereof include polyethylene wax, oxidation type polyethylene wax, polypropylene wax, oxidation type polypropylene wax, carnauba wax, sazole wax, rice wax, candelilla wax, jojoba wax, and bees wax. Such a wax is used preferably in an amount of 0.5 to 5.0 parts by weight per 100 parts by weight of thermoplastic resin, and more preferably 1.0 to 3.0 parts by weight. An amount of less than 0.5 part by weight results in insufficient effects and an amount of more than 5 parts by weight results in lowered light-transmittance and color reproduction.

Using a thermoplastic resin, colored microparticles and other desired additives, the toner of this invention can be manufactured by commonly known methods such as a kneading and grinding method, suspension polymerization method, emulsion polymerization method, emulsion granulation method, or capsulation method. Of the foregoing methods, taking into account the decrease of the toner particle size along with enhancement of image quality, the emulsion polymerization method is preferable in terms of manufacturing cost and manufacturing stability.

A thermoplastic resin emulsion prepared by emulsion polymerization is mixed with a dispersion of toner particle components such as colored microparticles. While maintaining balance between repulsion force of the particle surface, formed by pH adjustment and aggregation force due to addition of an electrolyte, aggregation is gradually performed. Association is performed with controlling the particle size and the particle size distribution, while stirring with heating. Thereby, fusion of microparticles and particle shape control are conducted to manufacture the toner particles. The volume-average particle size of the toner relating to this invention is preferably 4-10 μm in terms of high precise image reproduction, and more preferably 6 to 9 μm.

In this invention, the thus prepared toner particles may be used as it is, but preferably, Post-treatment agents may be incorporated to the toner particles to control electrostatic charge or enhance fluidity or cleaning ability. Examples of such post-treatment agents include inorganic oxide particles such as particulate silica, particulate alumina, and particulate titania, inorganic stearate compound particles such particulate aluminum stearate or particulate zinc stearate, and inorganic titanate compound particles such as strontium titanate or zinc titanate. These additives may be used singly or in combination. These particles are desirably used together with a surface treatment of a silane coupling agent, titan coupling agent, higher fatty acid or silicone oil in terms of environmental resistance stability and heat resistance maintenance. The post-treatment agent is incorporated preferably in an amount of 0.05 to 5 parts by weight per 100 parts by weight of toner particles, and more preferably from 0.1 to 3 parts by weight.

The electrophotographic toner of the invention may be mixed with a carrier and used as a toner used for a two-component developer, or may be used as a toner used for a single-component developer.

Conventional carriers used for a two-component developer can be used in combination with the electrophotographic toner of this invention. There can be used, for example, a carrier composed of magnetic material particles such as iron or ferrite, a resin-coated carrier formed by covering magnetic material particles with resin and a binder type carrier obtained by dispersing powdery magnetic material in a binder. Of these carriers, the use of a resin-coated carrier using silicone resin, copolymer resin (graft resin) of an organopolysiloxane and a vinyl monomer or polyester resin is preferred from the viewpoint of toner spent and the like. Specifically, a carrier coated with a resin which is obtained by reacting isocyanate with a copolymer resin of an organopolysiloxane and a vinyl monomer, is preferred in terms of fastness, ecological concerns and resistance to spent toner. A monomer containing a substituent such as a hydroxyl group having reactivity with an isocyanate needs to be used as the above-described vinyl monomer. The volume-average particle size of a carrier is preferably 20 to 100 μm (more preferably 20 to 60 μm) to maintain high image quality and prevent a carrier from fogging.

Next, there will be described an image formation method using the electrophotographic toner of the invention.

In the invention, the system of image formation is not specifically limited. Examples thereof include a system in which plural images are formed on a photoreceptor and transferred all together, a system in which an image formed on a photoreceptor is successively transferred using a transfer belt and is not specifically limited to such, of which the system in which plural images are formed on a photoreceptor and transferred all together is preferred.

In this system, the photoreceptor is uniformly charged and exposed according to the first image and the first development is performed to form the first toner image on the photoreceptor. Subsequently, the photoreceptor having formed the first toner image is uniformly charged, exposed according to the second image and the second development is performed to the second toner image. Further, the photoreceptor having formed the first and second toner images is uniformly charged, exposed according to the third image and the third development is performed to form the third toner image on the photoreceptor. Furthermore, the photoreceptor having formed the first, second and third toner images is uniformly charged, exposed according to the fourth image and the fourth development is performed to form the fourth toner image on the photoreceptor. In the foregoing, the first development is performed with a yellow toner, the second development is performed with a magenta toner, the third development is performed with a cyan toner and the fourth development is performed with a black toner to form a full color image. Thereafter, images formed on the photoreceptor are transferred all together to a transfer material such as paper and fixed on the transfer material to form images. In this system, images formed on the photoreceptor are transferred all together to paper or the like to form the final image, so that differing from a so-called intermediate system, the transfer, which often perturbs the previous images, is done only one time, resulting in enhanced image quality.

Since a plural number of development processes need to be performed to develop latent images formed on the photoreceptor, a non-contact development system is preferred. A system in which an alternant electric field is applied during development, is also preferable.

In the system in which overlaid color images are formed on a photoreceptor and transferred all together, a non-contact development system is preferred.

The volume-average particle size of a carrier usable as two-component developer is preferably 15 to 100 μm to maintain high image quality and prevent a carrier from fogging. The volume-average particle size of the carrier can be determined using a laser diffraction type particle size distribution measurement apparatus, HELOS (produced by SYMPATEC Corp.).

The carrier usable in the invention is preferably a resin-covered carrier or a so-coated resin dispersion type carrier in which magnetic particles are dispersed in resin. Resin used for coating is not specifically limited with respect to composition but, for example, olefin resin, styrene resin, styrene/acryl resin. silicone resin, polyester resin and fluorinated resin are usable. Resin constituting the resin dispersion type carrier includes, for example, styrene/acryl resin, polyester resin, fluorinated resin and phenol resin.

Suitable fixing systems usable in this invention include a so-called contact heating system. Representative examples of the contact heating system include a heat roll fixing system and a pressure heat-fixing system in which fixing is performed using a rolling pressure member including a fixed heating body.

In the image formation process to perform development, transfer and fixing by using a toner of this invention, the toner transferred onto a transfer material, e.g., paper, adheres onto the paper surface without colored microparticles being disintegrated, even after fixing.

In conventional toners obtained by directly dispersing or dissolving a dye in a thermoplastic resin (binding resin), the dye bleeds out onto the toner particle surface, producing the following problems: 1) low charging, 2) marked difference in charging between high temperature and high humidity, and low temperature and low humidity, 3) the charging amount varying depending on the kind of dye as a colorant, for example, when using pigments of cyan, magenta, yellow and black in full color recording. However, in this invention, colored microparticles are dispersed within the toner particle so that in spite of the toner particle having the dye at a relatively high content, the dye does not bleed out on the particle surface, overcoming the foregoing problems. Further, when thermally fixed onto a transfer material, transport of a dye as colorant to the outside of the colored microparticles (bleeding-out onto the surface of the colored microparticle) does not result and does not produce problems sublimation of a dye or oil staining during thermal fixing, as tends to be caused with conventional toners.

Examples

The present invention will be further described based on examples, but are by no means limited to these.

Colored Microparticle

Preparation of Colored Microparticle Dispersion 1

To a separable flask were added 13.5 g of resin (P-1), 16.3 g of dye (A-1) and 123.5 of acetic acid and after the atmosphere in interior was replaced with nitrogen gas, the dye was completely dissolved with stirring. Further thereto, 238 g of an aqueous solution 8.0 g of AQUALON KH-50 (produced by DAIICHI SEIYAKU CO., LTD.) was dropwise added with stirring and then emulsified for 300 sec. using CLEAR-MIX W-MOTION CLM-0.8W (produced by M-TECHNIQUE Co.). Thereafter, acetic acid was removed under reduced pressure to obtain a colored microparticle dispersion 1 containing a dye. In the thus obtained dispersion, the average particle size of colored particles was 42 nm. Hereinafter, the average particle size refers to the volume-average particle size, which was determined using ZETASIZER (Marbahn Co.).

P-1: St/HEMA/SMA=30/40/30

St: styrene

HEMA: 2-hydroxyethyl methacrylate

SMA: stearyl methacrylate

KH-05: AQUALON KH-05 (DAIICHI KOGYO SEIYAKU CO., LTD.)

A-1

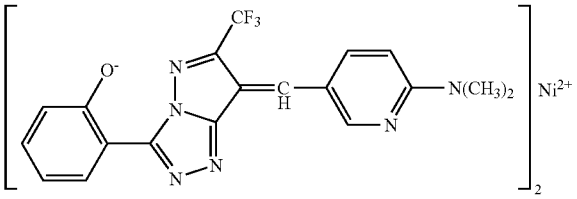

Preparation of Colored Microparticle Dispersion 2

Colored microparticle dispersion 2 was prepared as follows. To the colored microparticle dispersion 1, 0.5 g of potassium persulfate was added and heated at 70° C. using a heater and 10.0 g of methyl methacrylate (MMA) was dropwise added and allowed to react for 5 hr to obtain core/shell type colored microparticle dispersion 2. In the thus obtained dispersion, the average particle size of colored microparticles was 46 nm.

Preparation of Colored Microparticle Dispersion 3

Colored microparticle dispersion 3 was prepared similarly to the colored microparticle dispersion 1, except that dye (A-1) was replaced by MD-9. In the thus obtained dispersion, the average particle size of colored microparticles is shown in Table 2.

Preparation of Colored Microparticle Dispersion 4

Core/shell type colored microparticle dispersion 4 was prepared similarly to the foregoing colored microparticle dispersion 2, except that dye (A-1) was replaced by MD-9. In the thus obtained dispersion, the average particle size of colored microparticles is shown in Table 2.

Preparation of Colored Microparticle Dispersion 5

Core/shell type colored microparticle dispersion 5 was prepared similarly to the foregoing colored microparticle dispersion 4, except the amount of KH-05 (AQUALON KH-05) was varied to 1.0 g. In the thus obtained dispersion, the average particle size of colored microparticles is shown in Table 2.

Preparation of Colored Microparticle Dispersions 6-31

Core/shell type colored microparticle dispersions 6 through 31 were prepared similarly to the colored microparticle dispersion 2, except polymer (P-1) and dye (A-1) were varied as shown in Table 2. In the obtained dispersions, the average particle size of colored microparticles is shown in Table 2.

TABLE 2

| Dispersion No. | Resin (core) | Resin (shell) | Dye | Average Particle Size | Remark |
|---|---|---|---|---|---|
| 1 | P-1 | — | A-1 | 42 nm | Comp. |
| 2 | P-1 | MMA | A-1 | 46 nm | Comp. |
| 3 | P-1 | — | MD-9 | 30 nm | Inv. |
| 4 | P-1 | MMA | MD-9 | 34 nm | Inv. |
| 5 | P-1 | MMA | MD-9 | 220 nm | Inv. |
| 6 | P-1 | MMA | MD-10 | 36 nm | Inv. |
| 7 | P-1 | AN | MD-10 | 97 nm | Inv. |
| 8 | P-1 | MMA | MD-5 | 38 nm | Inv. |
| 9 | P-1 | MMA | MD-17 | 40 nm | Inv. |
| 10 | P-1 | MMA | MD-21 | 45 nm | Inv. |
| 11 | P-1 | MMA | MD-24 | 47 nm | Inv. |
| 12 | P-1 | MMA | MD-27 | 46 nm | Inv. |

TABLE 2-continued

| Dispersion No. | Resin (core) | Resin (shell) | Dye | Average Particle Size | Remark |
|---|---|---|---|---|---|
| 13 | P-1 | MMA | MD-30 | 45 nm | Inv. |
| 14 | P-1 | MMA | MD-34 | 40 nm | Inv. |
| 15 | P-1 | MMA | MD-38 | 52 nm | Inv. |
| 16 | P-1 | MMA | MD-41 | 50 nm | Inv. |
| 17 | P-1 | MMA | MD-44 | 40 nm | Inv. |
| 18 | P-1 | MMA | MD-49 | 43 nm | Inv. |
| 19 | P-1 | MMA | MD-54 | 48 nm | Inv. |
| 20 | P-1 | MMA | MD-63 | 53 nm | Inv. |
| 21 | P-1 | MMA | MD-67 | 53 nm | Inv. |
| 22 | P-1 | MMA | MD-70 | 60 nm | Inv. |
| 23 | P-1 | MMA | MD-80 | 62 nm | Inv. |
| 24 | P-2 | MMA | MD-10 | 38 nm | Inv. |
| 25 | P-2 | MMA | MD-18 | 40 nm | Inv. |
| 26 | P-2 | MMA | MD-29 | 41 nm | Inv. |
| 27 | P-2 | MMA | MD-40 | 50 nm | Inv. |
| 28 | P-2 | MMA | MD-50 | 38 nm | Inv. |
| 29 | P-2 | MMA | MD-57 | 48 nm | Inv. |
| 30 | P-2 | MMA | MD-75 | 64 nm | Inv. |
| 31 | P-2 | MMA | MD-88 | 63 nm | Inv. |

P-1: St/HEMA/SMA = 30/40/30
P-2: St/HEMA/SMA = 20/40/40
MMA: methyl methacrylate
AN: acrylonitrile

Toner

Preparation of Thermoplastic Resin (Latex)

Into 5,000 ml separable flask fitted with a stirring device, a temperature sensor, a condenser and a nitrogen-introducing was charged an aqueous surfactant solution (aqueous medium) of 7.08 g of an anionic surfactant (sodium dodecylbenzenesulfonate) which was previously dissolved in 2760 g of deionized water and the internal temperature was raised to 80° C. with stirring at a stirring rate of 230 rpm under a stream of nitrogen.

Separately, 72.0 g of a compound of the following Formula (1) as releasing agent was added to a monomer mixture of 115.2 g of styrene, 42.0 g of n-butyl acrylate and 10.9 g of methacrylic acid and dissolved with heating at 80° C. to prepare a monomer solution. Using a mechanical disperser having a circulation path, the monomer solution (80° C.) was mixed with the foregoing aqueous surfactant solution (80° C.) and stirred to prepare a dispersion of emulsion particles (oil droplets) having a uniform dispersion particle size. Subsequently, to this dispersion, a polymerization initiator solution of 0.84 g of a polymerization initiator (potassium persulfate, KPS) dissolved in 200 g of deionized water was added and heated at 80° C. for 3 hr. with stirring to perform polymerization (first polymerization) to form a latex. Then, to this latex, a polymerization solution of 7.73 g of a polymerization initiator (KPS) dissolved in 240 g of deionized water was added. After 15 min, a monomer mixture of 383.6 g of styrene, 140.0 g of n-butyl acrylate, 36.4 g of methacrylic acid and 13.7 g of tert-dodecylmercaptan was added dropwise at 80° C. over a period of 126 min. After completing addition, stirring continued for 60 min. with heating to perform polymerization (second polymerization). Then the reaction mixture was cooled to 40° C. to obtain a latex. The thus obtained latex was designated as latex (1).

Formula (1)

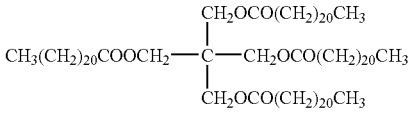

Toner Preparation 1

Into 5 liter separable flask fitted with a stirring device, a temperature sensor, a condenser and a nitrogen-introducing was charged 1250 g of the latex (1), 2,000 ml of deionized water and the foregoing colored microparticle dispersion 1. After adjusting t interior temperature to 30° C., the reaction mixture was adjusted to a pH 10.0 by adding a 5M aqueous sodium hydroxide solution. Then, an aqueous solution of 52.6 g of magnesium chloride hexahydride which was previously dissolved in 72 ml of deionized water, was added at 30° C. in 10 min. After allowed to stand for 3 min., heating was started and the reaction system was heated to 90° C. in 6 min. (at a temperature-increasing rate of 10° C./min). From that state, measurement of the aggregated particle size was started using Coulter Counter TA-II (produced by Coulter Corp.). When the volume-average particle size reached 6.5 μm, an aqueous solution of sodium chloride of 115 g dissolved in 700 mol of deionized water to stop grain growth and the reaction mixture was further stirred for 6 hr. with maintaining the temperature at 90±2° C. to continue fusion. Thereafter, the reaction mixture was cooled to 30° C. at a rate of 6° C./min. The aggregated particles were filtered off from dispersion of the aggregated particles and dispersed in deionized water in an amount of 10 times the weight of aggregated particles to perform washing. After repeating the procedure of washing and filtration twice, washing was done with deionized water and drying was done by hot air at 40° C. to obtain toner particles. The thus obtained toner particles were designated "colored particle 1".

Toner Preparation 2 to 31

Colored particles were prepared similarly to the foregoing toner preparation 1, except that the colored microparticle dispersion 1 was replaced by each of colored microparticle dispersions 2-31. The thus obtained colored particles were designated "colored particles 2 to 31".

Toner Preparation 32

Using a surfactant, a low molecular weight polypropylene (number-average molecular weight of 3200) was dispersed in water at a solid content of 30% by weight to prepare an emulsion of low molecular weight polypropylene. To 60 g of the thus prepared low molecular weight polypropylene emulsion was added 338 g of the colored microparticle dispersion 3. Further thereto, 220 g of styrene monomer, 40 g of n-butyl acrylate monomer, 12 g of methacrylic acid monomer, 5.4 g of t-dodecylmercaptan as a chain-transfer and 2,000 ml of degassed water were added, and maintained at 70° C. for 3 hr. with stirring under a stream of nitrogen to perform emulsion polymerization.

The thus obtained particular resin dispersion was adjusted to a pH of 7.0 with sodium hydroxide. Then, 700 ml of an aqueous 2.7 mol % potassium chloride solution was added thereto 420 ml of isopropyl alcohol and 23.4 g of polyoxyethylene octylphenyl ether (ethylene oxide average polymerization degree of 10), which was previously dissolved in 175 ml of pure water and maintained for 6 hr. at 75° C. with stirring to perform reaction. Thereafter, the reaction mixture was cooled to 30° C. at a rate of 6° C./min. The aggregated particles were filtered off from dispersion of the aggregated particles and dispersed in deionized water in an amount of 10 times the weight of aggregated particles to perform washing. After repeating the procedure of washing and filtration twice, washing was done with deionized water and drying was done by hot air at 40° C. to obtain toner particles. The thus obtained colored particles were designated "colored particle 32".

Toner Preparation 33

To an aqueous solution of sodium dodecylsulfate dissolved in 200 ml of pure water, 20 g of dye (MD-9) was added, stirred and dispersed by ultrasonic to prepare a colored particle dispersion. Using a surfactant, a low molecular weight polypropylene (number-average molecular weight of 3200) was dispersed in water at a solid content of 30% by weight to prepare an emulsion of low molecular weight polypropylene. To 60 g of the thus prepared low molecular weight polypropylene emulsion was added 338 g of the dispersion of colored microparticle 1. Further thereto, 220 g of styrene monomer, 40 g of n-butyl acrylate monomer, 12 g of methacrylic acid monomer, 5.4 g of t-dodecylmercaptan as a chain-transfer and 2,000 ml of degassed water were added, and maintained at 70° C. for 3 hr. with stirring under a stream of nitrogen to perform emulsion polymerization.

The thus obtained particular resin dispersion was adjusted to a pH of 7.0 with sodium hydroxide. Then, 675 ml of an aqueous 2.7 mol % potassium chloride solution was added thereto 400 ml of isopropyl alcohol and 22.5 g of polyoxyethylene octylphenyl ether (ethylene oxide average polymerization degree of 10), which was previously dissolved in 168 ml of pure water and maintained for 6 hr. at 75° C. with stirring to perform reaction. Thereafter, the reaction mixture was cooled to 30° C. at a rate of 6° C./min. The particles were filtered off from dispersion of colored particles and dispersed in deionized water (pH=3) in an amount of 10 times the weight of particles to perform washing. After repeating the procedure of washing and filtration twice, washing was done with deionized water and drying was done by hot air at 40° C. to obtain colored particles. The thus obtained colored particles were designated "colored particle 33".

Toner Preparation 34

Similarly to toner preparation 33, colored particles were prepared, except that dye (A-1) was replaced by (MD-15). The thus obtained colored particle was designated "colored particles 34".

Toner Preparation 35

To separable flask were added 16.0 g of dye (MD-15) and 200.0 g of ethyl acetate and after the interior of the flask was replaced by nitrogen gas, the dye was dissolved with stirring. Subsequently, 340.0 g of an aqueous solution containing 19.6 g of a 27% surfactant (EM-27, Kao Corp.) solution was dropwise added and emulsified for 300 sec using a ultrasonic homogenizer, UH-600 (Product by S.M.T. Corp.). Thereafter, ethyl acetate was removed under reduced pressure to obtain a solid particle dispersion of the dye. In the obtained dispersion, the average particle size of colored particles was 36 nm.

Colored particles were prepared similarly to the foregoing toner preparation 33, except that the colored microparticle dispersion was varied as above. The thus obtained colored particles were designated "colored particles 35".

Toner Preparation 36

Colored particles were prepared similarly to the foregoing toner preparation 33, except that dye (A-1) was replaced by C.I. Pigment Red 48:3 (product by Clariant Japan Corp.). The thus obtained colored particles were designated "colored particles 36".

Toner Preparation 37

Colored particles were prepared similarly to the foregoing toner preparation 33, except that dye (A-1) was replaced by C.I. Pigment Blue 15:3 (product by Dainippon Ink Co., Ltd.). The thus obtained colored particles were designated "colored particles 37".

Developer

To each of the foregoing colored particles 1 to 37, hydrophobic silica (having a number-average primary particle size of 12 nm and a hydrophobicity degree of 68) and hydrophobic titanium (having a number-average primary particle size of 20 nm and a hydrophobicity degree of 63) were added at 1% by weight and 1.2% by weight, respectively and mixed using a Henschel mixer to obtain toners. Corresponding to colored particles, the thus obtained toners were designated toner 1 to toner 37.

A silicone resin-covered ferrite carrier having a volume-average particle size of 60 μm was mixed with each of the foregoing toners 1 to 37 at a toner content of 6% by weight to obtain "developer 1" to "developer 37".

Development and Evaluation

Using digital copier Konica 7075 (produced by Konica Minolta Business Technology, Inc.) in which a fixing device was modified as below, practical picture tests were done on paper and an OHP sheet under an environment of ordinary temperature and ordinary humidity (25° C., 55% RH) with respect to the obtained developers 1 to 37. Evaluation was made with respect to (1) color reproduction, (2) transparency, (3) charging property, (4) off-set resistance (5) heat resistance and (6) lightfastness.

Development Condition:

| | |
|---|---|
| Photoreceptor surface potential: | −700 V |
| DC bias: | −500 V |
| Dsd (distance between photoreceptor and development sleeve): | 600 μm |
| Developer layer control: | magnet type (H-Cut system) |
| Developer layer thickness: | 700 μm |
| Development sleeve: | 40 mm. |

A heat-roll fixing system was used as a fixing device. Thus, a heating roller was formed by covering the core surface of an aluminum alloy cylinder (having an inside diameter of 40 mm, a thickness of 1.0 mm and a total width of 310 mm) including a heater in the central portion, using a 120 μm thick tube of copolymer of tetrafluoroethylene and perfluoroalkyl vinyl ether (PFA). A pressure roller was formed by covering the core surface of an iron cylinder (having an inside diameter of 40 mm and a thickness of 2.0 mm), using a sponge-form silicone rubber (having an ASKER C hardness of 48 and a thickness of 2 mm). The heating roller was brought into contact with the pressure roller to form a 5.5 mm wide nip. Using this fixing apparatus, the print speed was set to 480 mm/sec. A supply system in which a web system was impregnated with polydiphenylsilicone (exhibiting a viscosity of 10 Pa·s at 20° C.) was employed as a cleaning mechanism of the fixing device. The fixing temperature was controlled based on the surface temperature of the heating roller (setting temperature: 175° C.). The coating amount of silicone oil was 0.1 mg/A4.

(1) Color Reproduction

Color reproduction of monochrome images on copy paper was visually evaluated by ten persons based on the following criteria. Evaluation was conducted in a toner deposit amount of 0.7±0.05 mg/cm$^2$. Evaluation results are shown in Table 3.

A: excellent color reproduction,

B: superior color reproduction,

C: slight color staining but acceptable in practice,

D: marked color staining and unacceptable in practice.

(2) Transparency

A transparent image formed on an OHP sheet was prepared and the fixed image was measured with respect to visible spectral absorbance by Type 330 Spectrophotometer (produced by HITACHI) using an OHP sheet having no toner as a reference. There were determined the difference in absorbance between 650 nm and 450 nm of a yellow toner, the difference in absorbance between 650 nm and 550 nm of a magenta toner, and the difference in absorbance between 500 nm and 600 nm of a cyan toner. Transparency of the individual OHP image was evaluated based on the following criteria, in which a value of at least 70% was judged to be good transparency. Evaluation was conducted in a toner deposit amount of 0.7±0.05 mg/cm$^2$. Evaluation results are shown in Table 3.

A: 909 or more, being superior,

B: 70%-909, being good

C: less than 70%.

(3) Aging Change of Charging Property

Evaluation of charging property was conducted by varying the electrostatic charge of every print. Thus, based on the following criteria, the value of Qb/Qa was evaluated, where Qa is the electrostatic charge after setting a developer and making the first print and Qb is the electrostatic charge after completion of printing of 1,000,000 sheets. Evaluation results are shown in Table 3.

A: not less than 0.9 and less than 1.1, being superior,

B: not less than 0.8 and less than 0.9, or not less than 1.1 and less than 1.2, being good, C: not less than 0.7 and less than 0.8, or not less than 1.2 and less than 1.3, being acceptable in practice, D: less than 0.7 or more than 1.3, being unacceptable in practice.

(4) Off-Set Resistance 10,000 A4 sheets of fine-quality paper having a solid strip image of a 5 mm width vertical to the transport direction were transported vertically and fixed. Then, 10,000 A4 sheets of fine-quality paper having a half-tone image of a 20 mm width vertical to the transport direction were transported in horizontally form and fixed, and running a machine was stopped. After the machine was stopped overnight, the machine was restarted and the presence or absence of image staining due to an after-fixing off-set phenomenon, occurring on the first sheet was visually evaluated based on the criteria, as below. Evaluation results are shown in Table 3.

A: no occurrence of staining on images,

B: occurrence of slight staining on images but being acceptable in practice,

C: occurrence of marked staining and being unacceptable in practice.

(5) Heat Resistance

A fixing roller and recovered silicone oil were visually observed and coloring was visually evaluated based on the following criteria:

A: no coloring was observed on the fixing roller and silicone oil,

B: coloring was observed in fixing roller and silicone oil.

(6) Lightfastness

Lightfastness was evaluated in the manner that immediately after recording, the image density (Ci) was measured and after exposed to Xenon light (85,000 lux) for 10 days (at 25° C.) in a weather-meter, image density (Cf) was again measured and the residual dye ratio was determined from the difference in image density between before and after exposure to xenon light, according to the equation:

$$\{(Ci-Cf)/Ci\}\times 100(\%)$$

and evaluated based on the criteria, as below. The image density was measured using reflection densitometer (X-Rite 310TR). Evaluation results are shown in Table 3.

A: residual ratio of 98% or more,

B: residual ratio of 95% to 98%,

C: residual ratio of 90% to 95%,

D: residual ratio of 80% to 90%,

E: residual ratio of less than 80%.

(7) Weather Resistance

Weather resistance was evaluated in the manner that immediately after recording, the image density (Ci) was measured and after exposed to Xenon light (85,000 lux) for 14 days at 50° C. and 80% RH in a weather-meter, image density (Cf) was again measured and the residual dye ratio was determined from the difference in image density between before and after exposure to xenon light, according to the equation:

$$\{(Ci-Cf)/Ci\}\times 100(\%).$$

Aged samples were visually observed with respect to change of image color. Evaluation was made based on the following criteria:

A: residual ratio of 95% or more,

B: residual ratio of 90% 95%,

C: residual ratio of 80% to 90%,

D: residual ratio of less than 80% and images were visually observed to be slightly cloudy, E: residual ratio of less than 80% and images were visually observed to be much cloudy.

TABLE 3

| Developer No. | Color Reproduction | Transparency | *1 | Offset Resistance | Heat Resistance | *2 | Weather Resistance | Remark |
|---|---|---|---|---|---|---|---|---|
| 1 | B | A | B | B | A | C | D | Comp. |
| 2 | A | A | B | A | A | B | C | Comp. |
| 3 | A | A | B | B | A | B | A | Inv. |
| 4 | A | A | A | A | A | A | A | Inv. |
| 5 | B | B | A | A | A | A | A | Inv. |
| 6 | A | A | A | A | A | A | A | Inv. |
| 7 | A | A | A | A | A | A | A | Inv. |
| 8 | A | A | A | A | A | B | A | Inv. |
| 9 | A | A | A | A | A | B | A | Inv. |
| 10 | A | A | A | A | A | A | B | Inv. |
| 11 | A | A | A | A | A | B | B | Inv. |
| 12 | A | A | A | A | A | B | A | Inv. |
| 13 | A | A | A | A | A | B | A | Inv. |
| 14 | A | A | A | A | A | B | A | Inv. |
| 15 | A | A | A | A | A | A | B | Inv. |

TABLE 3-continued

| Developer No. | Color Reproduction | Transparency | *1 | Offset Resistance | Heat Resistance | *2 | Weather Resistance | Remark |
|---|---|---|---|---|---|---|---|---|
| 16 | A | A | B | A | A | B | A | Inv. |
| 17 | A | A | A | A | A | B | A | Inv. |
| 18 | A | A | A | A | A | A | A | Inv. |
| 19 | A | A | A | A | A | B | A | Inv. |
| 20 | A | A | A | A | A | B | B | Inv. |
| 21 | B | A | A | A | A | B | A | Inv. |
| 22 | A | A | B | A | A | B | B | Inv. |
| 23 | A | A | B | A | A | B | B | Inv. |
| 24 | A | A | A | A | A | A | A | Inv. |
| 25 | A | A | A | A | A | B | A | Inv. |
| 26 | A | A | A | A | A | B | A | Inv. |
| 27 | B | A | A | A | A | B | B | Inv. |
| 28 | A | A | A | A | A | B | A | Inv. |
| 29 | A | A | B | A | A | B | A | Inv. |
| 30 | B | A | B | A | A | C | B | Inv. |
| 31 | A | A | B | A | A | C | B | Inv. |
| 32 | A | A | B | A | A | B | A | Inv. |
| 33 | C | A | B | C | B | C | E | Comp. |
| 34 | B | A | B | A | A | B | A | Comp. |
| 35 | A | A | B | A | A | A | A | Comp. |
| 36 | D | C | B | B | A | B | A | Comp. |
| 37 | D | C | B | B | A | A | A | Comp. |

*1: Charging Property,
*2: Lightfastness

As apparent from Table 3, it was proved that developer Nos. 3 to 32, 34 and 35 relating to the invention exhibited superior color reproduction, transparency and improved charging property and offset resistance, and forming images with enhanced image quality. In a fixing roller and recovered silicone oil, no coloring due to dye was observed and superior heat resistance was also proved. It was further shown that lightfastness was equivalent or superior to nickel chelate dyes and metal chelate dyes relating to the invention have no problem in safety.

What is claimed is:

1. An electrophotographic toner comprising a thermoplastic resin and at least one metal chelate dye represented by the following formula (1):

$$M(L_1)(L_2)_n(X_1)_m(X_2)_l.W_1, \qquad \text{formula (1)}$$

wherein M is a divalent metal ion selected from the group of Cu and Zn; $X_1$ and $X_2$ are each a monodentate or didentate ligand, provided that $X_1$ and $X_2$ may combine with each other; $L_1$ and $L_2$; n, m and 1 are each 0 or 1; $W_1$ is a counter ion when a counter ion is required for neutralization of charge, and wherein in formula (1), at least one of $L_1$ and $L_2$ is represented by the following formula (2):

Formula (2)

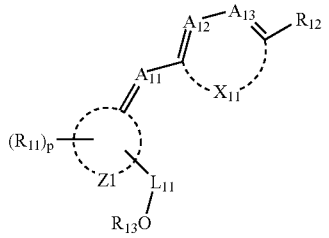

wherein $R_{11}$ is a hydrogen atom or a substituent; $R_{13}$ is a substituent; $R_{12}$ is —$NR_{14}R_{15}$ or —$OR_{16}$; $A_{11}$, $A_{12}$ and $A_{13}$ are each independently —$CR_{17}$— or —N—; $X_{11}$ is an atomic group necessary to form a 5- or 6-membered aromatic or heterocyclic ring; Z1 is an atomic group necessary to form a 5- or 6-membered nitrogen-containing heterocyclic ring, which may be substituted by one or more substituents and the substituents may combine with each other to form a condensed ring; $R_{14}$ to $R_{17}$ are each independently a hydrogen atom or a substituent; $L_{11}$ is a linkage group having one or two carbon atoms or a part of a ring structure, provided that $L_{11}$ may combine with $R_{13}$ to form a 5- or 6-membered ring; p is an integer of 0 to 3; and wherein in formula (2), the heterocyclic ring formed of Z1 is represented by the following formula (3), (4), (5), (6), (7), or (8):

Formula (3)

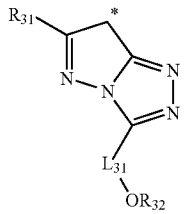

Formula (4)

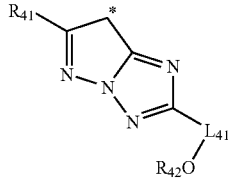

wherein $R_{31}$ and $R_{41}$ are each a hydrogen atom or a substituent; $R_{32}$ is a substituent selected from a group consisting of an alkyl group, a cycloalkyl group, an alkenyl group, an alkynyl group, an aryl group, a heteroaryl group, a heterocyclic group, an alkoxy group, a cycloalkoxy group, an aryloxy group, an alkylthio group, a cycloakylthio group, an arylthio group, an alkoxycarbonyl group, an aryloxycarbonyl group, a sulfamoyl group, an acyl group, an acyloxy group, an amido group, a carbamoyl group, a ureido group, a sulfinyl group, an alkylsulfonyl group, and arylsulfonyl group, a amino group, a cyano group, a nitro group and a halogen group, and $R_{42}$ is a substituent; $L_{31}$ and $L_{41}$ are each a linkage group having one or two carbon atoms or a part of a ring structure and binds to $A_{11}$ of formula (2) at the position designated "*";

Formula (5)

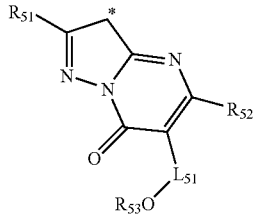

Formula (6)

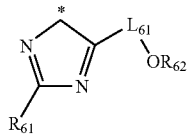

wherein $R_{51}$, $R_{52}$ and $R_{61}$ are each a hydrogen atom or a substituent; $R_{53}$ and $R_{62}$ are each a substituent: $L_{51}$ and $L_{61}$ are each a linkage group having one or two carbon atoms or a part of a ring structure and binds to $A_{11}$ of formula (2) at the position designated "*"; and Formula (7)

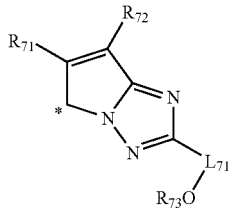

Formula (8)

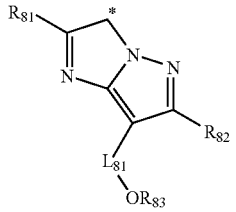

wherein $R_{71}$, $R_{72}$, $R_{81}$ and $R_{82}$ are each a hydrogen atom or a substituent; $R_{73}$ and $R_{83}$ are each a substituent: $L_{71}$ and $L_{81}$ are each a linkage group having one or two carbon atoms or a part of a ring structure and binds to $A_{11}$ of formula (2) at the position designated "*".

2. The toner of claim 1, wherein the toner comprises the thermoplastic resin and colored microparticles dispersed in the thermoplastic resin, and the colored microparticles comprising the dye of formula (1).

3. The toner of claim 1, wherein in formula (2), the hetero cyclic ring formed of Z1 is represented by the following formula (3) or (4):

Formula (3)

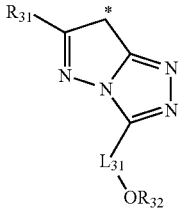

Formula (4)

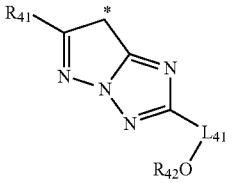

wherein $R_{31}$ and $R_{41}$ are each a hydrogen atom or a substituent; $R_{32}$ and $R_{42}$ are each a substituent; $L_{31}$ and $L_{41}$ are each a linkage group having one or two carbon atoms or a part of a ring structure and binds to $A_{11}$ of formula (2) at the position designated "*".

4. The toner of claim 1, wherein in the formula (2), the heterocyclic ring formed of Z1 is represented by the following formula (5) or (6):

Formula (5)

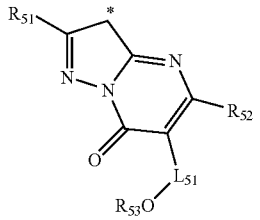

Formula (6)

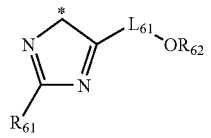

wherein $R_{51}$, $R_{52}$ and $R_{61}$ are each a hydrogen atom or a substituent; $R_{53}$ and $R_{62}$ are each a substituent: $L_{51}$ and $L_{61}$ are each a linkage group having one or two carbon atoms or a part of a ring structure and binds to $A_{11}$ of formula (2) at the position designated "*".

5. The toner of claim 1, wherein in the formula (2), the heterocylic ring formed of Z1 is represented by the following formula (7) or (8):

Formula (7)

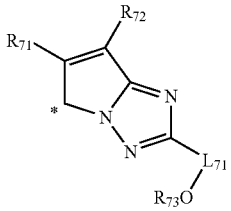

-continued

Formula (8)

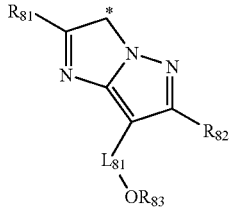

wherein $R_{71}$, $R_{72}$, $R_{81}$ and $R_{82}$ are each a hydrogen atom or a substituent; $R_{73}$ and $R_{83}$ are each a substituent: $L_{71}$ and $L_{81}$ are each a linkage group having one or two carbon atoms or a part of a ring structure and binds to $A_{11}$ of formula (2) at the position designated "*".

6. The toner of claim 1, wherein in formula (2), $A_{11}$, is —$CR_{17}$=, in which $R_{17}$ is a hydrogen atom or a substituent.

7. The toner of claim 1, wherein in formula (2), $R_{13}$ is an alkyl group having 1 to 4 carbon atoms.

8. The toner of claim 1, wherein in formula (1), M is $Cu^{2+}$.

9. The toner of claim 2, wherein the colored microparticles have an average particle size of 10 to 200 nm.

10. The toner of claim 2, wherein the colored microparticles further comprises a resin (1) differing in composition from the thermoplastic resin.

11. The toner of claim 2, wherein the colored microparticles each have a core comprising the dye of formula (1) and the resin (1) and a shell covering the core and comprising a resin (2).

12. The toner of claim 2, wherein the resin (2) is a (methyl) acrylate resin.

13. An image forming method comprising: imagewise exposing a uniformly charged photoreceptor to form an electrostatic latent image, developing the electrostatic latent image with a toner to form a toner image and transferring the toner image to a transfer material, wherein the toner is a toner as claimed in claim 1.

14. An image forming method of claim 1, wherein in formula (3), $R_{32}$ is a substituent selected from a group consisting of an alkyl group, an awl group, and a heterocyclic group.

15. An image forming method of claim 14, wherein $R_{32}$ is an alkyl group.

* * * * *